US009427060B2

(12) United States Patent
Mercier

(10) Patent No.: US 9,427,060 B2
(45) Date of Patent: Aug. 30, 2016

(54) DEVICE, KIT AND METHOD FOR COLORING HAIR

(75) Inventor: Michel Mercier, Hertzliya (IL)

(73) Assignee: KAMPALOOK LTD., Tel Aviv ( * ) Notice: Subject to any disclaimer, the term of this patent is extended or adjusted under 35 U.S.C. 154(b) by 1287 days.

(21) Appl. No.: 13/169,115

(22) Filed: Jun. 27, 2011

(65) Prior Publication Data

US 2011/0315157 A1 Dec. 29, 2011

Related U.S. Application Data

(60) Provisional application No. 61/358,507, filed on Jun. 25, 2010.

(51) Int. Cl.

*A45D 19/02* (2006.01)
*A45D 24/22* (2006.01)
*A45D 19/00* (2006.01)

(52) U.S. Cl.

CPC ..... *A45D 19/02* (2013.01); *A45D 24/22* (2013.01); *A45D 2019/0083* (2013.01); *A45D 2200/057* (2013.01)

(58) Field of Classification Search

CPC ..... A45D 19/0008; A45D 19/02; A45D 2019/0075; A45D 2019/0058; A45D 24/22; A45D 2200/057

USPC ..... 132/107–116, 124, 126, 120–121, 132/159–160, 212, 333, 148, 270; 401/196, 401/268; 119/611–612, 603–604

See application file for complete search history.

(56) References Cited

U.S. PATENT DOCUMENTS 2,849,009 A 8/1958 Heinrich
3,854,489 A 12/1974 Doyle et al.

(Continued)

FOREIGN PATENT DOCUMENTS

DE 29911802.9 11/2000
DE 10218502 10/2002

(Continued)

OTHER PUBLICATIONS

Downloaded on Feb. 22, 2014, for U.S. Appl. No. 12/817,524, filed Jun. 17, 2010—through Dec. 17, 2013.

(Continued)

*Primary Examiner* — Todd E Manahan
*Assistant Examiner* — Brianne Kalach
(74) *Attorney, Agent, or Firm* — Mark Van Dyke; Fourth Dimension IP

(57) ABSTRACT

A hair-penetrating shield 220 comprises a tooth array having top 280 and bottom 290 surfaces. In some embodiments, for a majority of the teeth, a cross section of each tooth (for example, triangular in shape) has an asymmetric width profile such that the tooth cross section, on average, is narrower near the top of the tooth and wider near the bottom of the tooth. In some embodiments, a ratio between: i) a first average tooth width describing the average tooth width below the top-bottom midpoint; and ii) a second average tooth width describing the average tooth width above the top-bottom midpoint is at least 1.2, or at least 1.6. In some embodiments, a non-viscous hair-coloring agent is dispensed as a mist over the top of the surface of the shield so as to color roots of hair passing through the spaces between the teeth of the user's hair. In some embodiments, closely-spaced teeth of the hair penetrating shield protect the user's scalp from the non-viscous hair-coloring agent. Related methods and kits are disclosed herein.

16 Claims, 55 Drawing Sheets

(56) References Cited

U.S. PATENT DOCUMENTS

| | | | | |
|---|---|---|---|---|
| 4,566,472 | A * | 1/1986 | Mueller et al. | 132/112 |
| 5,772,077 | A | 6/1998 | Tafur | |
| 6,286,518 | B1 | 9/2001 | Laporte | |
| 7,628,159 | B2 * | 12/2009 | De Laforcade | 132/112 |
| 2010/0300469 | A1 * | 12/2010 | Bachrach et al. | 132/107 |
| 2011/0005538 | A1 | 1/2011 | Mercier et al. | |

FOREIGN PATENT DOCUMENTS

| | | |
|---|---|---|
| DE | 20114390 | 1/2003 |
| EP | 0943260 | 9/1999 |
| EP | 1769697 | 4/2007 |
| FR | 2799621 | 4/2001 |
| JP | 8117012 | 5/1996 |
| JP | 8168409 | 7/1996 |
| JP | 8214936 | 8/1996 |
| JP | 9002554 | 1/1997 |
| JP | 2003230426 | 8/2003 |
| JP | 2004154459 | 6/2004 |
| JP | 2004155484 | 6/2004 |
| JP | 2008237693 | 10/2008 |
| JP | 2009106655 | 5/2009 |
| WO | WO9604814 | 2/1996 |
| WO | WO2005060786 | 7/2005 |
| WO | WO/2009/078017 | 6/2009 |

OTHER PUBLICATIONS

PCT search report/search opinion/patentability opinion for PCT/IL2008/001630 (mailed Oct. 6, 2009).
Machine-generated translation of JP2009106655 (May 2009).
Machine-generated translation of JP2008237693 (Oct. 2008).
Machine-generated translation of JP2004154459 (Jun. 2004).
Machine-generated translation of JP2003230426 (Aug. 2003).
Machine-generated translation of JP2004155484 (Jun. 2004).

* cited by examiner

REPLACEMENT SHEET

DEVICE, KIT AND METHOD FOR COLORING HAIR

FIELD AND BACKGROUND OF THE INVENTION

Embodiments of the present invention relate to a hair-coloring applicator device and to a related method for the coloring of hair.

Particular embodiments may be useful for the temporary coloring of graying hair, for example, at or near the hair roots.

Hair dyes are commonly used to hide the gray and white hairs typically caused by aging, as well as to alter other hair colors to suit personal taste. Hair colorants may be broadly classified into several types, although colorants of different types may be combined, and some colorants may not clearly belong to any one type [Anderson, *J. Soc. Dyers Colourists,* 116:193-196 (2000); Zviak and Millequant, [Zviak, Charles; Millequant, Jean. Editor(s): Bouillon, Claude; Wilkinson, John. Science of Hair Care (2nd Edition) (2005), 251-275. Publisher: CRC Press LLC, Boca Raton, Fla].

Permanent colorants are usually formed by mixing small aromatic precursors with an oxidizing agent, typically hydrogen peroxide. Following oxidation, the precursors covalently react with each other to form a dye. The small precursor molecules can diffuse into the hair more effectively than the larger dye molecule can diffuse out. An alkalizing agent, typically ammonia, is also added in order to cause swelling of the hairs, which allows maximum penetration of the precursors into the hair. In addition, the peroxide bleaches the original hair color, thereby allowing the color of the dye to completely replace the original hair color. Permanent colorants are quite popular, but they suffer the drawbacks of the complexity of correctly mixing and applying the precursors, and the use of potentially harmful reagents. Thus, permanent colorants are normally applied by professional hair stylists. In addition, even permanent coloring cannot hide the original hair color that inevitably reappears with the new growth of hair.

Demi-permanent colorants are similar to permanent colorants, but use lower concentrations of peroxide, and an alkalizing agent that is less effective than ammonia, but has a less unpleasant odor. Demi-permanent colorants are therefore less effective at penetrating the hair and bleaching the original hair color, and cannot be used to effectively color predominantly gray or white hair. However, the relative gentleness of such colorants makes them desirable when less effective coloring is sufficient, such as when gray or white hairs constitute a minority of hairs.

Semi-permanent colorants typically comprise molecules, such as nitrophenylenediamines and nitroaminophenols, which are small enough to diffuse into the hairs. Such colorants do not require additional reagents and are therefore easy to use, but they are less effective than permanent dyes, fade relatively quickly following several shampooings, and cannot bleach the original hair color.

Temporary colorants typically do not penetrate the hairs, and therefore are capable of only moderate changes in hair color. They are also removed by the first shampooing, and are therefore appropriate for individual occasions, and to make slight alterations to hair color, such as hiding gray or white new growth, until a more permanent colorant is applied. Because temporary colorants need not comprise small molecules capable of penetrating the hair, a wide variety of compounds may be used, which facilitates convenience. For instance, one may select dyes that have no risk of inducing an allergic reaction, which is not possible with more permanent colorants. There is also a large number of shades to choose from.

The ideal characteristics of a temporary hair colorant depend on the exact use of the colorant. Typically, however, it is important that the colorant be easily removable by shampoo, but not by rain, perspiration or friction from clothing or pillowcases. It is also desirable that the colorant have a sufficiently high affinity to hair, and to color hair evenly.

Temporary hair colorants have been used as ingredients in shampoos and conditioners, shading strengtheners, colored hair sprays and mascaras, aimed to be applied to the entire head of hair or as hair streaks. To provide even and stable coloring there are often several families of dyes used within a single formula. The charge of the dyes can be negative or positive to provide low or high affinity to the hair shaft, as dyes with positive charge (basic dyes) have a higher affinity to the hair.

Common temporary hair colorants include azo derivatives, basic triphenylmethane dyes such as methyl violet, azine derivatives such as safranine, and indoamines and indophenols [Zviak and Millequant, supra (2005)]. Colored polymers have been used, as well as artificial melanin.

Polymer colorants with a strong affinity to hair are often semi-permanent or permanent colorants. Examples of polymers with a strong affinity to hair which are semi-permanent colorants are disclosed in U.S. Pat. Nos. 4,182,612, 5,702,712 and 5,827,330.

A polymeric temporary colorant thereafter must have at most a moderate affinity to hair, and more desirable, a low affinity to hair. Examples of polymers suitable for temporary coloring of hair are disclosed, for example in U.S. Pat. Nos. 5,737,907 and 5,891,199.

Tannic acid, or gallic acid produced by hydrolysis of tannic acid, has for centuries been combined with ferrous ions to produce iron gall ink. After writing with the pale ink, the ferrous ions are oxidized by atmospheric oxygen to ferric ions, which react with the tannic acid to produce a dark violet-black organometallic polymer that can permanently bind to proteins, such as those in parchment. Iron gall ink is rarely used today, because paper does not comprise protein, and excess iron atoms are highly corrosive, damaging both paper and pens.

A similar process has been used to permanently or semi-permanently dye hair with a dye that binds the protein of hair. For example, EP Patent No. 327,345 discloses a kit which comprises a shampoo comprising ferrous ion for washing hair, and a solution comprising tannic acid which is applied to the hair after shampooing in order to create a semi-permanent black dye. Such a kit is inadequate for use as a temporary colorant because the colorant is semi-permanent, and because the use of two solutions (a tannic acid solution and a ferrous ion solution) is too lengthy and complex to appeal to consumers. Moreover, the kit disclosed therein must be used more than once in order to achieve full coloration.

Japanese Patent No. 2,014,324 and U.S. Pat. No. 4,946,472 disclose hair colorants comprising ferric ion and tannic acid in a single formulation. The colorants used in the taught formulations, however, are not temporary.

Chinese Patent Application No. 1990-104,017, Japanese Patent Nos. 3,014,160 and 48,031,902 and Japanese Patent Application Nos. 2002-47,287, 1993-312,065, 1988-292,113 and 1984-65,068 disclose permanent or semi-permanent hair colorants comprising ferrous iron and tannic acid in a single formulation. Based on the art of iron-tannic acid colorants, it is believed that ferrous ion undergoes oxidation to ferric ion (e.g. by exposure to air) before reacting with tannic acid to produce a colored polymeric iron tannate. Oxidation of ferrous ions in a hair colorant that has been applied to the hair results in the formation of an iron tannate polymer strongly bound to the hair, making the colorant non-temporary. These patents and patent applications are silent with respect to compositions that comprise tannic acid and ferric iron ions, let alone compositions that are devoid of unbound ferric ions.

Japanese Patent Nos. 61,055,483, 130,823, 94,800 and 93,052 and Japanese Patent Application Nos. 2005-206,160, 2000-85,556, 1990-336,606, 1987-245,287, 1984-177,514 and 1972-81,137 disclose permanent or semi-permanent hair colorants comprising two formulations, one of which comprises iron ions, and the other comprising tannic acid. Mixture of the two solutions in hair allows the production of iron tannates in the hair, the iron tannates thereby becoming bound to the hair.

In addition to the inability of such formulations to serve as temporary colorants, iron-tannic acid hair colorants suffer from several general deficiencies. The dark black color does not appeal to many consumers. In addition, all of the abovementioned formulations comprise unbound iron ions. Unbound iron is corrosive, and ferrous ion in particular produces highly oxidizing free radicals by the Fenton reaction. Excess iron can damage hair and cause unsightly skin hyper-pigmentation [Landsown, *Int. J. Cosmetic Sci.*, 23:129-137 (2001)].

Melanoidins are a family of brownish, colored compounds that result from the interaction between sugars and amino acids under moderate heat. Melanoidins are responsible for much of the browning and flavor of cooked foods, and hence are recognized as highly safe agents. However, melanoidins have not been disclosed as hair colorants heretofore.

It is advantageous for temporary hair colorants to comprise a formulation suitable for applying the colored compound(s) included therein to the hair with the desired ease and convenience. For example, the formulation may include solvents and/or surface active agents which allow the solubilization of the colored compound, and yet are fast drying formulation. It is also desirable in many cases for the formulation to include ingredients that prevent the temporary hair coloring from fading and/or rubbing off prematurely.

PCT Patent Application No. WO 94/10968 teaches an aqueous hair dye composition comprising solubilized melanin and a cationic material which binds the solubilized melanin to the hair via electrostatic interactions. The melanin is preferably solubilized by being oxidized with hydrogen peroxide, which is taught therein as imparting an ionic character to the melanin. The cationic material, such as a quaternium or polyquaternium compound, is taught therein as complexing the anionic melanin in a manner that increases the affinity of the melanin to the hair.

U.S. Pat. No. 6,506,374 teaches a hair coloring composition comprising alcohols to allow quick drying, and a polymer which prevents the color from rubbing off.

U.S. Pat. No. 5,821,240 teaches an aqueous hair coloring composition which includes a quaternary ammonium functional silane to prevent rubbing off.

Japanese Patent Application No. 1993-312,065 teaches a hair coloring composition comprising tannic acid, ferrous salts, and a silicone oil such as a silicone-polyether copolymer. Such silicone oils are non-volatile surface active agents useful in forming smooth films on hair.

As temporary hair colorants are desired for the potential ease and convenience of their use, it is particularly advantageous to have a quick and convenient technique for applying such colorants. Colorants in the form of pencils or wick-type applicators (e.g., U.S. Pat. No. 5,964,222) are frequently used to touch-up the hair along the hair line. Another technique involves combing into the hair a temporary hair colorant gel. In a further technique, hair colorant powder is applied by squeezing a bottle or by an aerosol container to dispense the powder, which is then worked into the hair line with the fingers.

SUMMARY OF THE EMBODIMENTS

The present disclosure describes a hair-coloring applicator device comprising (i) a shield device including an upper surface and a lower surface and (ii) an aerosol assembly for delivering a hair coloring composition or agent onto the upper surface of the shield.

At any given time, the hair-coloring applicator device may be useful for coloring hair in a specific 'local treatment region'—for example, at or near the hair line which delineates the border between the user's forehead and a 'hair mass' higher on the user's head. For example, rather than using the device to color an entirety or most of his/her hair, the device is especially useful for 'touching up' hair roots of visible regions of hair where the hair.

In one use-scenario, a user colors or dyes a majority of his/her hair from a 'natural color' to a 'target hair color' using any technique known in the art. At a later time (for example, a few days or few weeks later), the user's hair has grown so that the roots of his/her hair revert back to the 'natural' color. In many of these use cases, rather than rectifying this situation by coloring the entire hair mass (or even a significant fraction), the user is mainly interested in 'touching up' embarrassingly visible regions (for example, near the hair line bordering the forehead) where the hair-roots have reverted to their natural color. According to this an other use scenarios, the user may be interested in a 'quick, low effort' solution where the local regions of hair are treated quickly without requiring significant effort on the part of the user.

In some embodiments, the shield portion of the presently disclosed hair-coloring applicator may include a plurality of narrow elongated slots (e.g. substantially parallel to each other) via which strands of hair may pass. During usage, (i) the hair coloring composition is sprayed, from the aerosol assembly, into a region of space 'above' the hair shield; (ii) the shield is oriented to be substantially parallel to the local plane of the user's scalp so that user's scalp in the 'treatment region' is below the shield and protected by the shield from the hair coloring composition which may stain the scalp; and (iii) the user's hair at the 'treatment region' traverses (i.e. in an 'upward' direction) the thickness of the shield via the elongated slots so that at least a portion (preferably, including hair roots) of hair strands are located 'above' the shield (in contrast, to the scalp which is 'below' the shield and protected from the hair composition).

When the user sprays the hair coloring composition in a region of space 'above' the shield, the hair coloring composition makes contact with the 'traversing' hair strands to color at least a portion of the hair strands (for example, by coating the hair), preferably to color the roots of the hair strands. Furthermore, because the elongated slots are generally 'narrow' (though wide enough to accommodate the traversing hair strands), the shield can substantially prevent the sprayed hair coloring composition which may 'land' on the upper surface of the shield from traversing (i.e. in a 'downward' direction) below the shield to make contact with the scalp itself. Such contact may, in many use scenarios, be detrimental—for example, it may stain the scalp.

As noted before, in many use scenarios, the user only wants to color embarrassing grey (or another undesirable color) hair roots in specific localized regions. In this scenario, the user may generally be interested in a 'quick and easy low-effort solution' that does not require much effort expending any significant effort.

In some embodiments, instead of coloring hair with a hair-coloring cream or gel or a mousse as is known in the art (typically, the user needs to expend effort manually 'working in' or 'combing in' cream or gel or mousse), it may be advantageous to employ a quick-drying and/or non-viscous hair coloring composition that is configured to coat strands of hair without causing hair strands to stick together and without any need to manually 'work' the hair-coloring composition into the hair.

While a 'quick-drying' and/or 'non-viscous' hair coloring composition may be easy to work with (i.e. there is no requirement to 'work it into the hair' and/or it generally dries quickly), one salient feature of non-viscous liquids is that they tend to run or flow, which could increase the likelihood of exposure of the scalp to the hair-coloring agent. For example, the hair-coloring composition may be delivered over the top surface of the shield as a mist or even as a fine mist.

In some embodiments, it may be challenging to shield the scalp beneath the shield from droplets of hair-coloring mist (for example, accelerated by delivery from the aerosol assembly) and/or a hair-coloring agent provided as a non-viscous liquids.

Embodiments of the present invention relate to methods and apparatus which (allow the hair to upwardly penetrate above the shield so that the roots may be colored by the hair-coloring composition delivered (for example, as a spray) over the top surface of the shield; while nevertheless protecting the scalp below the shield from even non-viscous hair-coloring agents and/or hair-coloring agent delivered as a stream of droplets.

Experiments conducted by the present inventor have indicated that one or more of the following geometric properties may be useful for the shield:

(A) the narrow elongated slots are wide enough to accommodate the upwardly-traversing hair strands but narrow enough so that substantial quantities of hair-coloring composition do not downwardly penetrate below the shield onto the scalp;

(B) the narrow elongated slots may have some sort of length feature—i.e. they may be long enough to allow 'significant quantities' of hair to upwardly traverse the slots above the shield where the hair composition is delivered from the aerosol assembly. Elongated but narrow slots would thus have some sort of elevated 'slot aspect ratio' relating slot length (i.e. either the entire length of the slot or the 'aspect ratio' within a section of the slot having some sort of length) with some measure of the slot width—in some embodiments, the 'slot aspect ratio' may be at least 30 or at least 40 or at least 60 or at least 70 or at least 80 or at least 90 or at least 100);

(C) the shield portion of the device may include a plurality of generally aligned and/or substantially parallel teeth that are 'closely spaced' to each other—for example, slots or voids between laterally neighboring teeth may have any 'narrow slot' or 'narrow gap' property to block hair-coloring composition from 'downwardly' penetrating the shield to the scalp;

(D) although the teeth would not be 'extremely narrow,' in some embodiments, the teeth are not be 'too wide' (for example, teeth that are too wide may reduce the number of slots than can be fit in a device that is not 'too wide'). In some embodiments, the upper limit (e.g. averaged over a majority or significant majority or very significant majority of the teeth and/or averaged over the entire length of teeth or averaged over some lengthwise section of the tooth or shield) for tooth width (or the upper limit for average distances between slots) may be 4 mm, or 3 mm, or 2.5 mm, or 2 mm). Because 'longer teeth' may provide a more efficient device (i.e. longer slots to accommodate more hair strands), and because the teeth may have some sort of narrowness property, in some embodiments, the 'tooth aspect ratio' may be relatively large for example, at least 20 or at least 30 or at least 40 or at least 50 or any range or value disclosed herein. The tooth aspect ratio, discussed below, relates tooth length to tooth width or thickness or cross section averaged over the entirety of the tooth or over some 'section of tooth/length of tooth' along the tooth axis)

(E) the shape of the cross section of the teeth (or the cross section of the void between laterally-neighboring teeth) may also play a role in shielding the scalp below the shield while facilitating the upward traversal of hair strands so that the hair roots are 'exposed' to the aerosol-delivered hair-coloring composition. Thus, in one example, the present inventors have discovered that upwardly-pointing substantially triangularly-shaped teeth (i.e. teeth having a substantial triangular cross-section—see, for example, FIGS. 15, 21-22) may provide excellent results. These teeth (i.e. the cross section of the tooth in a majority or significant majority or very significant majority of locations along the tooth axis) may be are configured so that the narrowest 'gap' between laterally-neighboring teeth is near the tooth bottom. Not wishing to be bound by theory, it is noted that by locating the 'narrowest gap' between teeth near the bottom of the tooth, this may facilitate a situation where the root (and not only a 'higher' section of a strand of hair) upwardly penetrates above the 'nearest gap' between teeth into a region that is more exposed to the delivery of the aerosol hair-coloring composition. Furthermore, because the teeth are more narrow near the top, the void between teeth is wider at 'higher' locations near the top of the void or the top of the laterally neighboring teeth. This void geometry provided by the tooth geometry means that the roots of the hair strands in locations above the 'narrowest gap between teeth' are less likely to be shielded by the teeth in this 'higher' location above the 'narrowest gap between teeth';

(F) It is disclosed that there is no requirement for triangularly-shaped tooth cross sections, and in some embodiments, one or more features associated with for triangularly-shaped tooth cross sections for any tooth cross section shape. Thus, in some embodiments, the cross section of the tooth and/or the void between laterally-neighboring teeth may have an asymmetric width profile so that the tooth is wider at the bottom (i.e. on average, in most locations) and narrower at the top (or conversely, so that the void is wider at the top and narrower at the bottom so that the 'narrowest gap' is located near the bottom of the neighboring teeth).

(G) In some embodiments, the topography of the top surface of the shield and bottom surface of the shield may different so that the top of the shield feels relatively rough (e.g. due to an undulating surface that undulates in the lateral direction) and the bottom of the shield feels relatively smooth. The 'length scale' for the roughness and the smoothness would typically be around 1 mm (i.e. 0.5 mm or 0.75 mm or 1.25 mm or 1.5 mm or 2 mm).

This may be observed by observing the trajectory of a cylinder whose radius is 0.5 mm or 0.75 mm or 1 mm or 1.25 mm or 1.5 mm or 2 mm and who length is at least 0.5 cm or at least 1 cm or at least 2 cm or at least 3 cm or at least 4 cm) over the top and the bottom surfaces. The top surface which is 'rough' would cause the cylinder to undulate or oscillate when moved in a lateral direction over the top surface of the shield at a larger or much large magnitude than when in an identical experiment, the same cylinder is moved in a lateral direction over the bottom surface of the shield (where the vertical oscillations or undulations may be non-existent or much smaller).

In one example, for a majority of voids between teeth of a tooth array (of any number disclosed herein), when the cylinder is 'rolled' or moved laterally over the top surface of the shield in a lateral direction, the cylinder would undulate or oscillate at a first magnitude where the magnitude of vertical oscillations or undulations would be at least 0.5 mm or at least 1 mm or measure that is equal to the radius or 1.5 times the radius of cylinder. When the same cylinder, in the same location, is moved over the bottom surface of the shield, the magnitude of vertical oscillations or undulations for the bottom surface (i.e. a second magnitude) would be less (i.e. having a value that is at most 50% or at most 30% or at most 20% or at most 10% of the first magnitude observable for the top surface—for example, compare FIG. 25 to FIG. 27

In some embodiments, the ratio of (i) the magnitude of the undulations/vertical oscillations for the top surface (i.e. measured for the given cylinder) to (ii) the magnitude of the undulations/vertical oscillations for the top surface (i.e. measured for the same given cylinder) may be at least 1.5 or at least 2 or least 3 or least 5.

In one example, for the top surface the magnitude of oscillations or undulations of the cylinder may match (i.e. within a tolerance of 70% or 50% or 30%) the cylinder radius.

It is now disclosed for the first time a hair-coloring device for coloring hair roots, the device comprising: a) a hair-penetrating shield comprising a tooth array having top and bottom surfaces and having proximal and distal ends, the tooth array including at least eight closely-spaced teeth such that for a majority of teeth of the tooth array: i) each tooth of the majority includes a main portion and a tapered distal portion for facilitating hair penetration; and ii) for each tooth of the majority, the main portion includes a section having a length of at least 2.5 cm where for most locations along the tooth axis within the section: A) a cross section of the tooth has an asymmetric width profile along the shield thickness axis such that the tooth cross section, on average, is narrower near the top of the tooth and the tooth cross section, on average, is wider near the bottom of the tooth; B) the tooth cross-section is less than 5 mm^2; and C) the tooth is separated from a laterally neighboring tooth to provide a minimum gap distance that is between 0.3 mm and 1 mm, and b) an aerosol assembly coupled to the hair-penetrating shield, the aerosol assembly including an aerosol outlet elevated above the top surface of the shield, the aerosol assembly configured to dispense a non-viscous hair-coloring agent as a mist in a proximal-distal direction defined by the array of teeth onto the top surface of the shield such that the hair-penetrating shield protects the space beneath the bottom surface from the non-viscous hair-coloring agent.

In some embodiments, each tooth has a top-bottom midpoint that is midway between the tooth's top and bottom, and wherein for the majority of teeth of the tooth array, for most locations along the tooth axis within the section, a width ratio between:

i) a first average tooth width describing the average tooth width below the top-bottom midpoint;

ii) a second average tooth width describing the average tooth width above the top-bottom midpoint is at least 1.2.

In some embodiments, for the majority of teeth, for most locations along the tooth axis, the width ratio is at least 1.6.

In some embodiments, for the majority of teeth, for most locations along the tooth axis, the tooth cross section is less than 3 mm^2.

In some embodiments, for the majority of teeth, for most locations along the tooth axis wherein: i) each pair of laterally neighboring teeth T1 and T2 are positioned to form a respective intertooth lateral void that is in between the laterally neighboring teeth within a height range having upper and lower bounds: A) the upper bound being the lower height of the top of tooth T1 and the top of tooth T2, and B) the lower bound being the greater height of the bottom of tooth T1 and the bottom of tooth T2, and ii) a cross section of the respective intertooth void has an asymmetric width profile along the shield thickness axis such that the void cross section, on average, is wider near the top of the intertooth void and the intertooh void, on average, is narrower near the bottom of the intertooth void.

In some embodiments, i) each void has a top-bottom void mid-height level that is midway between upper and lower bounds of the height range; ii) for the majority of teeth of the tooth array, for most locations along the tooth axis within the section, a width ratio between: A) a first average void width describing the average void width above the top-bottom void mid-height level; B) a second average void width describing the average void width below the top-bottom void mid-height level, is at least 1.2.

In some embodiments, the tooth array includes at least 14 closely-spaced teeth.

It is now disclosed for the first time a hair-coloring device for coloring hair roots, the device comprising:

a) a hair-penetrating shield having top and bottom surfaces, comprising a slot array having at least eight elongated shield-thickness-spanning narrow slots that are substantially aligned a proximal-distal direction, the hair-penetrating shield including a longitudinal section of at least 2.5 cm where:

i) for a majority of slots of the array, each slot provide a shield-thickness-spanning property throughout a majority of the longitudinal section;

ii) an array-wide average cross-section-minimum-slot width is between 0.3 mm and 1 mm and/or for the majority of slots of the array each provide, throughout a majority of the longitudinal-subsection cross-section-minimum-slot width that is between 0.3 mm and 1 mm;

iii) for the majority of slots of the slot array, a slot aspect ratio within the longitudinal section is at least 30, the slot aspect ratio being defined by a ratio between the slot length within the section and an individual-slot longitudinal-averaged cross-section-minimum-slot width averaged over the longitudinal section;

iv) an array-wide average slot-slot lateral distance within the longitudinal section is at most 3 mm and/or at most a value equal to 3 times the array-wide average cross-section-minimum-slot width within the longitudinal section the hair-penetrating shield including a plurality of elongated, tapered penetrating elements located at the distal end of the shield; and;

b) an aerosol assembly coupled to the hair-penetrating shield, the aerosol assembly including an aerosol outlet elevated above the top surface of the shield, the aerosol assembly configured to dispense a non-viscous hair-coloring agent as a mist in a proximal-distal direction defined by the array of teeth onto the top surface of the shield such that the hair-penetrating shield protects the space beneath the bottom surface from the non-viscous hair-coloring agent.

In some embodiments, for each slot of the majority of slots, for most longitudinal locations within the longitudinal section, the slot exhibits an asymmetric width profile along the shield thickness axis such that the slot thickness is narrower near the bottom surface of the shield than it is near the top surface of the shield.

In some embodiments, for a majority of a region that is laterally bound by the first and last slot of the slot array and within the longitudinal section, the top surface is rough relative to the bottom surface for a topographic length scale of 1 mm.

In some embodiments, the slot array having at least 14 elongated shield-thickness-span ning narrow slots.

It is now disclosed for the first time a hair-coloring device for coloring hair roots, the device comprising: a) a hair-penetrating shield comprising a tooth array having top and bottom surfaces and having proximal and distal ends, the tooth array including at least eight closely-spaced teeth such that for a majority of teeth of the tooth array: i) each tooth of the majority includes a main portion and a tapered distal portion for facilitating hair penetration; ii) each tooth of the majority includes a longitudinal section having a length of at least 2.5 cm where: A) the aspect ratio of the tooth within the section is at least 20, the tooth aspect ratio between defined by a ratio between the tooth length within the section and a square root of the longitudinally-averaged tooth cross section within the section; B) for most locations within the tooth longitudinal section, the tooth cross-section is less than 5 mm^2; and C) for most locations within the longitudinal section, the tooth is separated from a laterally neighboring tooth to provide a minimum gap distance that is between 0.3 mm and 1 mm, b) an aerosol assembly coupled to the hair-penetrating shield, the aerosol assembly including an aerosol outlet elevated above the top surface of the shield, the aerosol assembly configured to dispense a non-viscous hair-coloring agent as a mist in a proximal-distal direction defined by the array of teeth onto the top surface of the shield such that the hair-penetrating shield protects the space beneath the bottom surface from the non-viscous hair-coloring agent.

In some embodiments, the tooth array includes at least 14 closely-spaced teeth.

It is now disclosed for the first time a hair-coloring device for coloring hair roots, the device comprising: a) a hair-penetrating shield comprising a tooth array having top and bottom surfaces and having proximal and distal ends, the tooth array including at least eight closely-spaced teeth such that for a majority of teeth of the tooth array: i) each tooth of the majority includes a main portion and a tapered distal portion for facilitating hair penetration; ii) each tooth of the majority includes a longitudinal section having a length of at least 2.5 cm where: A) for most locations within the tooth longitudinal section, the tooth cross-section is less than 5 mm^2; and B) the tooth is separated from a laterally neighboring tooth to provide a minimum gap distance, a ratio between a length of the longitudinal section of the tooth and the longitudinally-averaged minimum gap distance with the laterally neighboring tooth being at least 30, the minimum gap distance being, for most locations within the longitudinal section, that is between 0.3 mm and 1 mm; and b) an aerosol assembly coupled to the hair-penetrating shield, the aerosol assembly including an aerosol outlet elevated above the top surface of the shield, the aerosol assembly configured to dispense a non-viscous hair-coloring agent as a mist in a proximal-distal direction defined by the array of teeth onto the top surface of the shield such that the hair-penetrating shield protects the space beneath the bottom surface from the non-viscous hair-coloring agent.

In some embodiments, the tooth array includes at least 14 closely-spaced teeth.

It is now disclosed for the first time a hair-coloring device for coloring hair roots, the device comprising: a) a hair-penetrating shield comprising a tooth array having top and bottom surfaces and having proximal and distal ends, the tooth array including at least eight closely-spaced teeth such that for a majority of teeth of the tooth array: i) each tooth of the majority includes a main portion and a tapered distal portion for facilitating hair penetration; and ii) for each tooth of the majority, the main portion includes a section having a length of at least 2.5 cm where for most locations along the tooth axis within the section: A) a cross section of the tooth has an substantial triangular shape, the substantial triangle pointing upwards along the shield thickness axis; and B) the tooth cross-section is less than 5 mm^2; and b) an aerosol assembly coupled to the hair-penetrating shield, the aerosol assembly including an aerosol outlet elevated above the top surface of the shield, the aerosol assembly configured to dispense a non-viscous hair-coloring agent as a mist in a proximal-distal direction defined by the array of teeth onto the top surface of the shield such that the hair-penetrating shield protects the space beneath the bottom surface from the non-viscous hair-coloring agent.

In some embodiments, for the majority of teeth, for most locations along the tooth axis within the section, the topography of the top and bottom surfaces differ, the top surface being relatively bumpy and the bottom surface being relatively smooth in the lateral direction.

In some embodiments, the top surface is undulating in a lateral direction and/or a direction perpendicular to the tooth axis.

It is now disclosed for the first time a hair-penetrating shield useful for coloring hair roots, the shield comprising: a tooth array having top and bottom surfaces and having proximal and distal ends, the tooth array including at least eight closely-spaced teeth such that for a majority of teeth of the tooth array: i) each tooth of the majority includes a main portion and a tapered distal portion for facilitating hair penetration; and ii) for each tooth of the majority, the main portion includes a section having a length of at least 2.5 cm where for most locations along the tooth axis within the section: A) a cross section of the tooth has an asymmetric width profile along the shield thickness axis such that the tooth cross section, on average, is narrower near the top of the tooth and the tooth cross section, on average, is wider near the bottom of the tooth; B) the tooth cross-section is less than 5 mm^2; and C) the tooth is separated from a laterally neighboring tooth to provide a minimum gap distance that is between 0.3 mm and 1 mm.

It is now disclosed for the first time a hair-penetrating shield useful for coloring hair roots, the shield having top and bottom surfaces, the shield comprising a slot array having at least eight elongated shield-thickness-spanning narrow slots that are substantially aligned a proximal-distal direction, the hair-penetrating shield including a longitudinal section of at least 2.5 cm where: i) for a majority of slots of the array, each slot provide a shield-thickness-spanning property throughout a majority of the longitudinal section; ii) an array-wide average cross-section-minimum-slot width is between 0.3 mm and 1 mm and/or for the majority of slots of the array each provide, throughout a majority of the longitudinal-subsection cross-section-minimum-slot width that is between 0.3 mm and 1 mm; iii) for the majority of slots of the slot array, a slot aspect ratio within the longitudinal section is at least 30, the slot aspect ratio being defined by a ratio between the slot length within the section and an individual-slot longitudinal-averaged cross-section-minimum-slot width averaged over the longitudinal section; iv) an array-wide average slot-slot lateral distance within the longitudinal section is at most 3 mm and/or at most a value equal to 3 times the array-wide average cross-section-minimum-slot width within the longitudinal section, the hair-penetrating shield including a plurality of elongated, tapered penetrating elements located at the distal end of the shield.

It is now disclosed for the first time a hair-penetrating shield useful for coloring hair roots, the shield comprising a tooth array having top and bottom surfaces and having proximal and distal ends, the tooth array including at least eight closely-spaced teeth such that for a majority of teeth of the tooth array: i) each tooth of the majority includes a main portion and a tapered distal portion for facilitating hair penetration; ii) each tooth of the majority includes a longitudinal section having a length of at least 2.5 cm where: A) the aspect ratio of the tooth within the section is at least 20, the tooth aspect ratio between defined by a ratio between the tooth length within the section and a square root of the longitudinally-averaged tooth cross section within the section; B) for most locations within the tooth longitudinal section, the tooth cross-section is less than 5 mm^2; and C) for most locations within the longitudinal section, the tooth is separated from a laterally neighboring tooth to provide a minimum gap distance that is between 0.3 mm and 1 mm.

It is now disclosed for the first time a hair-penetrating shield comprising a tooth array having top and bottom surfaces and having proximal and distal ends, the tooth array including at least eight closely-spaced teeth such that for a majority of teeth of the tooth array: i) each tooth of the majority includes a main portion and a tapered distal portion for facilitating hair penetration; ii) each tooth of the majority includes a longitudinal section having a length of at least 2.5 cm where: A) for most locations within the tooth longitudinal section, the tooth cross-section is less than 5 mm^2; and B) the tooth is separated from a laterally neighboring tooth to provide a minimum gap distance, a ratio between a length of the longitudinal section of the tooth and the longitudinally-averaged minimum gap distance with the laterally neighboring tooth being at least 30, the minimum gap distance being, for most locations within the longitudinal section, that is between 0.3 mm and 1 mm.

It is now disclosed for the first time a hair-penetrating shield comprising a tooth array having top and bottom surfaces and having proximal and distal ends, the tooth array including at least eight closely-spaced teeth such that for a majority of teeth of the tooth array: i) each tooth of the majority includes a main portion and a tapered distal portion for facilitating hair penetration; and ii) for each tooth of the majority, the main portion includes a section having a length of at least 2.5 cm where for most locations along the tooth axis within the section: A) a cross section of the tooth has an substantial triangular shape, the substantial triangle pointing upwards along the shield thickness axis; and B) the tooth cross-section is less than 5 mm^2.

It is now disclosed for the first time a method of touching up hair roots of an individual, the method comprising:

a) engaging any presently-disclosed hair-penetrating shield to a user's head so that the bottom surface of the shield faces that user's scalp and so that root regions of the user's hair pass through spaces between the teeth of the shield; and b) dispensing a non-viscous hair-coloring agent as a mist on the top surface of the shield so as to color the root regions of the user's hair such that the hair-penetrating shield protects, from the non-viscous hair-coloring agent, the user's scalp that is facing the bottom surface of the shield.

It is now disclosed for the first time a kit comprising: a) any presently-disclosed hair-penetrating shield; and b) an aerosol assembly including an aerosol outlet elevated above the top surface of the shield, the aerosol assembly configured to dispense a non-viscous hair coloring agent as a mist in a proximal-distal direction defined by the array of teeth onto the top surface of the shield such that the hair-penetrating shield protects the space beneath the bottom surface from the non-viscous hair-coloring agent.

As used herein the term "about" refers to ±10%.

The term "comprising" means that other steps and ingredients that do not affect the final result can be added. This term encompasses the terms "consisting of" and "consisting essentially of".

As used herein, the singular form "a", "an", and "the" include plural references unless the context clearly dictates otherwise. For example, the term "a compound" or "at least one compound" may include a plurality of compounds, including mixtures thereof.

Throughout this disclosure, various aspects of this invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE EMBODIMENTS

Figure 1:
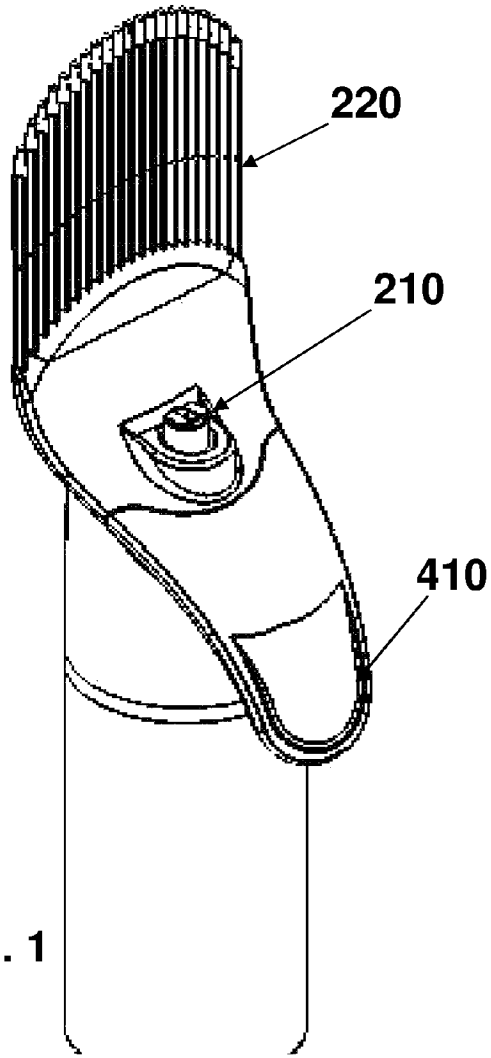
FIGS. 1-4 illustrate various views of an apparatus for coloring hair in accordance with some embodiments.

Some embodiments of the present invention relate to methods and apparatus that were disclosed in PCT/IL2008/001630 which (i) was filed on Dec. 17, 2008; (ii) was published on Jun. 25, 2009 as WO/2009/078017; and (iii) is incorporated herein by reference in its entirety. In some embodiments, any feature or combination of features described in the present document may be combined with any feature of combination of features described in application PCT/1 L2008/001630.

The present invention, in some embodiments thereof, is of a hair coloring applicator, and of hair coloring agents and compositions which can be used to color hair.

Specifically, the present invention can be used to color ("touch-up") hair along a hair line in a quick and convenient manner, particularly with a temporary hair coloring composition which is based on hair coloring agents that are substantially natural (e.g., derived from naturally-occurring substances), environmentally-friendly, and which exhibit natural hair shades, and/or a suitable volatile carrier devoid of alcohol.

The principles and operation of a hair coloring applicator according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

FIGS. 1-4 illustrate various views of an apparatus for coloring hair in accordance with some embodiments.

Figure 5:
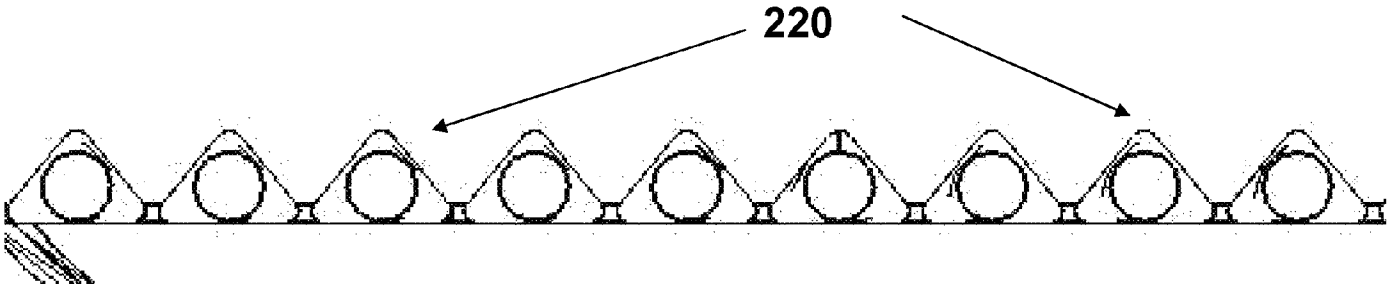
FIGS. 5-6 illustrate an array of teeth.
Figure 6:
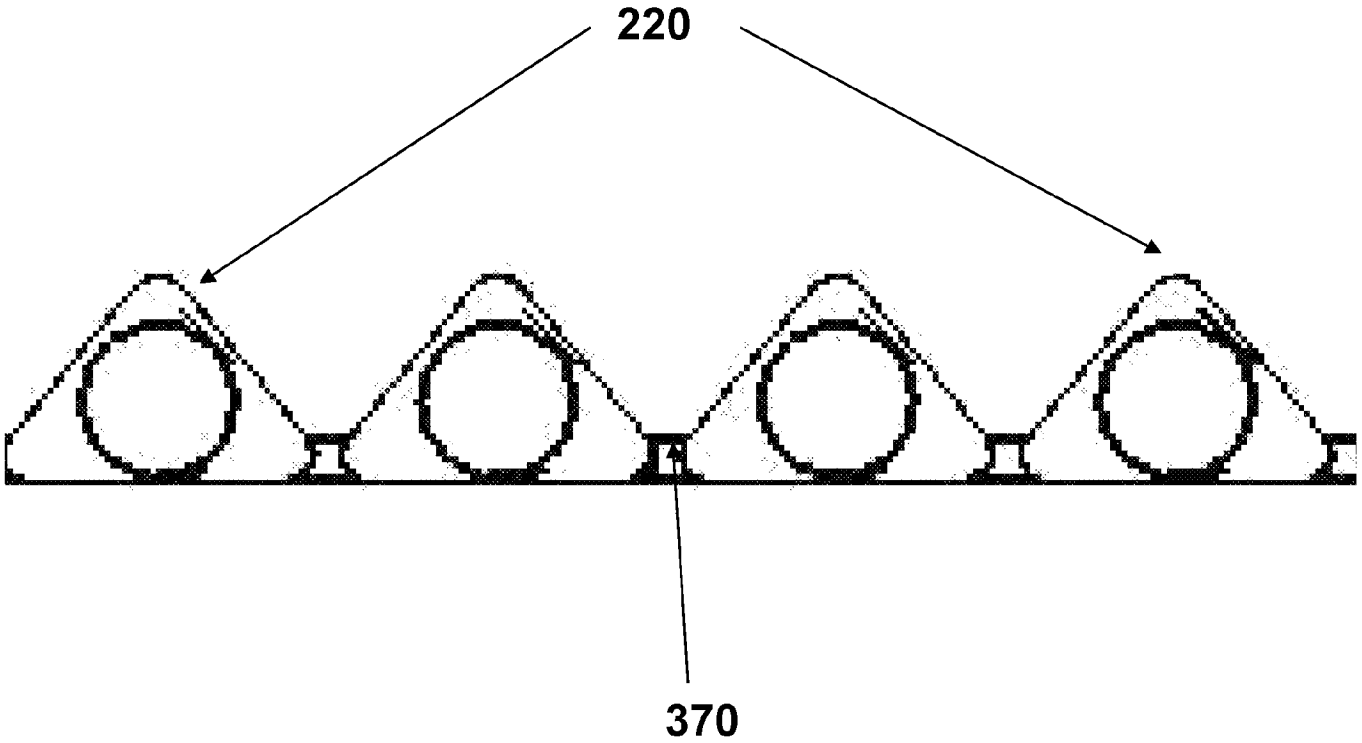

FIGS. 5-6 illustrate an array of teeth.

Figure 7:
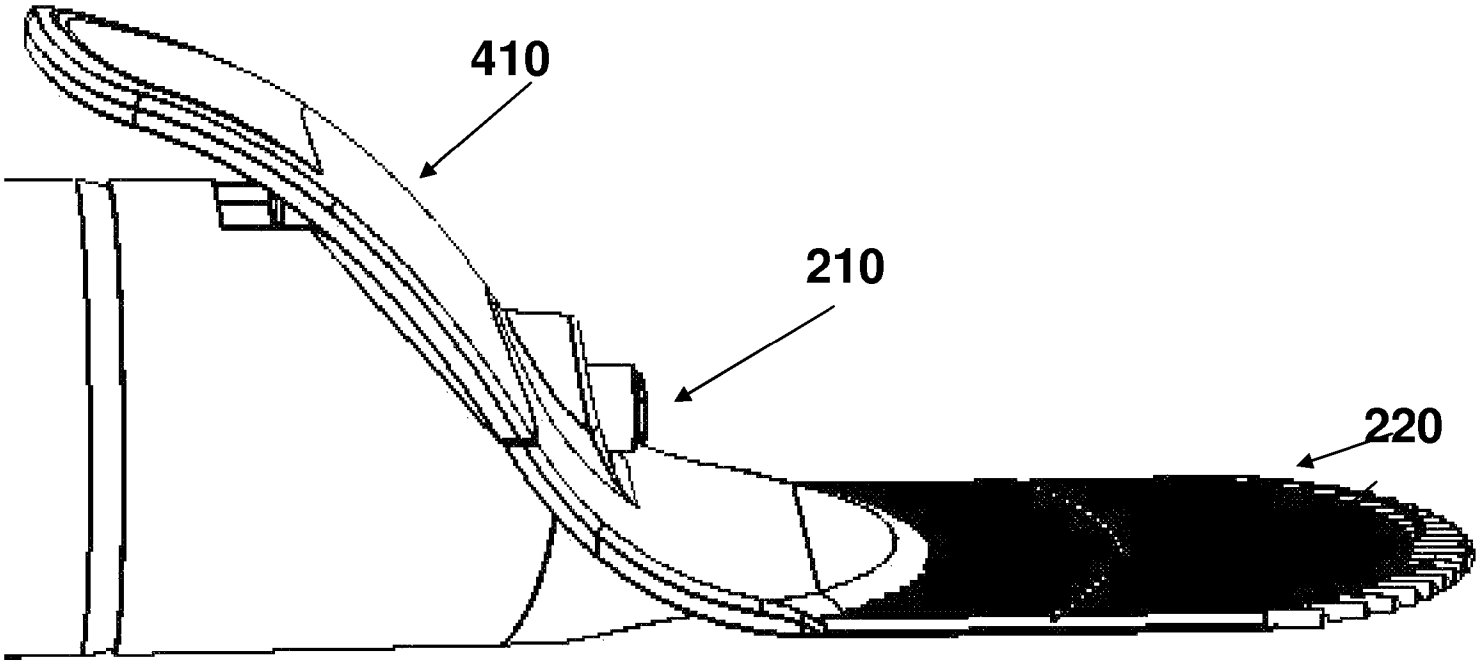
FIG. 7-8 illustrate a side view of an apparatus for coloring hair in accordance with some embodiments.
Figure 8:
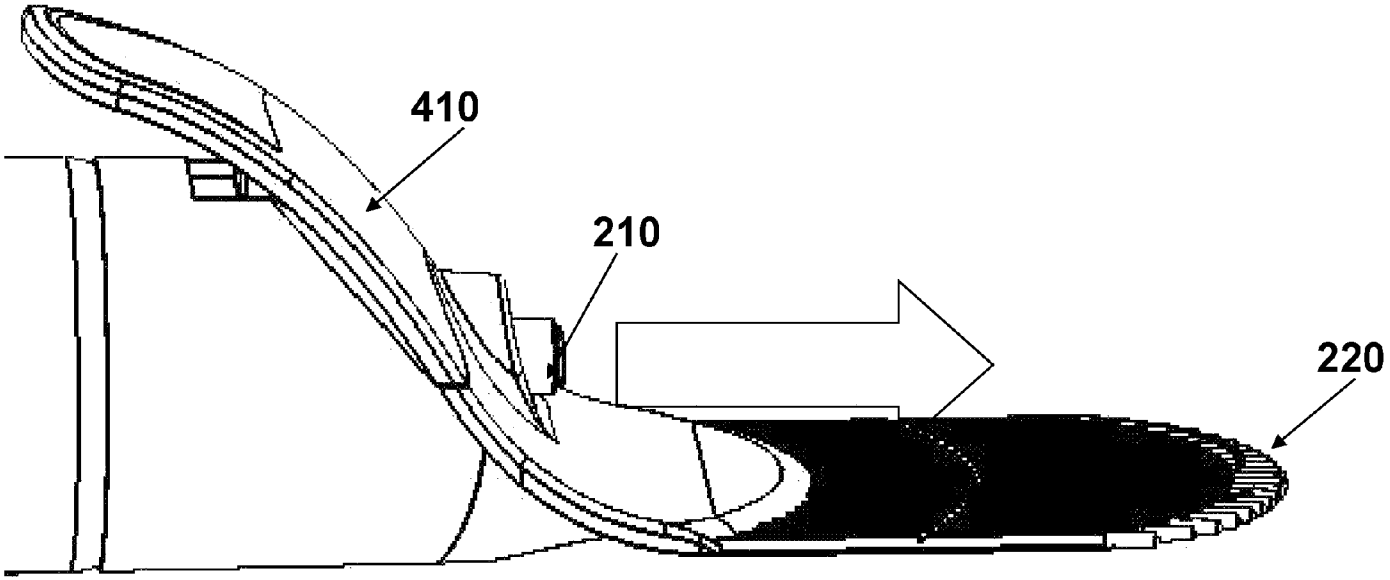

FIG. 7-8 illustrate a side view of an apparatus for coloring hair in accordance with some embodiments.

Figure 10:
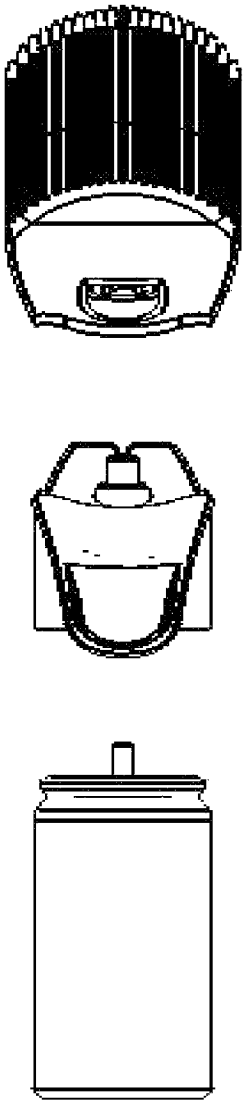
FIGS. 9-10 illustrate an exploded view of an apparatus for coloring hair in accordance with some embodiments.
Figure 9:
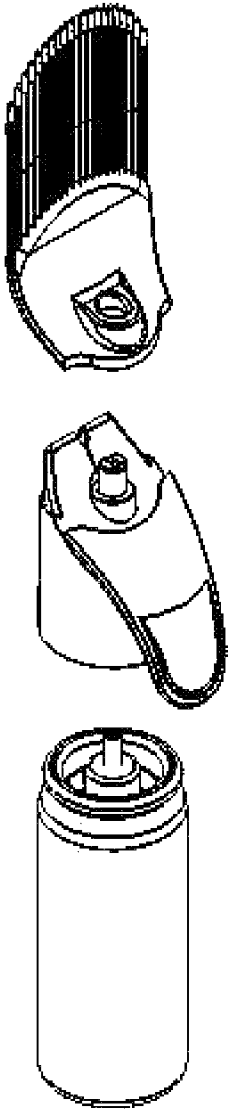

FIGS. 9-10 illustrate an exploded view of an apparatus for coloring hair in accordance with some embodiments.

Figure 11A:
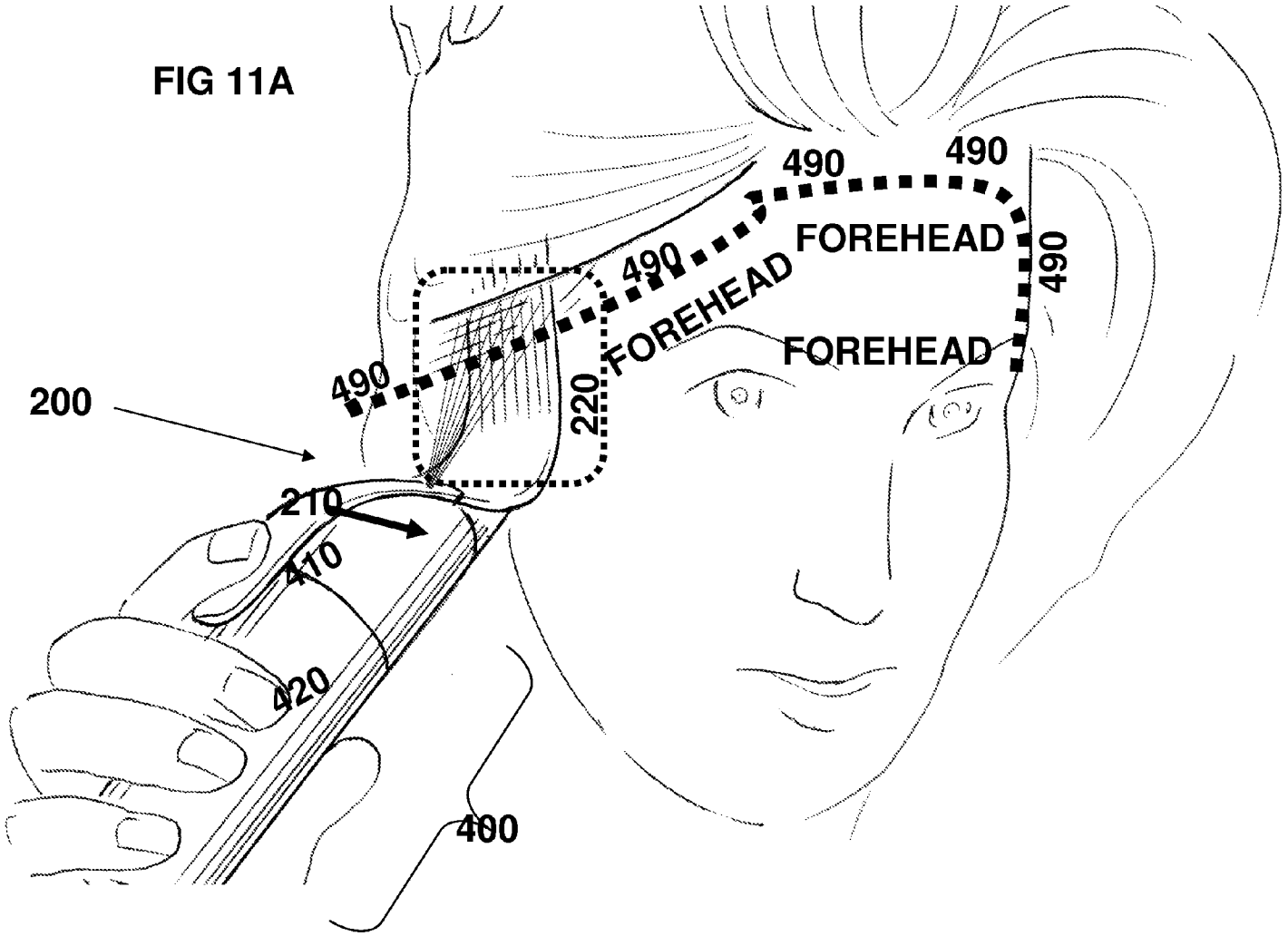
FIGS. 11-12 illustrate usage of an apparatus for coloring hair to color hair in accordance with some embodiment.
Figure 11B:
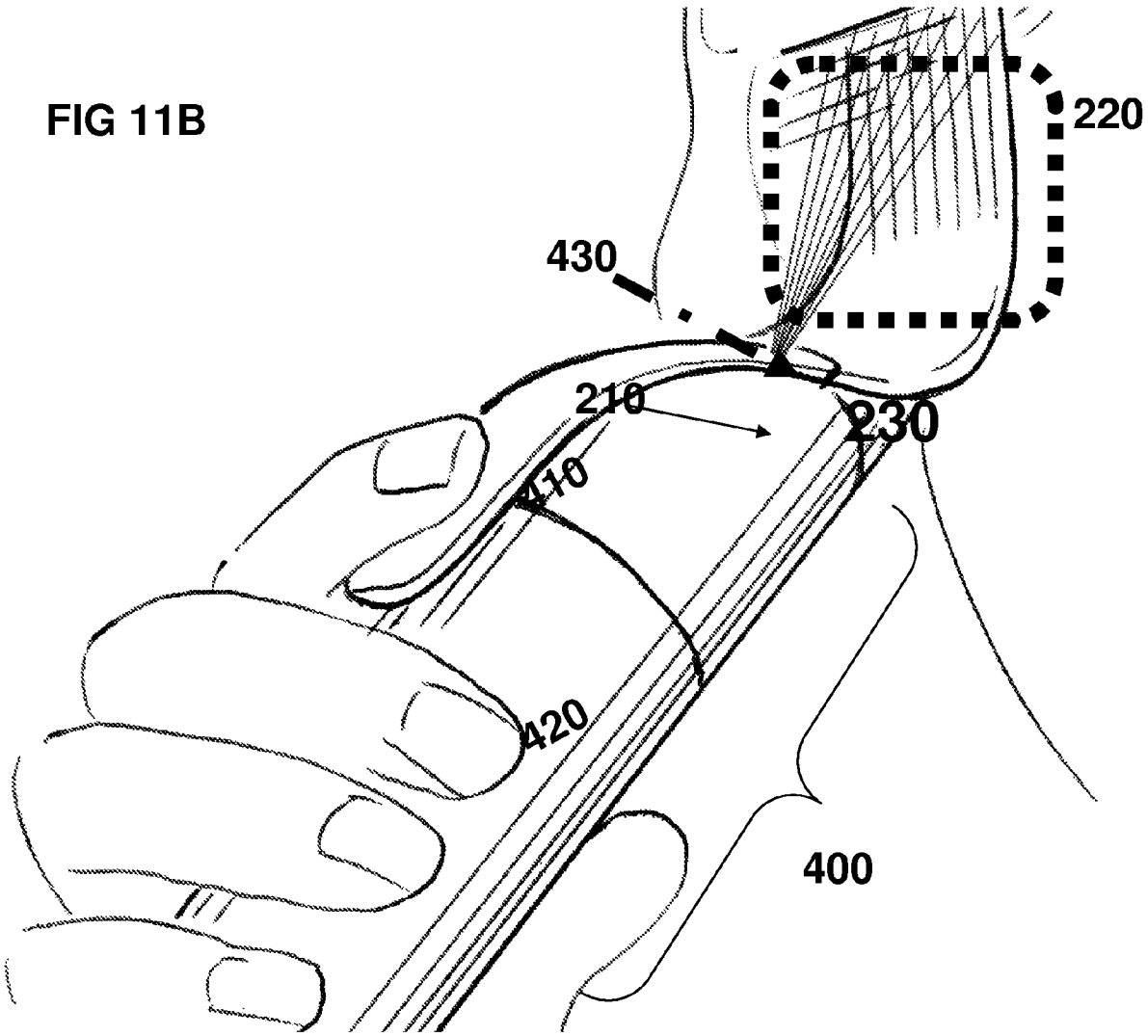
Figure 11C:
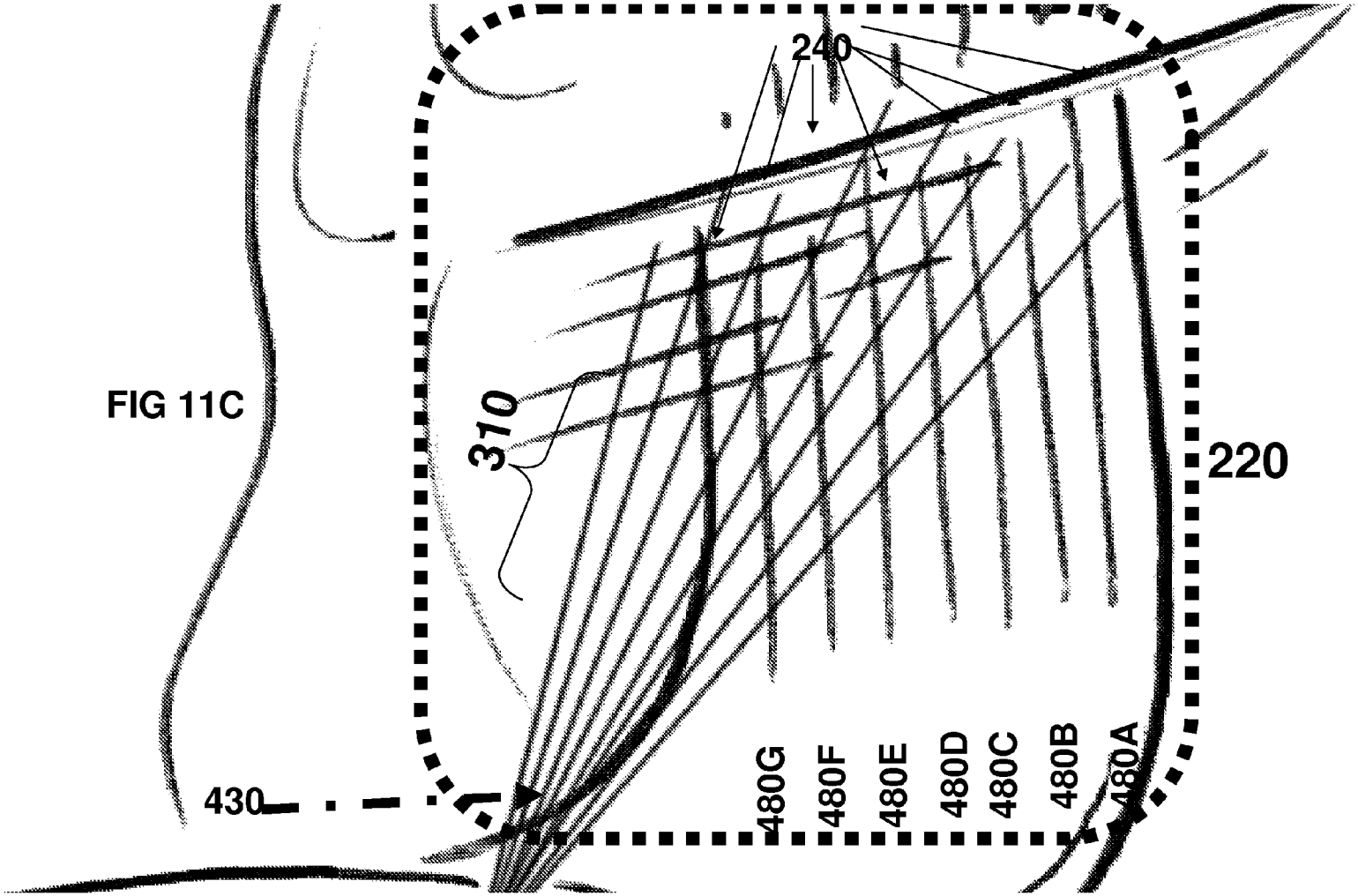
Figure 12:
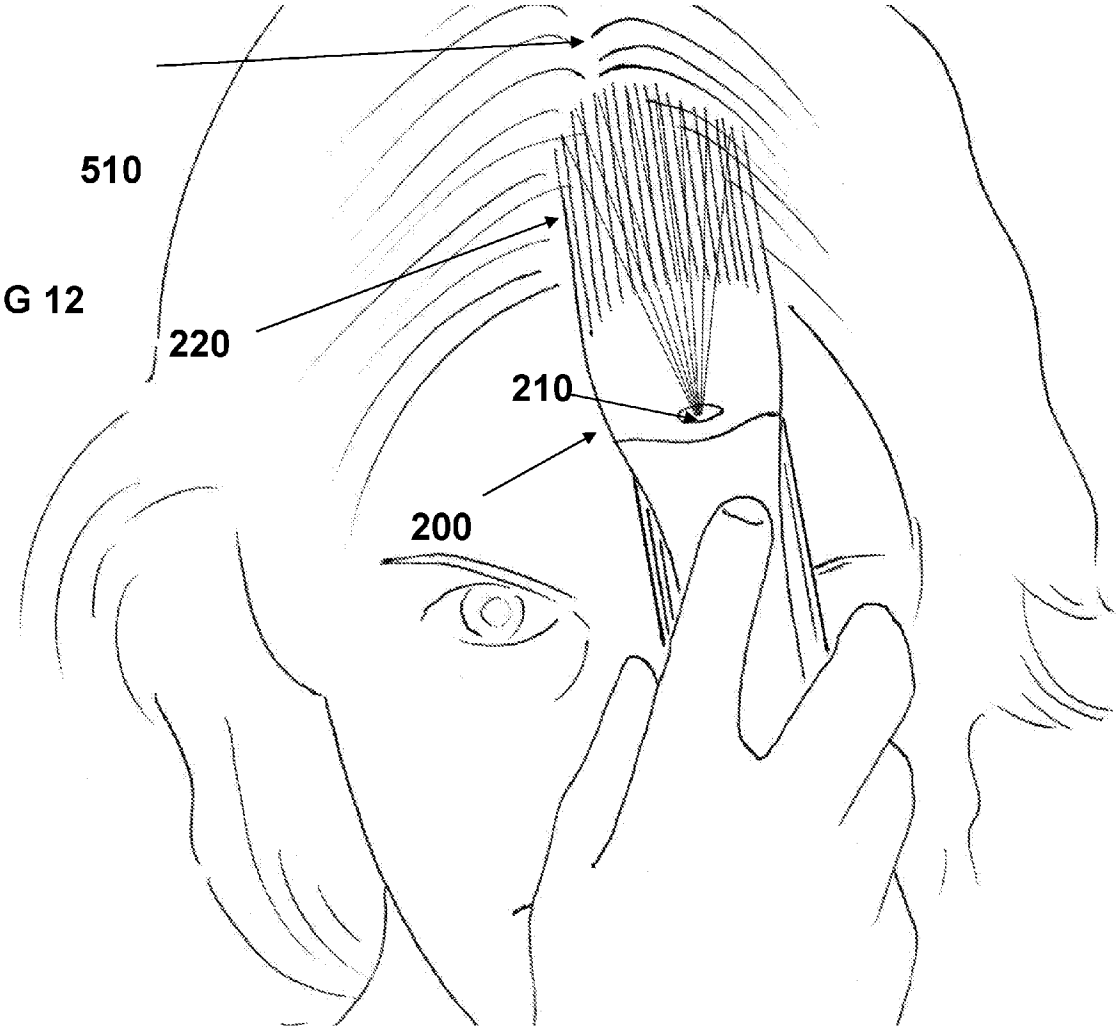
Figure 13A:
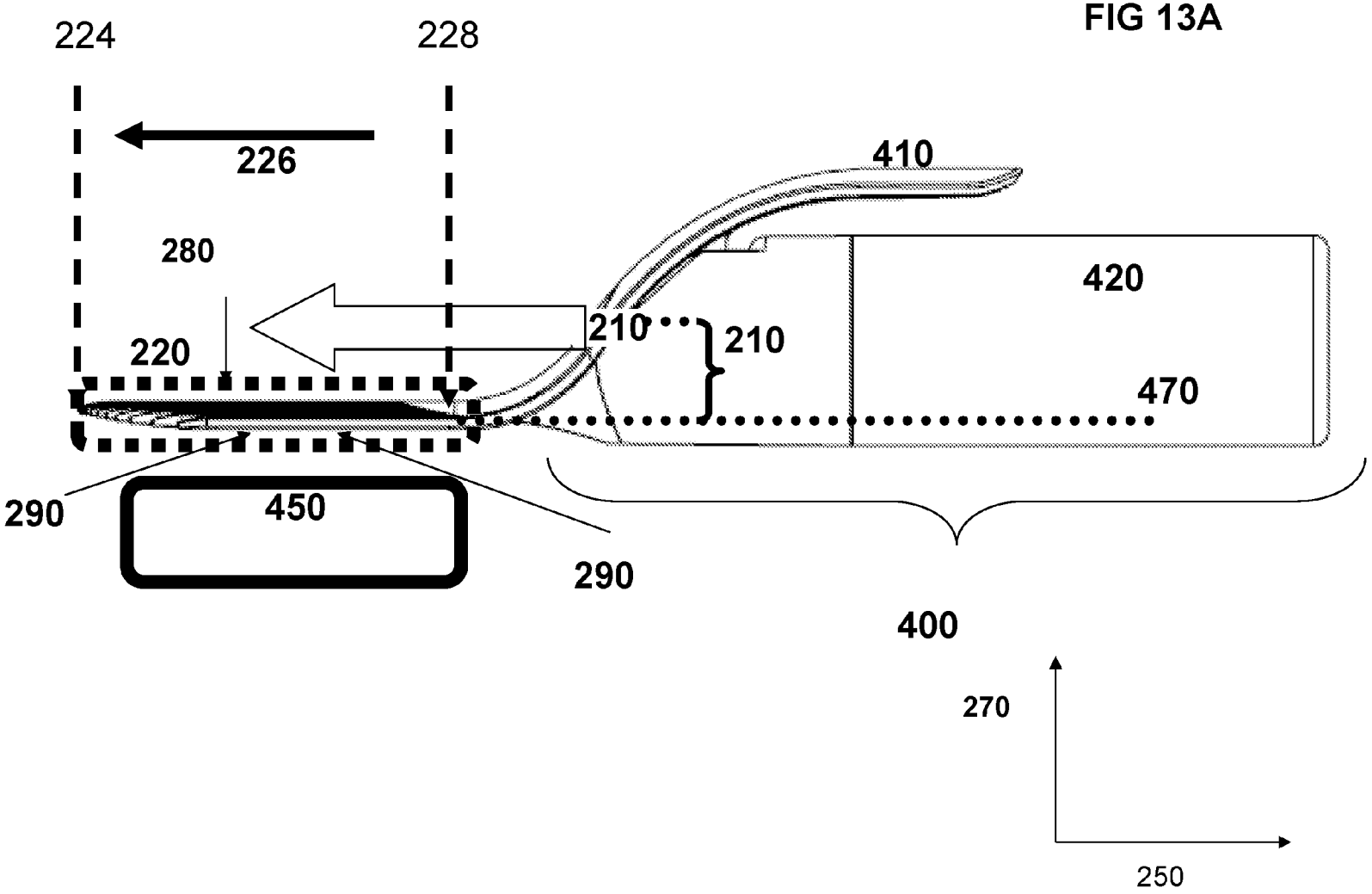
FIGS. 13A-13C illustrate spraying a hair-coloring mist composition over a top surface of a shield.
Figure 13B:
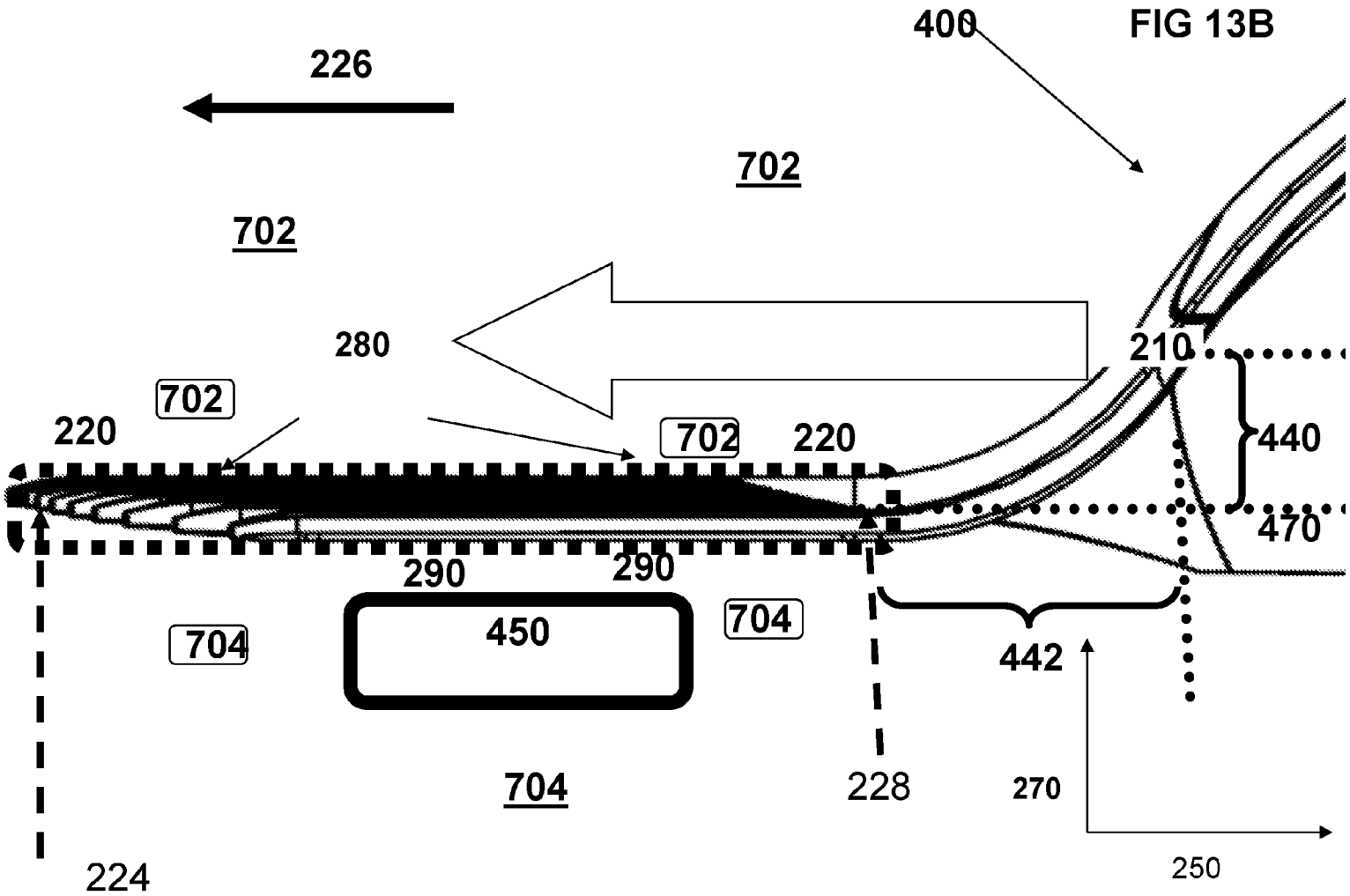
Figure 13C:
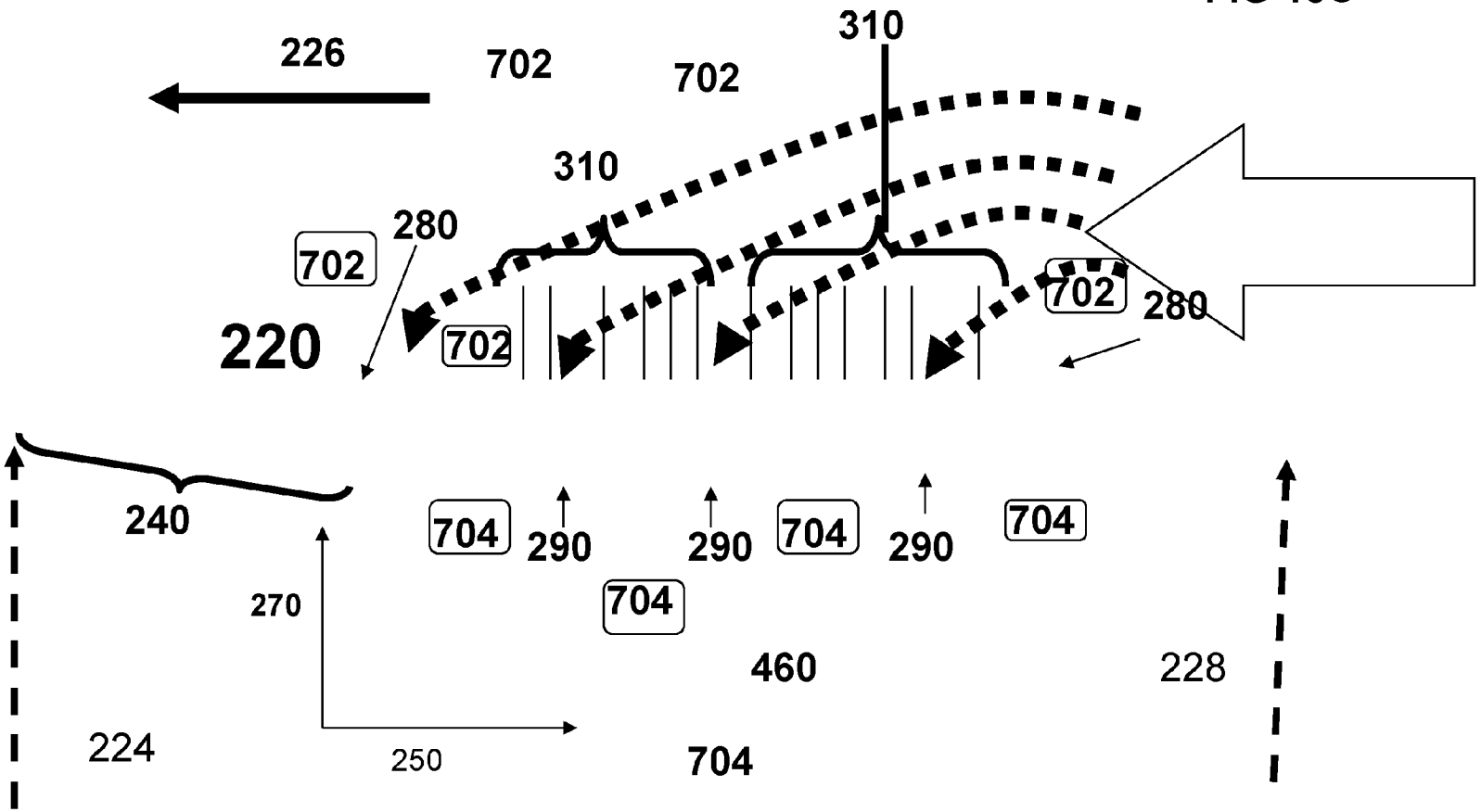

FIG. 11A-11C illustrates one use scenario where a user employs a hair coloring device 200 to color roots of her hair—for example, in the 'peripheral' region 490 bordering the forehead. FIG. 12 illustrates another use case. FIGS. 13A-13C are side views of the device 200 employed in the use cases of FIGS. 11-12. As will be discussed below, in one non-limiting usage scenario, device 200 including shield 220 may be useful for coloring the user's hair (more specifically, the roots of the user's hair) with an aerosol spray (for example, a mist or a stream of droplets including a hair-coloring agent and an alcoholic solvent) while simultaneously protecting the user's scalp from being subjected to the hair coloring agent.

In some embodiments, the hair color provided in the spray form is 'quick-drying' and/or non-viscous. In these embodiments, despite the ability of the hair coloring solution to 'run' upon landing on a surface of the shield 220 (i.e. due to the non-viscous nature of the hair-coloring spray in these embodiments), shield 220 nevertheless may provide geometric properties that facilitate the protection of the user's scalp from the hair coloring agent.

As will be discussed below, in order to provide this protection and/or other features, shield 220 may, in some embodiments, provide one or more of the following features: (i) 'thin elongated' slots having a high 'slot aspect ratio'; (ii) an array of closely-spaced teeth where the teeth or the voids between the teeth have a 'high aspect ratio'; (iii) teeth with a specific cross-section shape (for example, triangular); and/or one or more additional features discussed herein The device 200 comprises (i) a relatively flat hair-penetrating shield 220 and (ii) an aerosol assembly 400. Hair-coloring aerosol spray is dispensed from aerosol opening/outlet 210 over the 'front' surface 280 of shield 220—the path taken by the aerosol onto the top/front surface 280 is illustrated by the block arrow labeled "spray" in FIGS. 13A-13C, and is also labeled as element 430 in FIG. 11B.

While not a limitation, in some embodiments, the spray is a 'fan spray' configured to angularly distribute aerosol spray substantially uniformly over an angle that is at least 20 degrees or at least 30 degrees or at least 40 degrees and/or at most 180 degrees and/or at most 120 degrees and/or at most 90 degrees and/or at most 70 degrees and/or at most 50 degrees and/or at most 40 degrees. In some embodiments, the fan spray produced by the aerosol assembly has a substantially planar shape (i.e. in a plane that is substantially parallel to the relatively flat surfaced of shield 220 and/or intersects this surface at an angle of less than 30 degrees or less than 20 degrees or less than 10 degrees). A discussion about the spray assembly including the orifice and the 'spray insert' is provided below with reference to FIG. 30.

In some embodiments, (i) this aerosol spray is directed to the front surface 280 of shield 220; and (ii) the mechanical structure of shield 220 blocks this aerosol from reaching space 450 beneath shield 220—i.e. space on the side of shield 220 defined by bottom/back surface 290 of shield 220. In the example of FIGS. 11-12, shield 220 may be oriented so that back surface 290 is held against the user's scalp which is 'below' back surface 290—see FIGS. 11-12 where the front surface 280 'faces away from the user's scalp, while the back surface 290 (not visible in FIGS. 11-12) is pressed again the user's scalp. In this example, shield 220 is oriented to that the relatively flat structure of shield 220 is pressed against and substantially parallel to the 'local relatively flat surface' of the user's scalp.

For the present disclosure, the terms 'above' and 'below' shield 220 refer to 'above' and 'below' shield 220 along the 'shield thickness axis' 270 defined in FIGS. 13A-13C irrespective of shield 220 or device 200 orientation. In FIGS. 13B-13C, the region 'above' shield 220 is labeled as 702, while the region 'below' shield 220 is labeled as 704. Because the term 'above' and 'below' are defined irrespective of shield 220 or device 200 orientation, in the example of FIG. 11, even though shield 220 is substantially vertical, the region into which the hair-coloring aerosol is spray is 'above' shield 220, while the scalp to which back surface 290 of shield is pressed is 'below' shield 220.

As noted above, one function of device 200 is to protect or shield the scalp 'below' the shield from being directly subjected to the hair-coloring agent delivered as an aerosol. Another function of device 200 is to facilitate the deliver of the hair-coloring agent to the hair strands—for example, to the roots of the hair. Thus, shield 220 may include a plurality of relatively narrow slots 480 (see FIG. 11C) that are wide enough to accommodate strands of hair but not much wider. As illustrated in FIG. 11C, these slots may be generally aligned with each other and/or generally aligned with longitudinal axis 250 of the shield.

For the present disclosure, a slot at a given location (e.g at a 'longitudinal location' having a value along the slot axis or tooth axis or longitudinal axis 250) may have a 'shield-thickness-spanning' property at a location if it is possible to traverse the slot, at the given location, in the 'thickness/height' direction—i.e. along shield thickness axis 270. Thus, with reference to FIGS. 13B-13C, it would be possible to 'travel' via the slot at the given location has a 'shield-thickness-spanning' property from the region 704 upward to region 702 (or vise-versa).

The strands of hair 310 rooted in the user's scalp traverse the narrow slots (i.e. along the 'shield thickness axis' 270 defined in FIGS. 13A-13C from back surface 290 to front surface 280) to emerge 'above the shield' into region of space 'above' the shield 702. As shown in FIG. 11C, these hair strands 310 (or a portion thereof) then may be 'co-located' with the sprayed hair-coloring aerosol in the region above shield 702 and subjected to the sprayed hair-coloring agent to facilitate the coloring of hair roots.

In some embodiment, (i) the narrow slots 480 are indeed narrow (for example, having a narrowest width in the range of 0.2 mm to 1 mm—for example, at least 0.2 mm or at least 0.3 mm—for example, at most 1 mm or at most 0.8 mm or at most 0.7 mm or at most 0.7 mm or at most 0.6 mm), and (ii) the shield 220 is geometrically structured to substantially lack other features (i.e. holes, orifices, openings, etc) that would allow aerosol to traverse shield 220 in a 'downwards' direction along axis 270 from region 702 to region 704. Thus, it is possible to provide a device and method which will substantially localize the aerosol-delivered hair-coloring agent to the front surface 280 (and hence, localize the aerosol-delivered hair-coloring agent to the hair strands 310 or in some preferable embodiments to roots of hair strands 310) of shield 220 while protecting the scalp which is located 'below shield 220' in region 704.

In addition, in some embodiments, due to the narrowness of slots 480 and/or to the 'denseness' of material in space defined by shield 220, shield 220 is not really a comb. Instead, shield 220 may be used to penetrate (to a certain degree) into the hair region substantially at the 'border' region 490 between the mass of hair and the user's forehead (see FIG. 11) and/or in regions of hair parts (see FIG. 12)—in some embodiments, it may be difficult for the hair-penetrating shield to penetrate much deeper into the user's hair mass.

Nevertheless, in many use-scenarios, a user colors or dyes a majority of his/her hair from a 'natural color' to a 'target hair color' using any technique known in the art. At a later time (for example, a few days or few weeks later), the user's hair has grown so that the roots of his/her hair revert back to the 'natural' color. In many of these use cases, rather than rectifying this situation by coloring the entire hair mass (or even a significant fraction), the user is mainly interested in 'touching up' embarrassingly visible regions (for example, near border region 490 and/or in a hair part 510) where the hair-roots have reverted to their natural color. Towards this end, in some embodiments, the shield may be useful for this purpose even if the shield 220 may lack 'combing functionality' (i.e. in some embodiments) and usage may be substantially confined to these 'border' visible regions of the hair.

In order to protect the scalp and/or provide 'opportunities' for hair-strands to upwardly traverse shield 220 to be exposed to the aerosol-provided hair coloring agent, shield 220 may, in some embodiments, provide one or more of the following features: (i) 'thin elongated' slots having a high 'slot aspect ratio'; (ii) an array of closely-spaced teeth where the teeth or the voids between the teeth have a 'high aspect ratio'; (iii) teeth with a specific cross-section shape (for example, triangular) and/or one or more additional features discussed herein. As will be discussed below, the 'thinness' of slots or voids or gaps may be useful for hindering downward motion of even a non-viscous substance—since certain slots or voids or gaps may still be wide enough to accommodate hair strands (i.e. whose width may be on the order of magnitude of a hundred or hundreds of microns), the 'long slot' or 'long void' feature may be useful for providing an extended area where hair strands can 'upwardly' traverse the shield into a space above the shield, where hair-coloring agent (for example, droplets of spray) may coat the hair strands.

In another example (see FIG. 15), individual teeth may have some sort of asymmetric width profile where the teeth are wider (or conversely, the 'slot' or 'gap' between teeth is narrower) 'closer' to the bottom 290 surface while the teeth are narrower (or conversely, the 'slot' or 'gap' between teeth is wider) near the top 280 surface. As will be discussed below, locating the 'minimum gap location' near the bottom may be useful for facilitating where the hair roots, in particular, are subjected to the hair-coloring agent—for example, including black hair color and/or hair coloring agent capable of 'coating' the hair.

Another feature that may be provide by device 200 whose use is illustrated in FIGS. 11-12 is the ability to 'penetrate' into the user's hair at a 'border location' when the shield is oriented substantially parallel to the local plane of the user's head.

Figure 16:
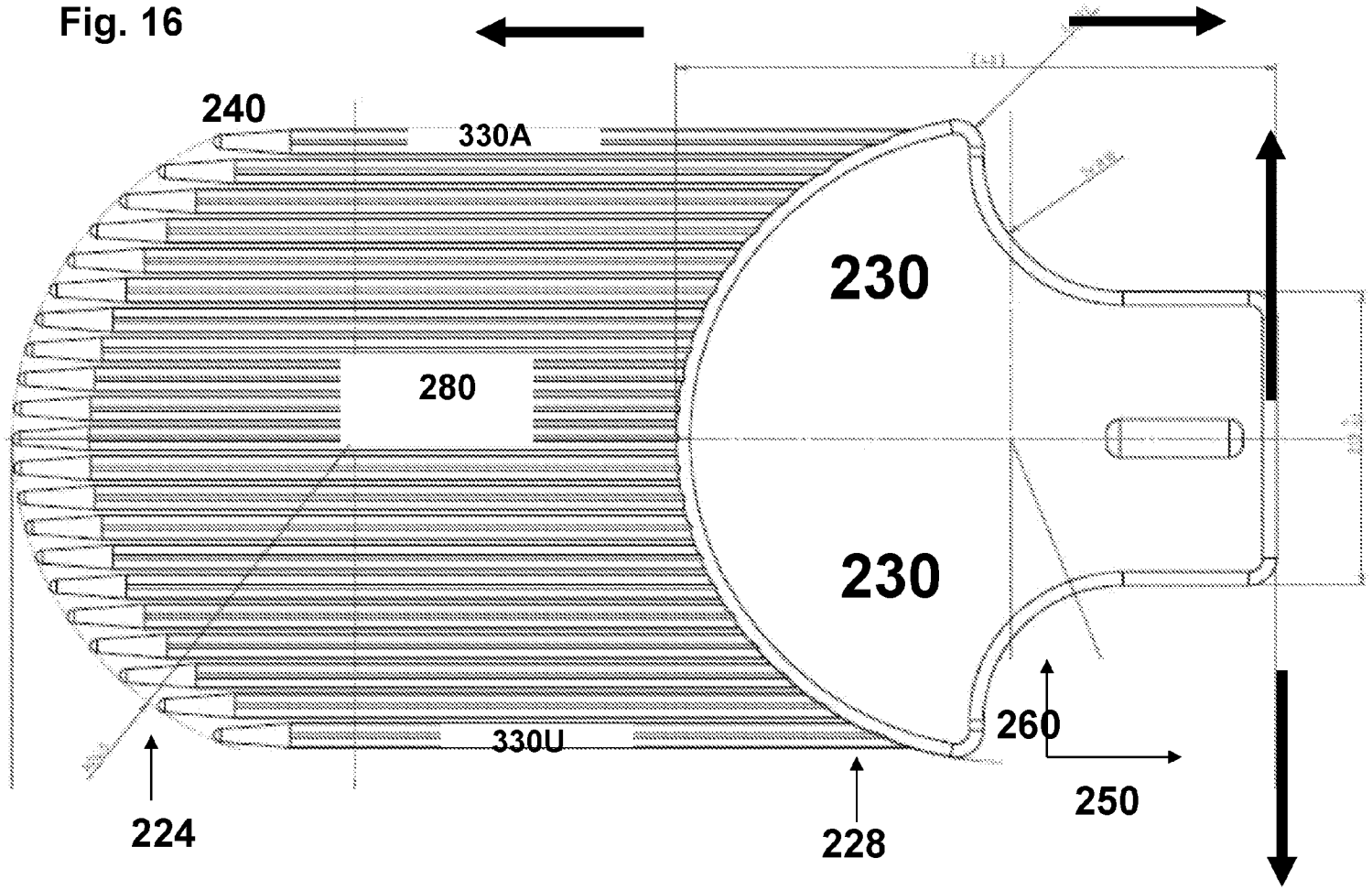
Figure 17A:
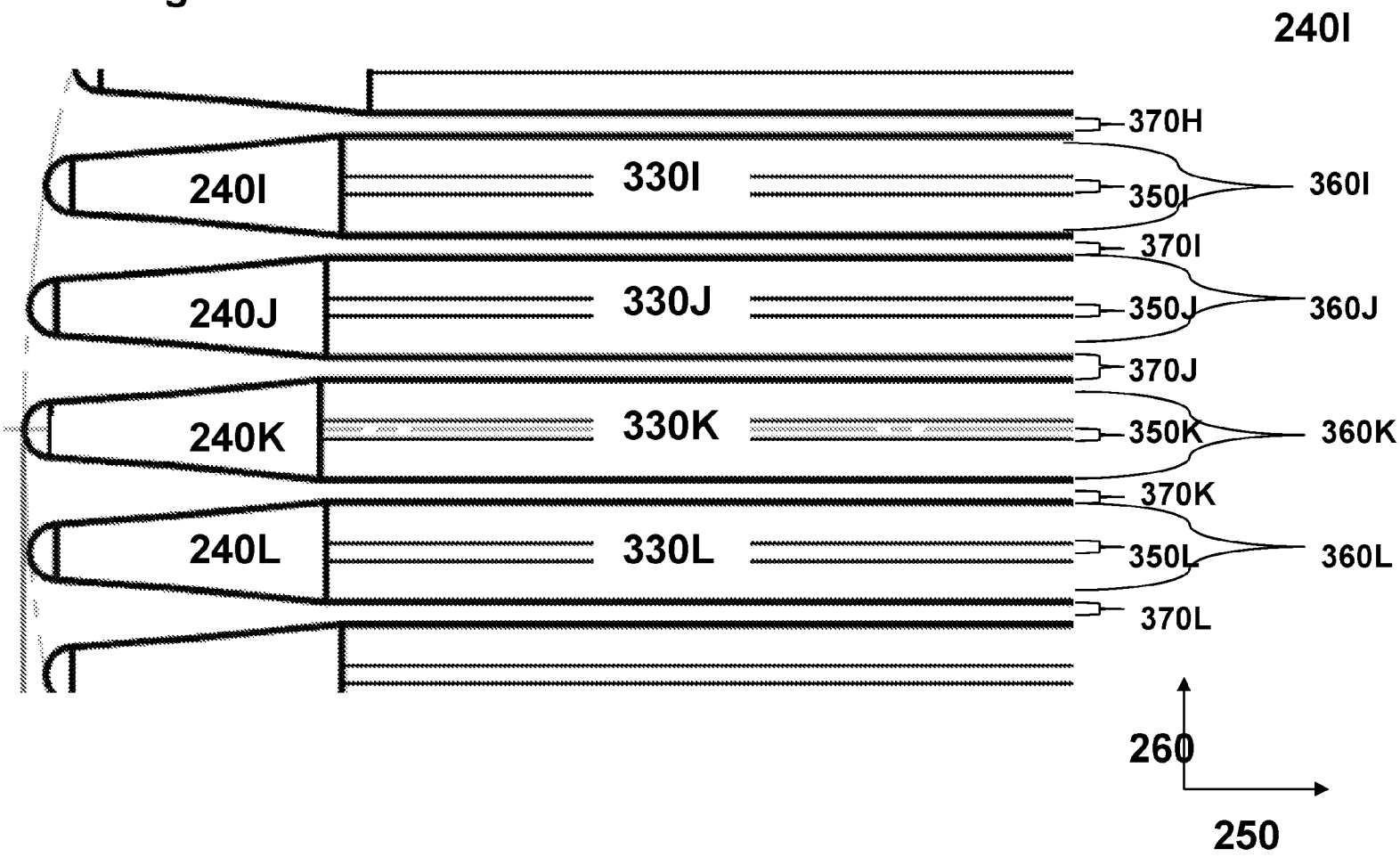
FIGS. 17-19 illustrate various views of a tooth array of a shield useful for coloring hair in accordance with some embodiments.
Figure 17B:
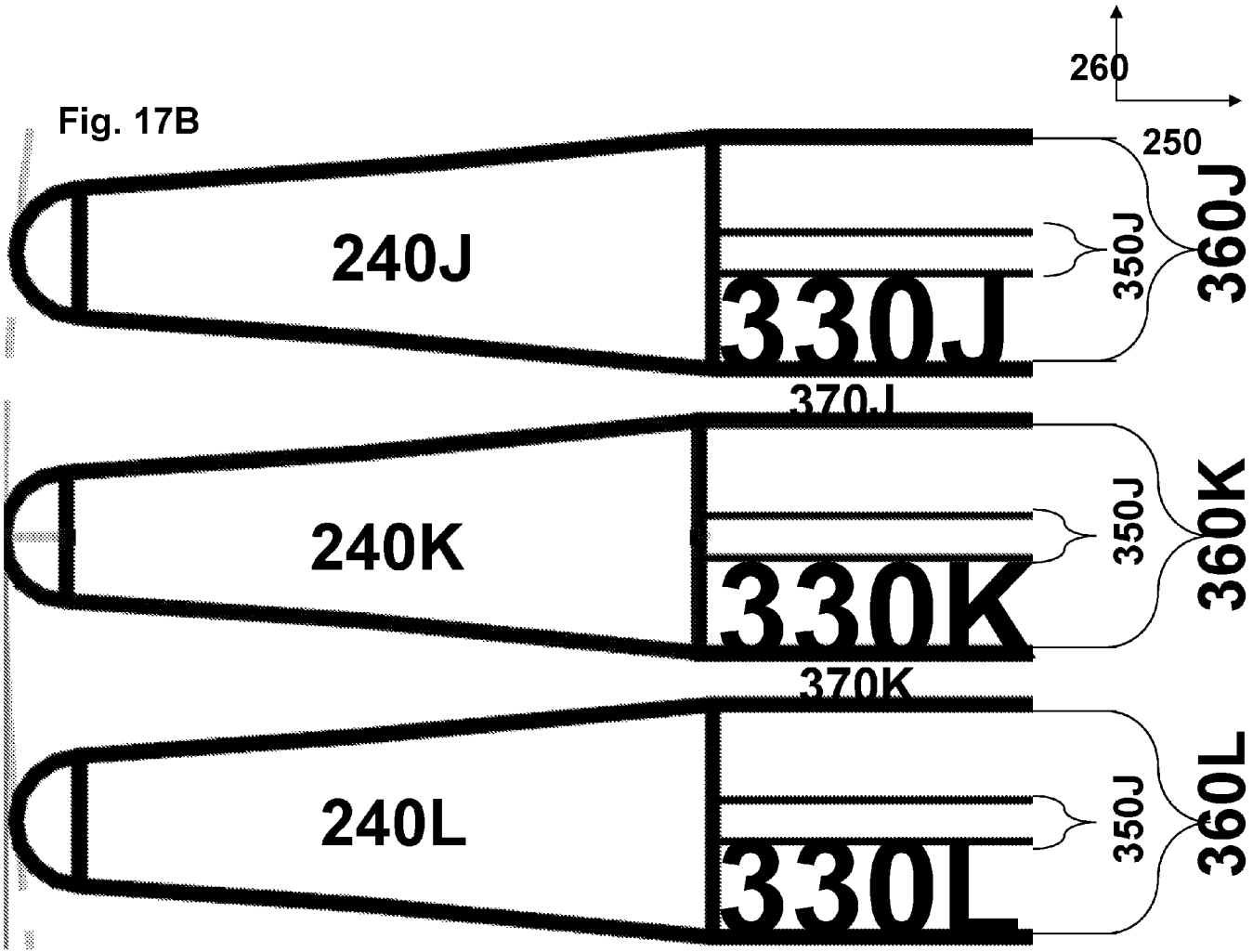
Figure 19A:
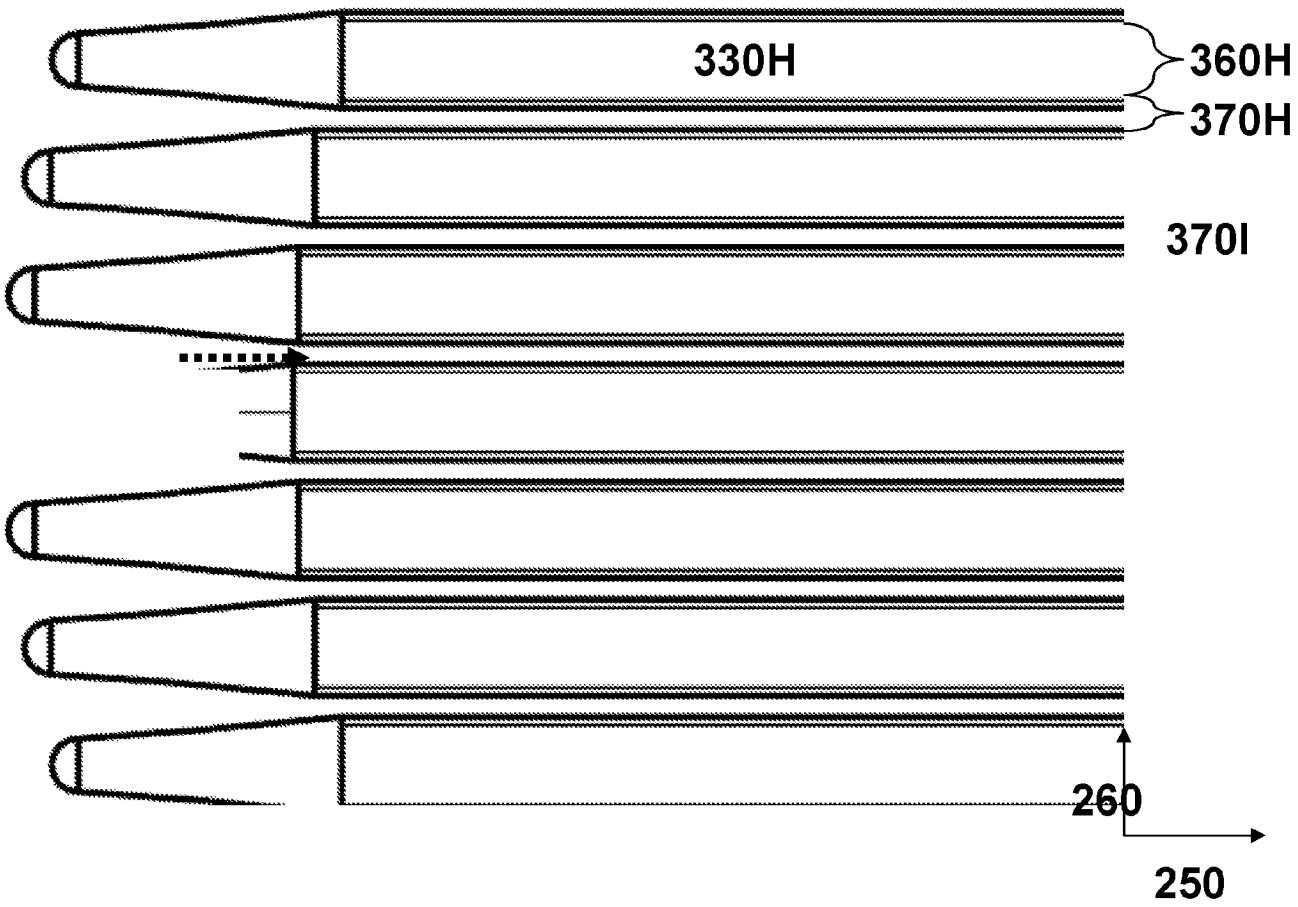
Figure 19B:
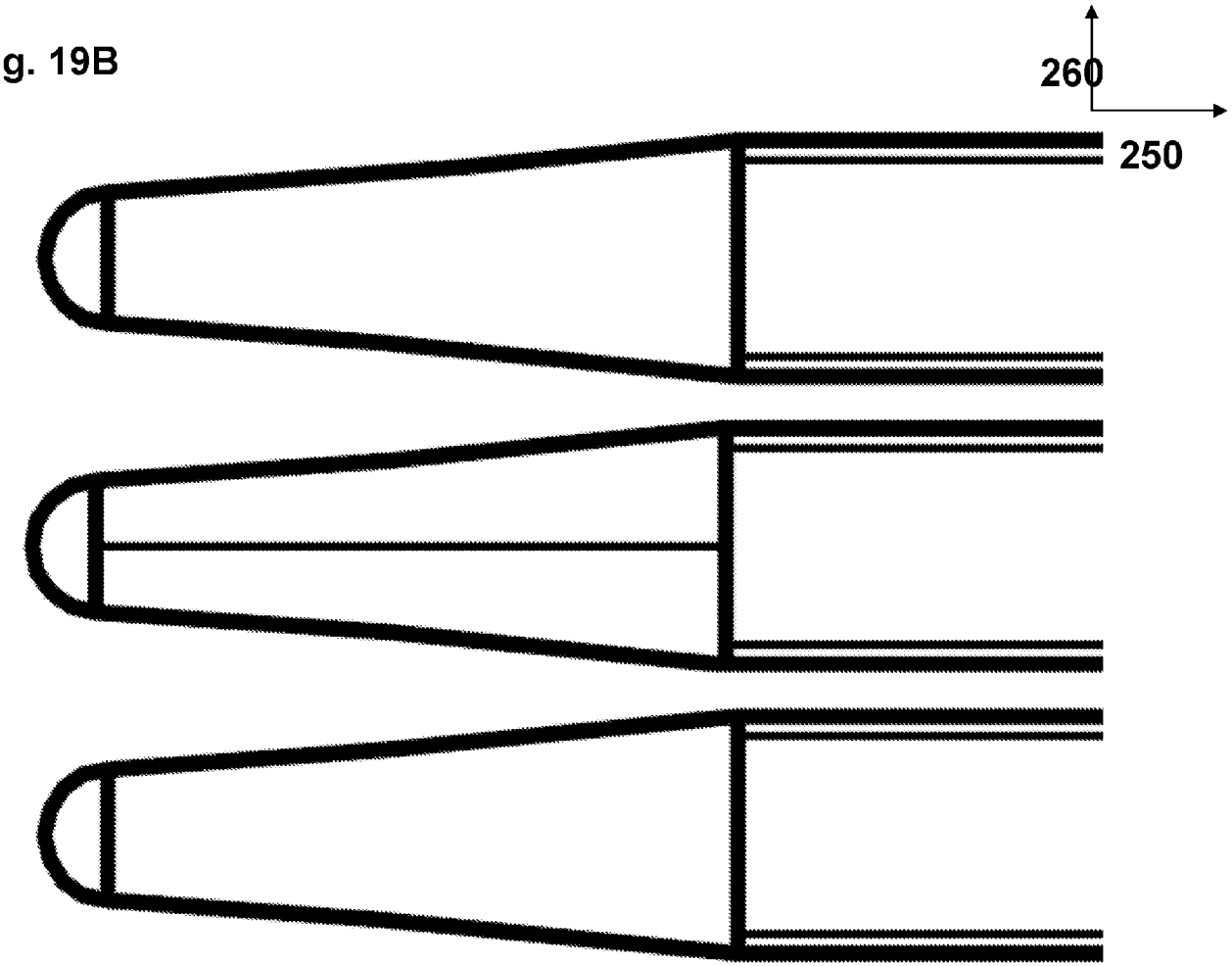
Figure 20:
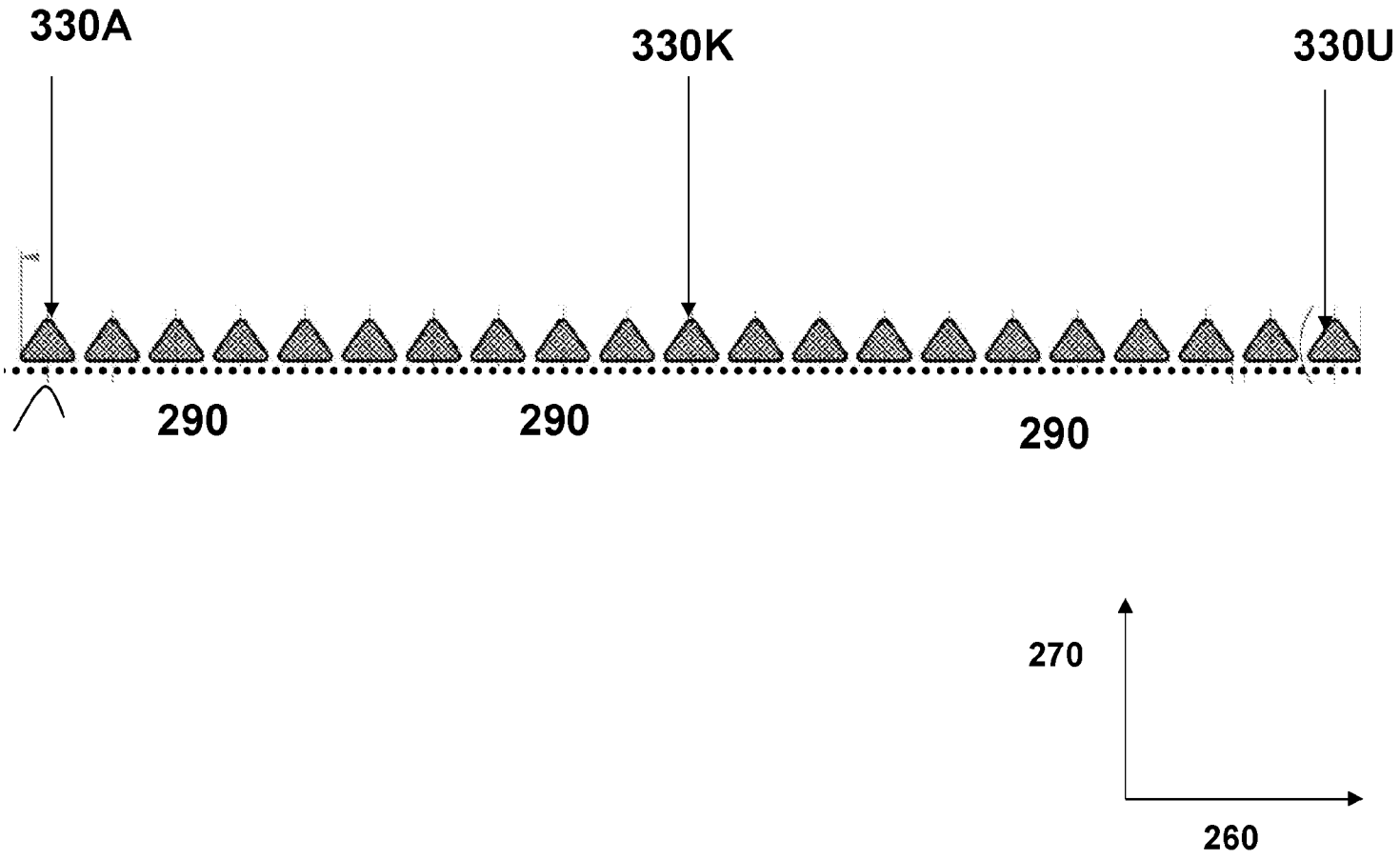
FIGS. 20-24, 26 relate to cross section views of a tooth array of a shield useful for coloring hair in accordance with some embodiments.

In order to facilitate the penetration (for example, the 'shallow penetration' into full hair (e.g. thick hair of an Indo-European or an African or an Asian) of shield 220 into a mass of hair, it may be useful to provide hair-penetrating elements 240 (for example, see FIGS. 11C, 16-17). Nevertheless, in some embodiments, due to the narrowness of slots 480 (also note the narrowness of 'intertooth gaps' 370 which may define the narrowest location of slots 480—see FIGS. 17, 19, 21), the shield may provide diminished or no 'combing functionality.' In one example, the 'shallow penetration' is limited to up to 3 cm or up to 5 cm or up to 7 cm into the 'full hair.'

Other features illustrated in FIGS. 11-12 include aerosol control 410, aerosol container 420 where the hair coloring aerosol may be stored before deliver via opening/outlet 210, and device substrate or housing 230 which may provide mechanical connectivity or mechanical coupling between shield 220 and aerosol assembly 400. In one non-limiting example, aerosol assembly 400 may be directly or indirectly fastened to shield 220 via any fastener known in the art, including but not limited to a clip, a screw apparatus, a magnetic fastener or any other fastener known in the art. For example, aerosol assembly 400 may be detachably attachable to shield 220. In another embodiment, aerosol assembly 400 (or a portion thereof) and shield 220 may be glued together or welded together, or integrally formed with each other.

Reference is now made to FIGS. 13A-13C which are side views of the device 200 (or portions thereof). FIGS. 13A-13C illustrate the proximal 228 and distal 224 ends of shield 220 which define a general 'proximal-distal' direction 226. The distance between proximal 228 and distal 224 ends is referred to as the 'proximal-distal distance.' In the example of FIGS. 11-13, the spray (or some sort of 'spray vector' defining a central tendency of the directions that aerosol spray delivered from opening/outlet 210 takes) may be along proximal-distal direction 226, and/or generally aligned with longitudinal axis 250.

In the non-limiting example of FIG. 13B, the outlet/opening 210 via which the hair-coloring aerosol is (i) delivered is 'elevated' above the substantially flat surface/substantially planar surface of shield 220 by a distance labeled as 440 (in FIG. 13B the 'extension' of the substantially flat surface of shield 220 is labeled as 470) and (ii) displaced in a proximal direction behind proximal end 228 by a distance labeled as 442. In some embodiments, the 'height' indicated by 440 may be at least 1 mm or at least 3 mm or at least 5 mm or at least 1 cm or at least 1.5 cm or at least 2 cm or at least 5% AND/OR at least 10% or at least 20% or at least 30% of the 'proximal-distal' distance AND/OR at least 1.5 times or at least 2 times or at least 3 times or at least 5 times or at least 7 times an average thickness of shield 220. In some embodiments where shield 220 comprises a tooth array comprising a plurality of substantially aligned teeth (see, for example, FIGS. 15-21), the 'height' indicated by 440 may be at least 1.5 times or at least 2 times or at least 3 times or at least 5 times or at least 7 times an average tooth thickness averaged over teeth of the tooth array.

In some embodiments, the 'backward displacement distance' indicated by 470 may be at least 5 mm or at least 1 cm or at least 1.5 cm or at least 2 cm AND/OR at least 10% or at least 20% or at least 30% or at least 50% a proximal-distal distance' between proximal 228 and distal 224 ends of shield 220.

In some embodiments, elevating and/or displacing aerosol outlet 210 in a distal direction may be useful for 'creating some distance' between the aerosol outlet 210 and shield 220. In some embodiments, if aerosol outlet 210 is too close to shield 220, then the risk of aerosol-delivered hair coloring agent (for example, delivered as a stream of droplets) penetrating in a downwards direction from region 702 and top surface 280 via the shield to below bottom surface 290 to regions 704 (where the scalp is), may increase.

As indicated in FIG. 13C, although the spray (e.g. a stream of droplets) may initially leave outlet/opening 210 in a direction that may be along proximal-distal direction 226, the path of the aerosol may curve towards shield 220 onto upper/top surface 280 to contact and color hair 310 which upwardly extended via shield the spray (or some sort of 'spray vector' defining a central tendency of the direction that hair-coloring aerosol spray delivered from opening/outlet 210 takes) may be along proximal-distal direction 220 into region 702 above shield 220. In some embodiments, this hair coloring spray may include a fast-drying hair coloring agent and/or may include a 'temporary' hair coloring agent which 'wears off' after one or a few hair washings and/or within a short period of time that is at most a few weeks or a few days.

As noted above, the shield 220 may be useful for hindering 'downward' motion (i.e. from region 702 above the shield to region 704 below the shield) of even non-viscous hair-coloring agent.

In one non-limiting example, the non-viscous hair-coloring agent may include a dye (for example, a basic hair dye) mixed with a non-viscous carrier such as an alcohol-based carrier. In non-limiting examples, the droplets are at least 5% or at least 10% or at least 15% by weight alcohol. In non-limiting example, the stream of droplets have a particle size that is less than 200 microns or less than 100 microns or less than 80 microns or less than 60 microns and/or at least 5 microns or at least 10 microns or at least 20 microns or at least 30 microns.

A 'non-viscous' substance (for example, fluid) is a substance that 'runs' or 'flows', may have a viscosity that is less than 100 cps (and/or less than 100 times the viscosity of water at 20 degrees C.), or less than 75 cps (and/or less than 75 times the viscosity of water at 20 degrees C.), or less than 50 cps (and/or less than 50 times the viscosity of water at 20 degrees C.), or less than 30 cps (and/or less than 30 times the viscosity of water at 20 degrees C.), or less than 20 cps (and/or less than 20 times the viscosity of water at 20 degrees C.), or less than 10(and/or less than 10 times the viscosity of water at 20 degrees C.), or less than 5 cps (and/or less than 5 times the viscosity of water at 20 degrees C.) or less than 3 cps (and/or less than 3 times the viscosity of water at 20 degrees C.) or less than 2 cps (and/or less than 2 times the viscosity of water at 20 degrees C.) or less than 1 cps (and/or less than the viscosity of water at 20 degrees C.) (cps is centipoises).

In some embodiments, having a 'low-viscosity' hair-coloring substance (for example delivered as a mist) may obviate the need for a user to 'comb in' or 'work in' the hair coloring agent into the hair (as would be the case of a mist). In user would merely spray the hair color into the hair, and the droplets (for example, that arrive directly from the aerosol spraying opening and/or droplets the ricochet from other strands of hair) serve to coat the user's hair. In one example, this may take place without causing multiple strands of hair to stick to each other.

In some embodiments, presence of a 'high concentration' of a propellant (for example, an ether propellant)—for example, at least 15% or at least 20% or at least 25% or at least 30% or at least 35% and/or use of an alcoholic solvent facilitates the fast drying of the coated hair strands—for example, within a few minutes.

Figure 13D:
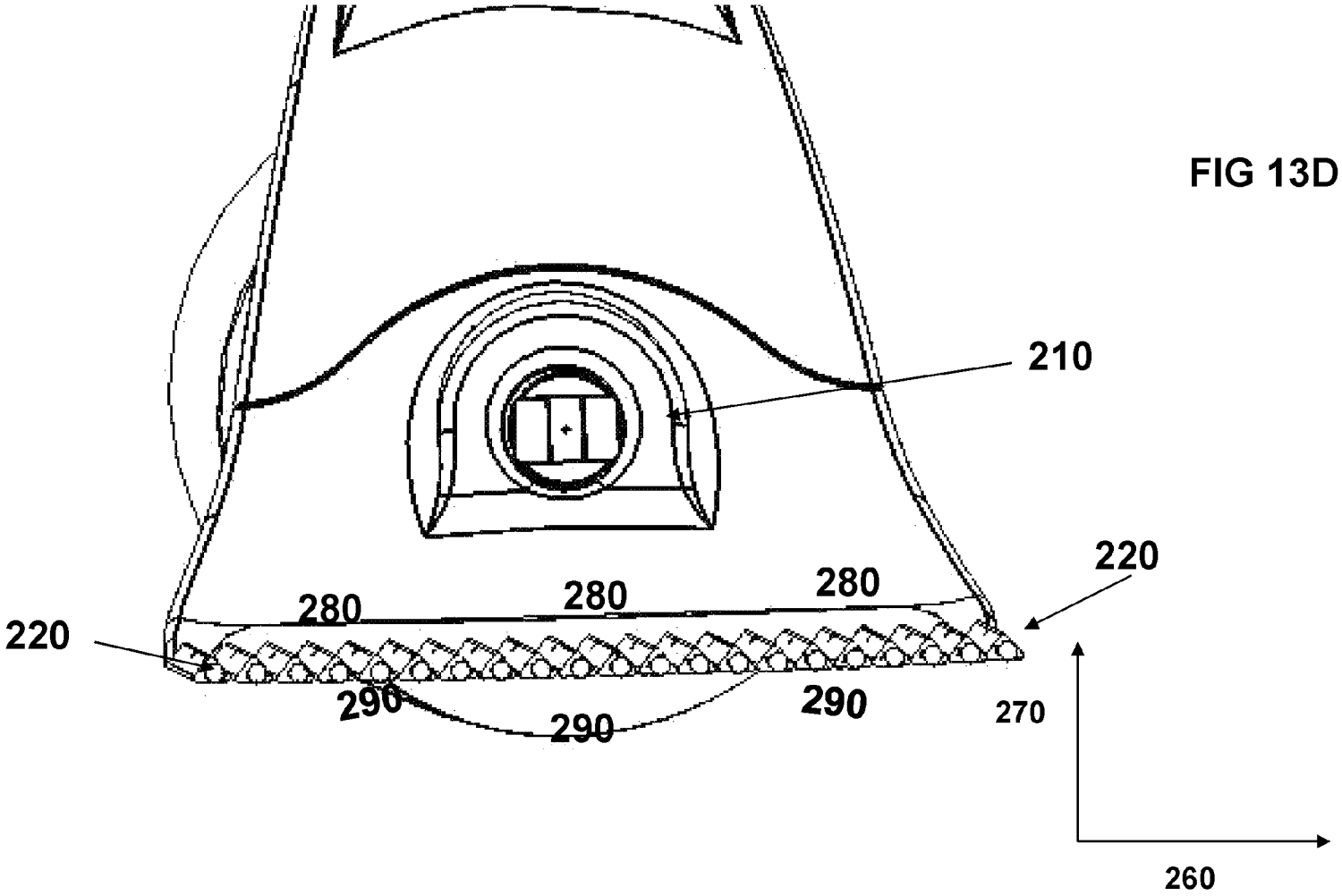
FIGS. 13D-13E illustrate a view of an apparatus for coloring hair in accordance with some embodiments including an array of teeth whose width profile is asymmetric (e.g. triangular).
Figure 13E:
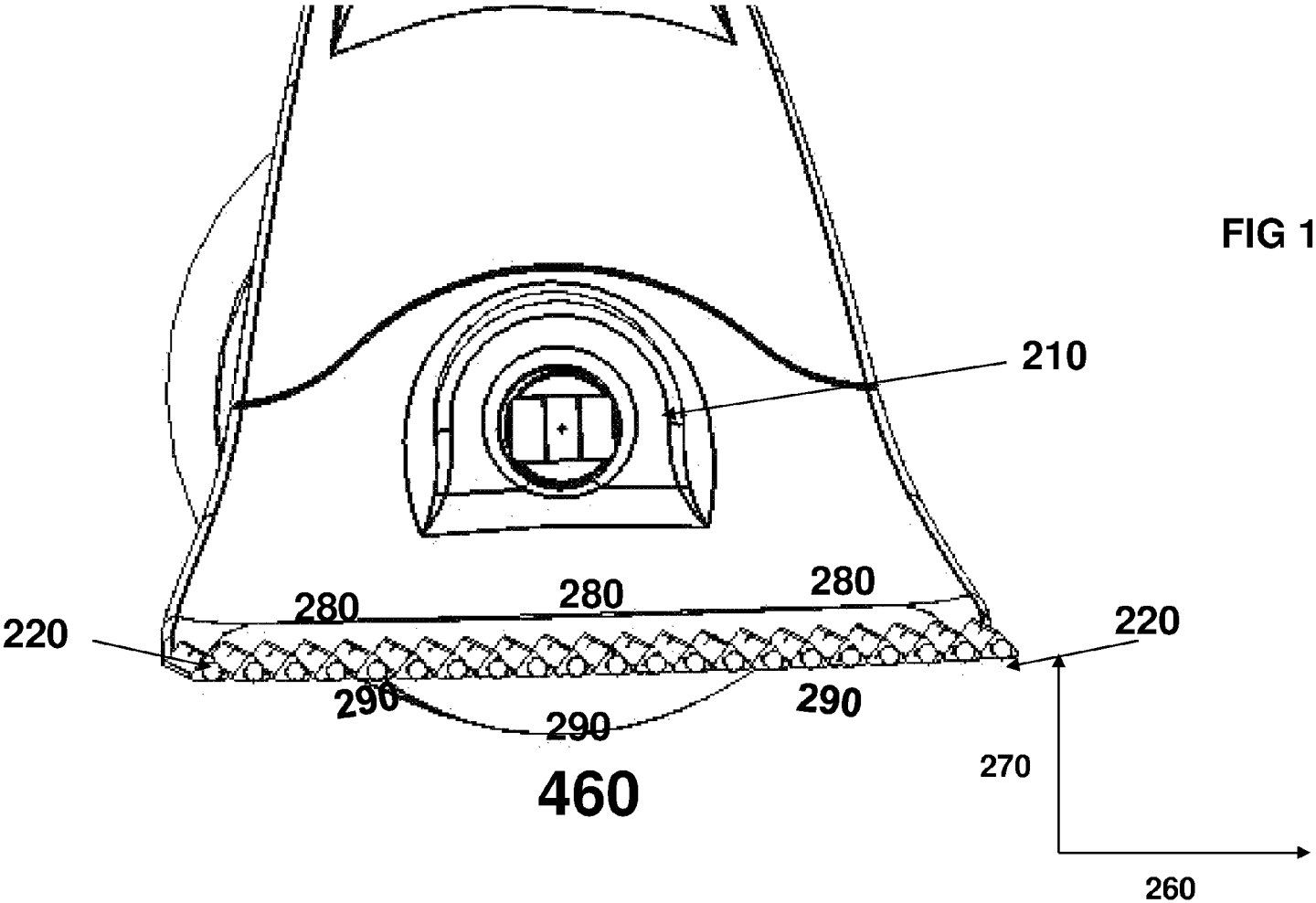
Figure 14:
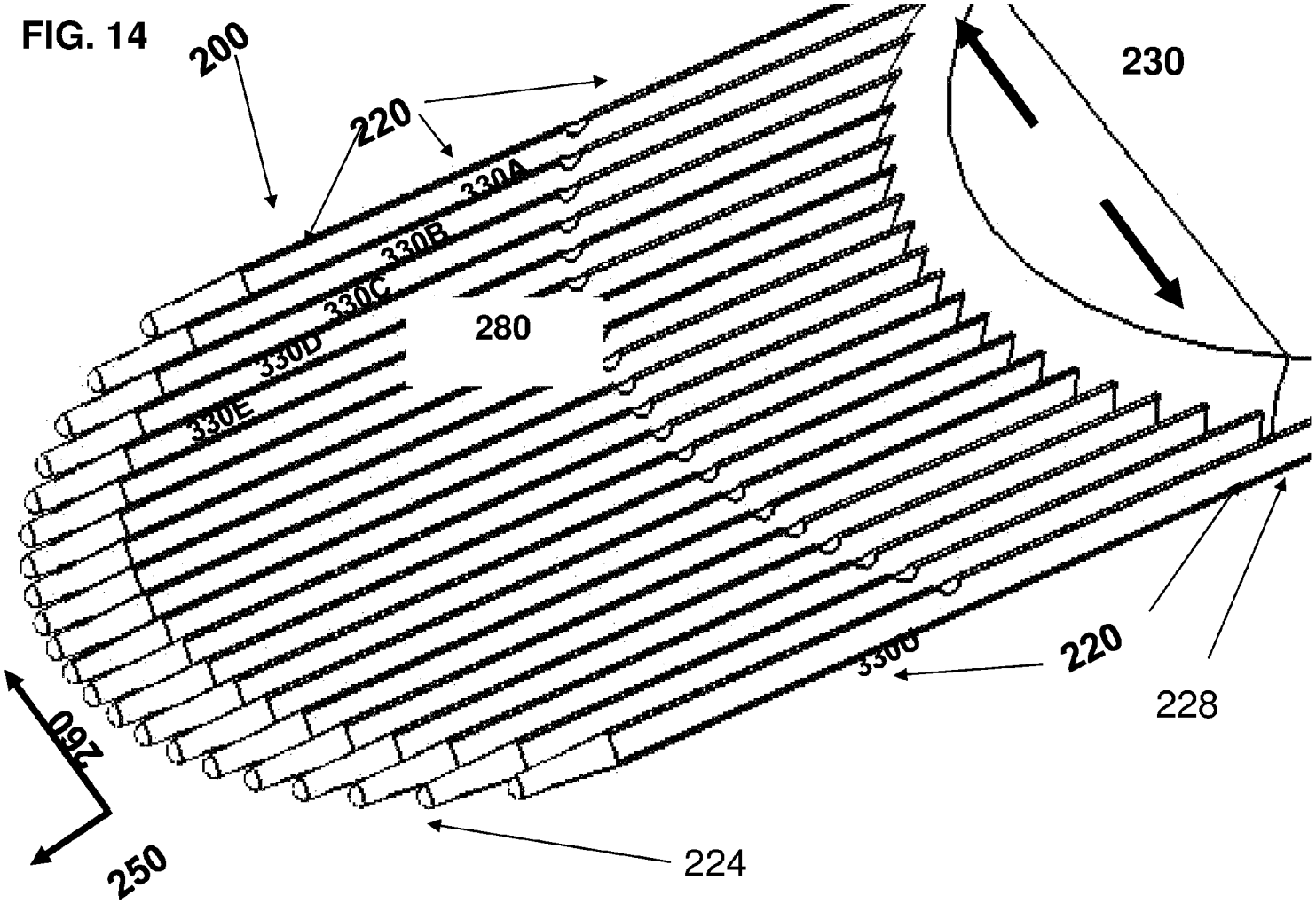
FIG. 14, 16 illustrates other views of a shield useful for coloring hair in accordance with some embodiments.

FIG. 13C-13D illustrate another view of device 220—for example, a cross section of area spanned by the vectors of shield thickness axis 270 and lateral axis 260 (the lateral direction of lateral axis 260 is also illustrated in FIG. 14). There is no requirement for shield 220 to be flat or generally flat. In the non-limiting example of FIGS. 13C-13D, generally flat shield is 'gently concave down' to provide some sort of gentle shallow and wide cavity into which a portion of the user's scalp may be placed.

In some embodiments, shield 220 may comprise a plurality of teeth, as illustrated in FIG. 14. In the example of FIGS. 14-29, each tooth includes a respective main portion 330 and a respective distal portion 240. In some embodiments, a gap between the teeth (for example, a narrowest gap or minimum gap distance 370 at a location between the top 246 and bottom 248 of a pair of teeth) may relate to slots 480 discussed above.

In the non-limiting example of FIGS. 15-29, shield 220 comprises a tooth array comprising exactly 22 teeth. This is not a limitation. In some embodiments, shield 220 may include at least 5, or at least 8, or at least 10, or at least 12, or at least 20, or exactly 22 generally aligned teeth. In the non-limiting example of FIGS. 15-21, the teeth are all exactly parallel to each other—this is not a limitation. In some embodiments, the 'generally aligned' teeth may be substantially parallel, or may diverge from each other closer to distal end 224 or converge.

One salient feature that may be provided by the teeth of the non-limiting example of FIG. 15 is that these teeth are relatively long/tall and narrow and/or relatively long/tall and thin.

For the present disclosure, the 'width' of a tooth (i.e. at any location along the tooth axis) refers to the dimension of the tooth along the lateral axis 260. As will be discussed below (see FIG. 21) this width, for any particular tooth, may vary at different locations along the shield thickness axis 270 (or along the tooth axis or along the longitudinal axis 250). In the non-limiting example of FIGS. 17, 19 and 21, the 'width' at the 'bottom' of each tooth 248 is labeled as 360, while the width near the 'top' of each tooth is labeled as 350.

For the present disclosure, the 'thickness' or 'height' of a tooth is the dimension of the tooth along the shield thickness axis 270. As is evident from the figures, the height or thickness may vary along lateral axis 260 or along the tooth axis or along the longitudinal axis 250.

As was noted above, one salient feature that may be provided by the teeth of the non-limiting example of FIG. 14 is that these teeth are relatively long/tall and narrow and/or relatively long/tall and thin—i.e. they may have a 'large aspect ratio'. In some embodiments, for every tooth of a tooth array of shield 220, or for a majority of teeth of tooth array (or for at least 30% or at least 70% of teeth of the tooth array—possible numbers of teeth of the tooth array are listed above), at least one of TOOTH_RATIO_1, TOOTH_RATIO_2 and TOOTH_RATIO_3 may be at least 10, or at least 15, or at least 20, or at least 25, or at least 30, or at least 40.

TOOTH_RATIO_1 is defined as the ratio between the tooth length and the average tooth width (i.e. averaged for all locations in the tooth along the shield thickness axis 270 and along the length of the tooth—either including or excluding distal tapered section 240 (hair-penetrating probe section 240)). TOOTH_RATIO_2 is defined as the ratio between the tooth length and the average tooth thickness (i.e. averaged for all locations in the tooth along the lateral axis 260 and along the length of the tooth—either including or excluding distal tapered section 240 (hair-penetrating probe section)). TOOTH_RATIO_3 is the ratio between the tooth length and the average cross-sectional tooth area (FIG. 21 illustrates 'slices' or cross-sections of teeth)—TOOTH_RATIO_3 is averaged along the length of the tooth—either including or excluding distal tapered section 240 (hair-penetrating probe section)).

Another salient feature that may facilitate the temporary coloring of hair roots while the scalp is protected is the feature where the 'tooth is relatively wide the bottom of the tooth' while 'relatively narrow' near the top of the tooth.

In some embodiments, in order to provide this functionality, the tooth cross section may be triangularly-shaped—for example, with a wider base and a narrower top. This is illustrated in FIG. 15.

Figure 15A:
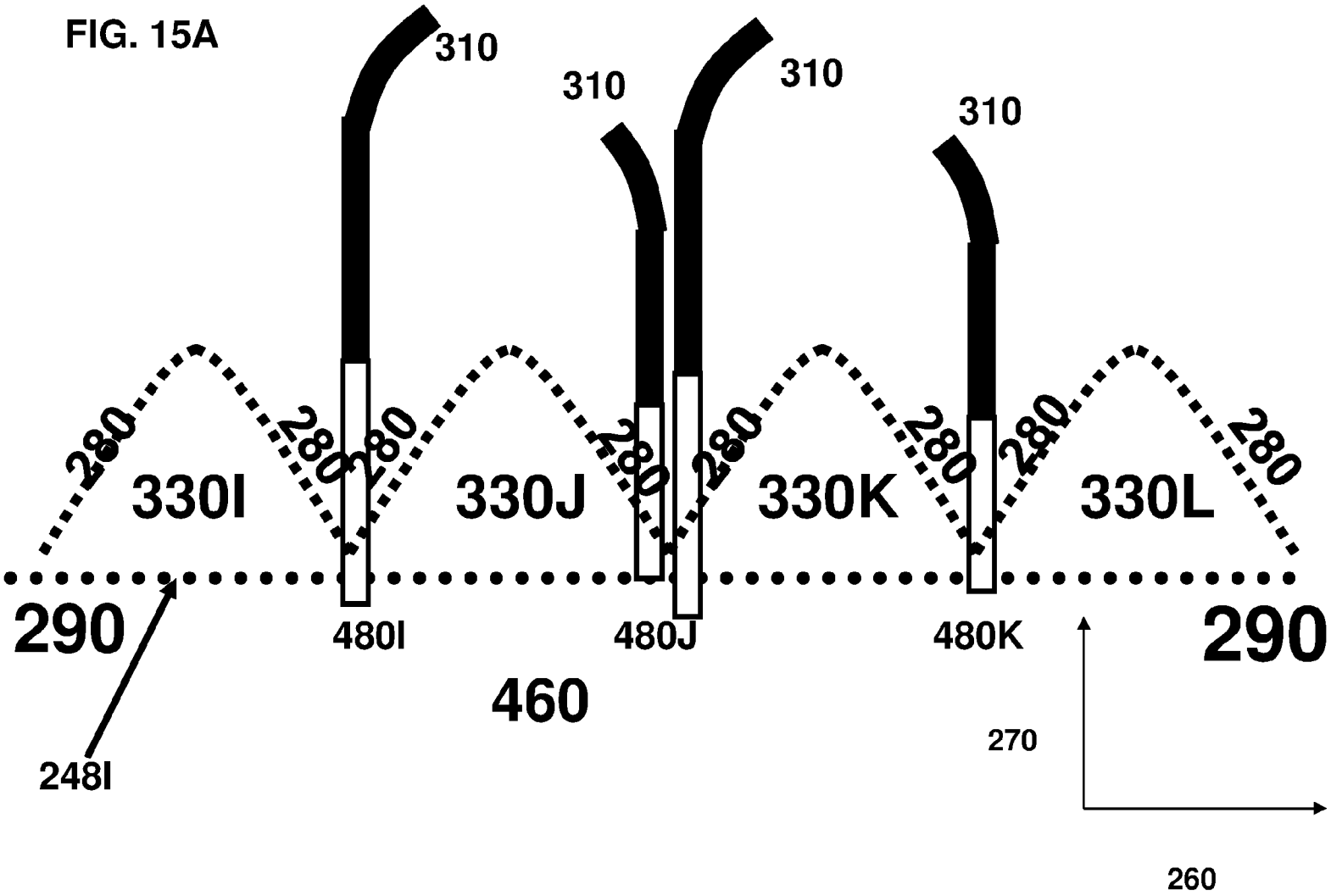
FIGS. 15A-15C illustrate application of spray to hair roots in accordance with some embodiments.
Figure 15B:
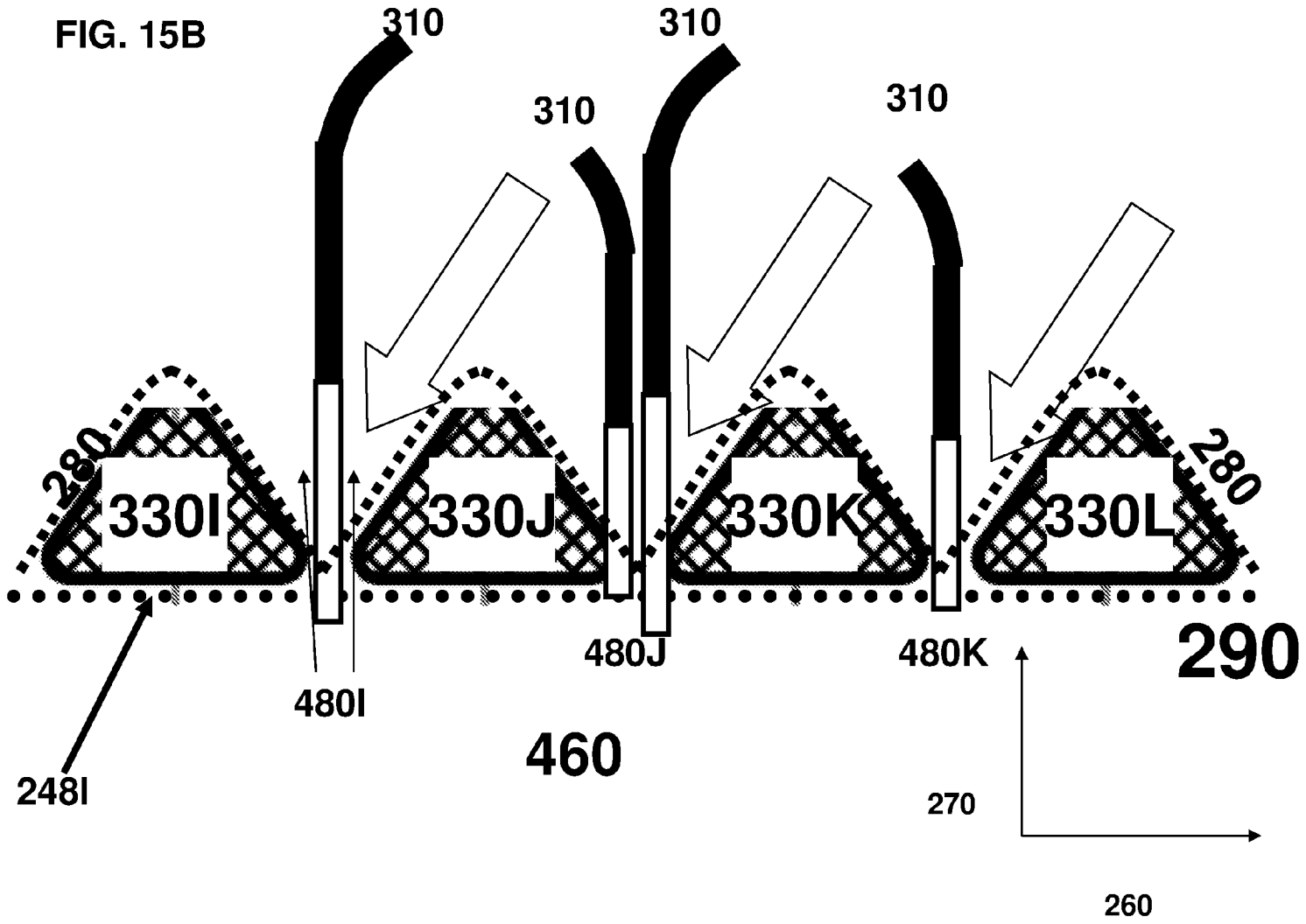
Figure 15C:
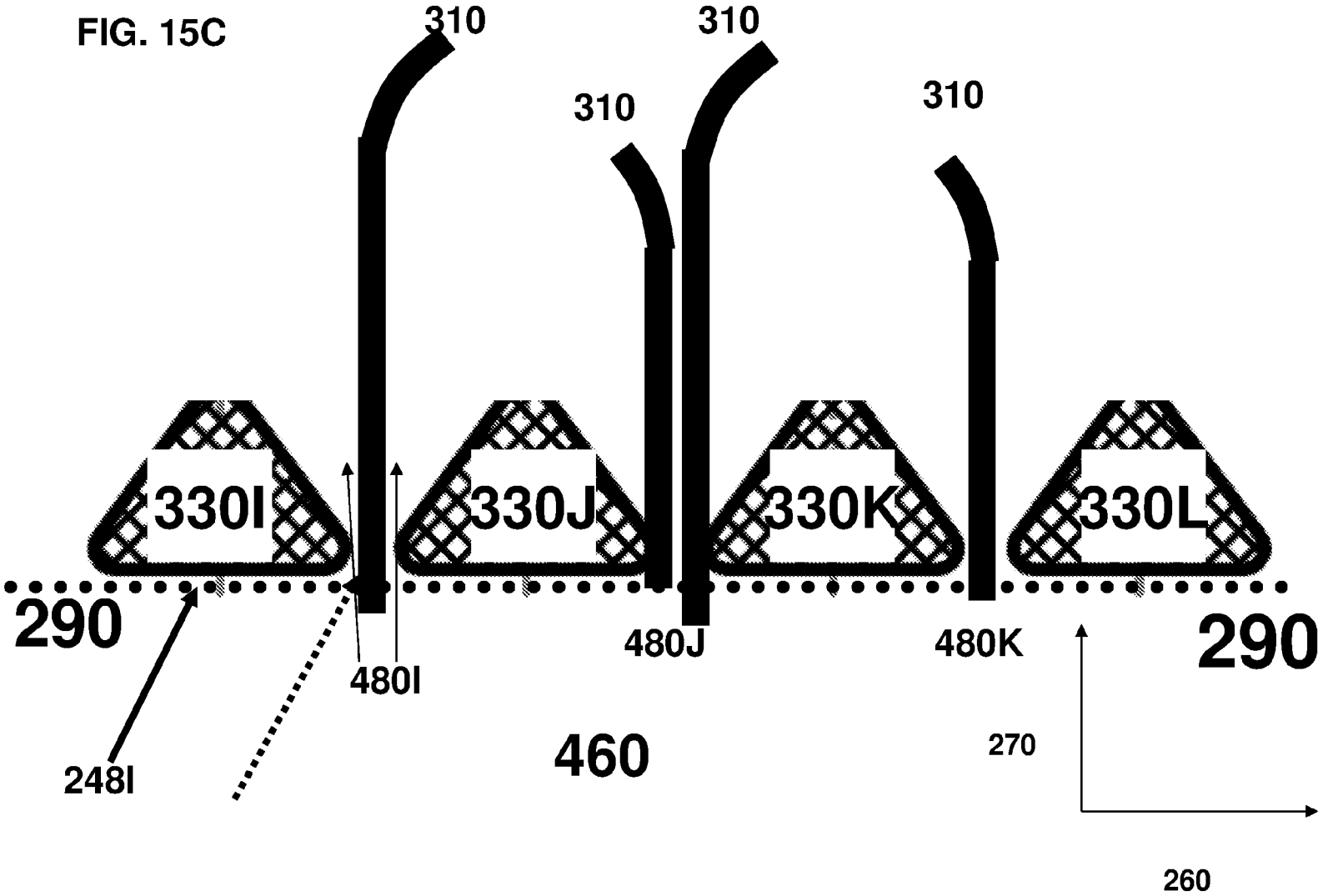

Also illustrated in FIG. 15 is the process whereby hair with grey roots may be treated to coat the hair strand (for example, at the root) with black hair-color. Thus, FIG. 15A illustrates 'before' treatment, FIG. 15B illustrates one example of the spray process, and FIG. 15C illustrates the hair strands 'after' treatment according to one non-limiting example.

In the non-limiting example of FIGS. 14-21, all of the teeth have identical shapes and cross sections (not necessarily identical length)—this is clearly not a limitation and in some embodiments, there may be variation among tooth dimensions and/or dimensions describing the geometrical relationships of multiple (e.g. laterally-adjacent or laterally-neighboring teeth) teeth (e.g. tooth gap distances).

Furthermore, the tooth cross section may longitudinally vary along the 'tooth axis' (not shown in the figures).

Furthermore, in the non-limiting examples of FIGS. 15-29, the teeth are exactly straight—i.e. some sort of internal 'tooth axis' (i.e. the elongate or central axis of the tooth) always corresponds to longitudinal axis 250. This is not a limitation, and even if the 'local tooth axis' over 'very short' distance is a straight line, it is appreciated that when a tooth is not perfectly straight, the central/elongate tooth axis (not illustrated) may provide curvature or sharp angles—instead of being a 'straight line' it is possible to think of the tooth axis as a one-dimensional manifold in space that will, in many embodiments, be generally aligned with longitudinal axis 250 and approximate a straight line.

One salient feature that may be provided by the device of FIGS. 14-29 is that (i) the width of the tooth may vary over different 'heights' in the tooth (e.g. over shield thickness axis 270) and (ii) this width function may provide an 'asymmetric width profile' (i.e. referring to the width of the tooth at one or more locations along the tooth length—for example, at a majority of locations over the length of the tooth, or at a majority of locations over a 'given section' of the tooth whose length is at least 2 cm).

Some features described herein may relate to a 'given section' or 'control section' of the main portion 330 of a tooth or teeth (i.e. a 'lengthwise section' or a 'longitudinal section') that is at least 2 cm or at least 2.5 cm or at least 3 cm or at least 3.5 cm or at least 4 cm. This 'longitudinal' section may be located at any location on the tooth. In some embodiments, this 'given section' may be located near the distal end of shield 220—for example, lengthwise adjacent to (i.e. bordering or less than 5 mm or 1 cm from) to the tapered distal section 240 (e.g. 'probe-shaped—for example, including a rounded end).

In the non-limiting example of FIG. 21, the tooth cross section has a triangular cross section (for example, a rounded isosceles triangle). Other cross sections shapes are possible including but not limited to other examples of 'substantially triangular cross-section shapes.'

In the example of FIG. 21, the tooth has a relatively wide width at the bottom of the tooth 248 (e.g. 360) and a relatively narrow width at or near the top 246 of the tooth). Another salient feature of FIG. 21 is that the minimum gap width for the cross-section (i.e. between laterally adjacent pairs of teeth—for example, the gap 370I between teeth 3301 and 330J) is located near or at the bottom of the tooth 248.

By locating this 'minimum gap' near the bottom of the tooth, it is possible for the root of the hair strand 310 to be located within void region 390 between laterally-adjacent teeth above the location of the minimum gap distance 370. In some embodiments, it may be useful or important to allow the root of hair strand 310 (rather than only a more distal location within the hair strand past the root) to traverse the location of the minimum gap distance 370 and emerge above this location into void region 390 between teeth above the 'undulating' upper surface 280 of the shield defined by the upper surfaces of the teeth. Because the root of the hair strand (and not just an upper location of the hair strand) is located in the 'aerosol-exposed' region 702 above upper surface 280, rather than the 'aerosol shielded' region 704 below a location of the minimum gap distance 370 (and below the lower/bottom surface 290 of shield 220), this 'minimum-gap-traversing' hair root can be subjected to the hair-coloring agent provided by the hair-coloring aerosol spray.

In some embodiments, the average or individual void cross section (i.e. for a longitudinal section that is at least 2 cm or at last 2.5 cm or at least 3 cm at least 4 cm or at least 5 cm or longer) may be (i.e. either for a single tooth or single slot or for an array of any number of teeth or slots or voids—i.e. either on average for the array or individually for any number within an array of slots or teeth or voids) at most 6 mm^2 or at most 5 mm^2 or at most 4 mm^2 or at most 3 mm^2 or at most 2 mm^2—in some embodiments, the average or individual void cross section may be at least 0.5 mm^2 or at least 1 mm^2. This 'void cross-section' may prevail on average over the section, or may prevail for at least a significant minority of locations, for at least majority of locations (synonymously for most locations), or at least a significant or very significant majority of locations of the section. This may be true on average for any number of teeth of a tooth array (or voids formed therefrom) or any number of slots or voids of a slot/void array and/or be true individually for a significant minority or majority or significant majority or very significant majority of teeth (i.e. the resulting voids formed therefrom) of the tooth array.

In some embodiments, the average or individual tooth cross section (i.e. for a longitudinal section that is at least 2 cm or at last 2.5 cm or at least 3 cm at least 4 cm or at least 5 cm or longer) may be (i.e. either for a single tooth or for any number of teeth—i.e. either on average or individually for an array of any number within an array of teeth) at most 6 mm^2 or at most 5 mm^2 or at most 4 mm^2 or at most 3 mm^2 or at most 2 mm^2—in some embodiments, the average or individual void cross section may be at least 0.5 mm^2 or at least 1 mm^2. This 'tooth cross-section' may prevail on average over the section, or may prevail for at least a significant minority of locations, for at least majority of locations (synonymously for most locations), or at least a significant or very significant majority of locations of the section. This may be true on average for any number of teeth of a tooth array (or voids formed therefrom) and/or be true individually for a significant minority or majority or significant majority or very significant majority of teeth (i.e. the resulting voids formed therefrom) of the tooth array.

As may be observed from the figures, the 'upper surface of the void regions 390' and/or 'the upper surface defined by connecting top locations 246 of the teeth' (this is marked by 340) may deviate from the 'upper/top' surface 280 of the shield or of the teeth (e.g. above the 'minimum gap location' of the 'minimum gap distance' 370)

One salient feature observable in FIG. 21 is that the upper surface 280 is relatively rough with oscillating heights (along the lateral axis) while the lower surface 290 is relatively smooth 290 (and a local level, it may be substantially planar). In some embodiments, the geometry where (i) the lower surface 290 is relatively smooth and where (ii) the minimum gap location of minimum gap distance 370 is closer to or at the bottom 248 of the teeth is useful for helping the hair strand 310 traverse the minimum gap location 370 at the hair root. On the other hand, if the minimum gap distance 370 were to be higher and/or if the lower/bottom surfaced were to have large 'height/vertical' variations, this might, at least somewhat (without leaving the scope of the invention), somewhat reduce the effectiveness of the device because hair coloring might tend to be concentrate at a higher location on the hair strand 310 rather than at the root.

The previous paragraph (and any other feature or figure described herein) refers to some features that may be provided by some embodiments—this is not intended as limiting.

Figure 18A:
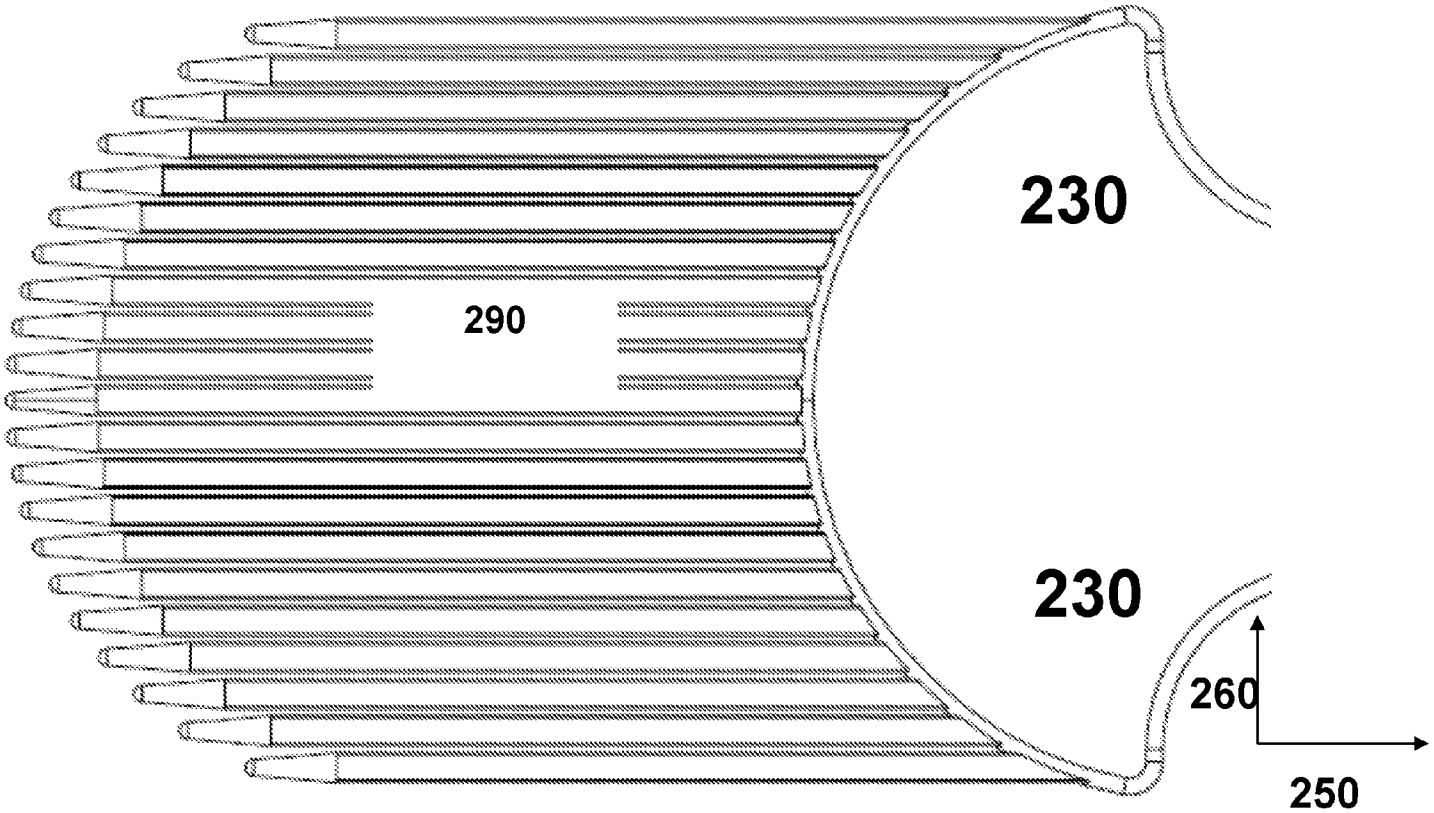
Figure 18B:
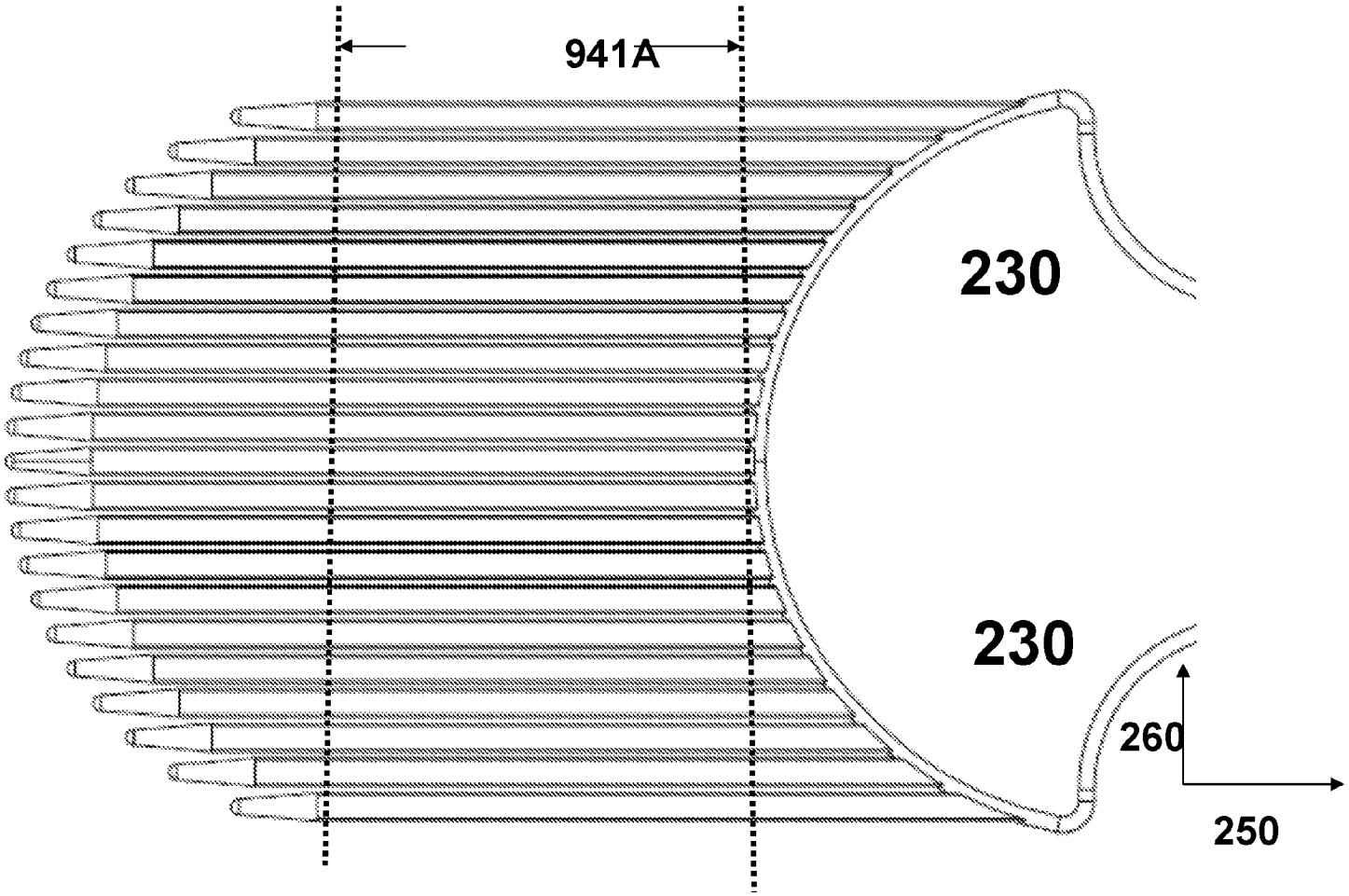
Figure 18C:
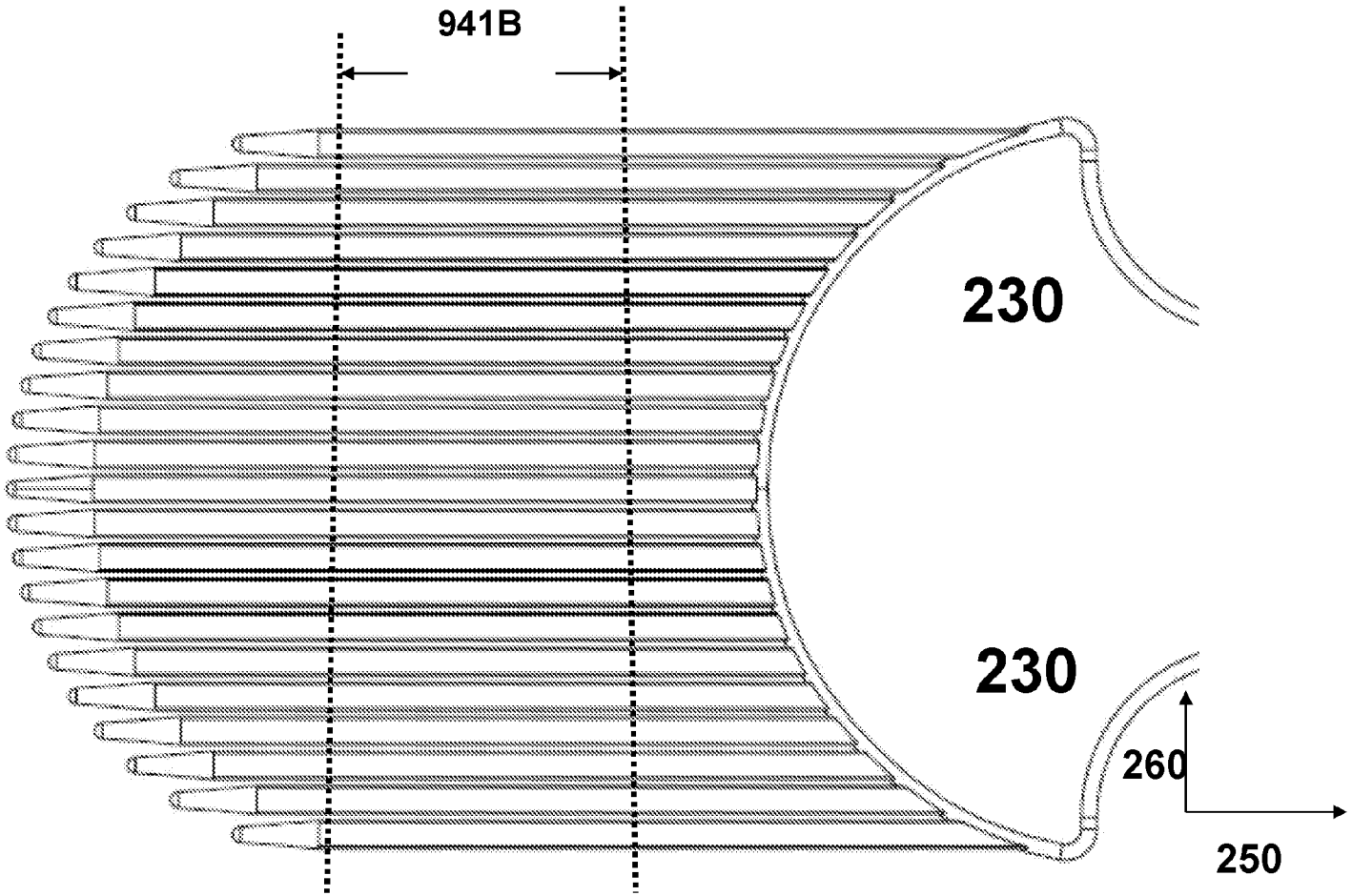

In some embodiments, because the upper surface 280 may tend to undulate or oscillate along the lateral axis while the lower surface may lack such undulations/oscillations (or they may only be present to a slight extent), the 'upper 280 surface' may be a rough surface (i.e. have a rough topography), while the lower 290 surface may be a 'smooth' surface. Thus may also be observed by comparing FIG. 15 and FIG. 16 to FIG. 18—while the width of the teeth in the front surface may vary significantly between the bottom and top of the teeth (compare 350 and 360) on the front side (looking 'down), in FIG. 18, it may observed that the back surface 290 is significantly smoother. In FIG. 18, back surface 290 includes wider teeth (i.e. at or near the bottom 248—as opposed to the front surface when looking down the width may vary significantly) punctuated by relatively narrow gaps 370.

In a non-limiting example, the 'minimum gap width' 370 of the narrow gaps is at least 0.2 mm or at least 0.3 mm or at least 0.4 mm. In a non-limiting example, the 'minimum gap width' 370 of the narrow gaps is at most. 1.2 mm or at most 1 mm or at most 0.8 mm or at most 0.7 mm or at most 0.6 mm. This may be for any number of teeth of a tooth array (i.e. significant minority, majority, significant majority, very significant majority) and/or averaged over any length of tooth or slot (i.e. for a 'section' at least significant minority of locations, at least majority of locations or synonymously most locations, or at least significant or very significant majority of locations)

Figure 21A:
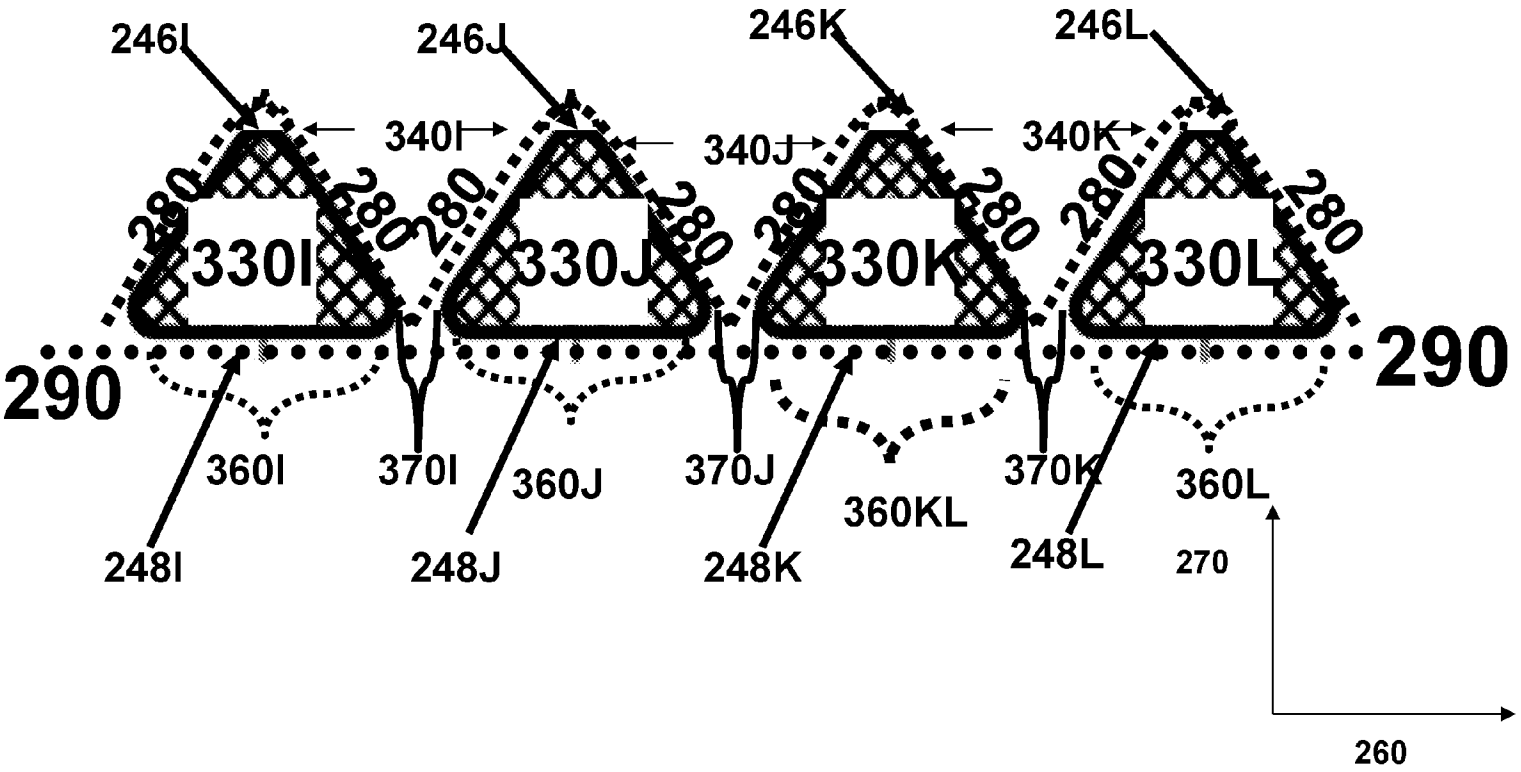
Figure 21B:
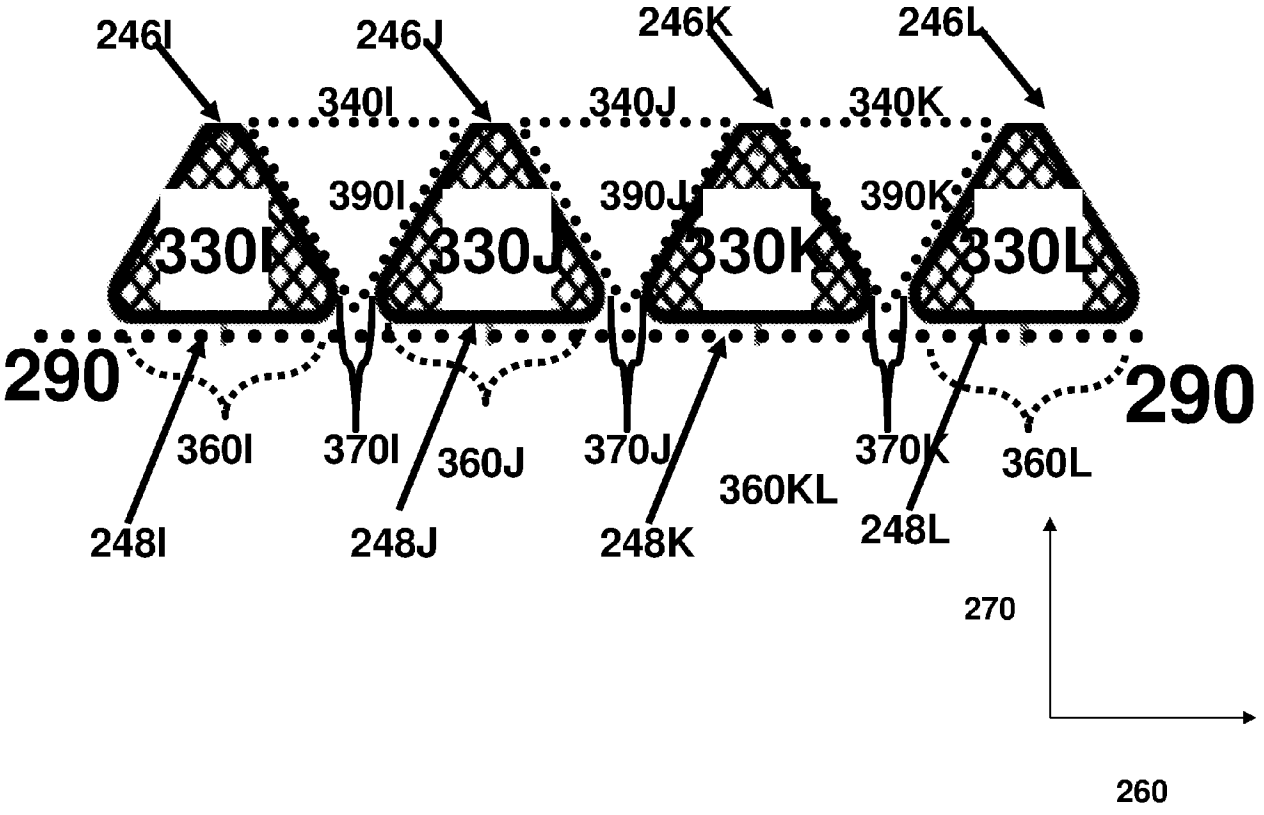
Figure 21C:
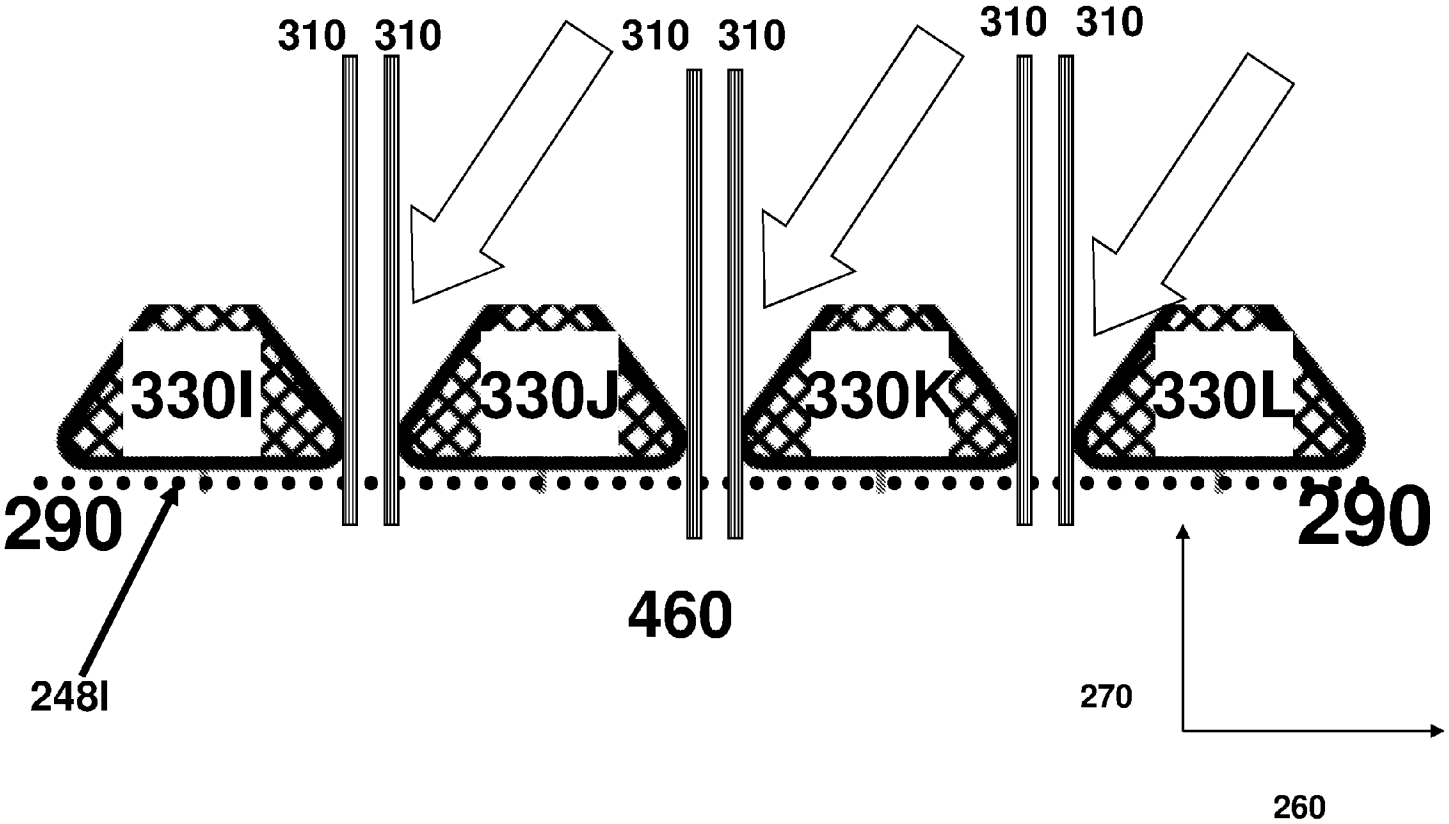
Figure 21D:
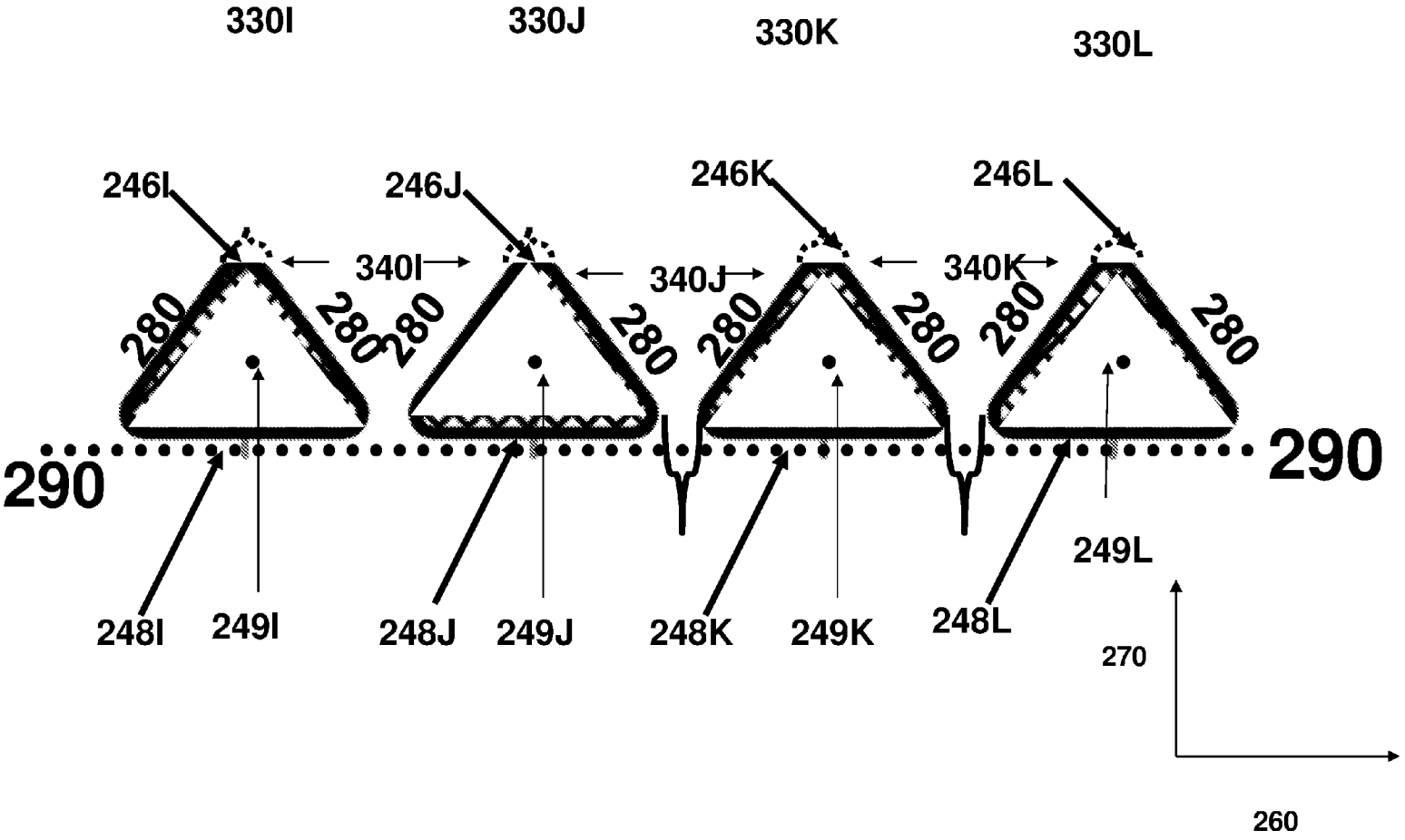

In FIG. 21D, the 'highest location' or 'top' of various teeth are labeled as 246. The 'bottom' or lowest point on the shield thickness axis 270 is labeled as 248. The 'halfway' point (this may be a locus of points if the top of bottom of the teeth are a locus of points) 249 are also illustrated in FIG. 21D. Nevertheless, all points of the 'locus of points for 249' (or the top-point midpoint) would have the same 'height' 923 above the bottom 248—see also FIG. 23C.

In some embodiments, for a majority (or a significant majority—i.e. at least 70% or 80%) of locations within 2 cm lengthwise 'control section' or 'given section' of the tooth, the ratio between the 'maximum width 360 of the tooth' (in some embodiments, the maximum width 360 may be located in the lower half or lower 30% or lower 20% or lower 10% of the tooth—where the upper sections and lower sections of the tooth are defined along thickness axis 270 and relative to the top 246 and bottom 248 of the teeth) and the 'minimum gap distance' 370 may be at least 1.3 or at least 1.5 or at least 1.7 or least 2. The skilled artisan is directed, for example to FIGS. 19A and 18. This 'ratio feature' may be provided over a 'tooth set' of at least 2 or at least 3 or at least 4 or at least 5 or at least 7 or at least 10 or at least 12 or at least 15 consecutive teeth. In some embodiments, this feature may be provided such that for the majority of 'adjacent gap pairs' 370 (in FIGS. 17A, 370I and 370J are 'adjacent gap pairs —370I and 370K are not 'adjacent gap pairs') the distance between adjacent 'gaps' 370 (or, in some embodiments, the average of the distances between the adjacent gap pairs) is at most 2 cm or at most 1.7 cm or at most 1.5 cm It is possible to define a 'fill factor' of a 2D surface or of a 3D volume of space (i.e. a 'control area' or 'control volume') that includes both (i) 'matter of shield 220' or 'matter of teeth 330' (for example, plastic or any other appropriate material) as well as (ii) void or empty space (for example, 390 or 702 or 704). The 'fill factor' refers to the ratio of: (i) the total area (or volume) within the 'control area' (or 'control volume') that is occupied by matter DIVIDED BY; (ii) the total size (i.e. area or volume) of the control volume.

Figure 22A:
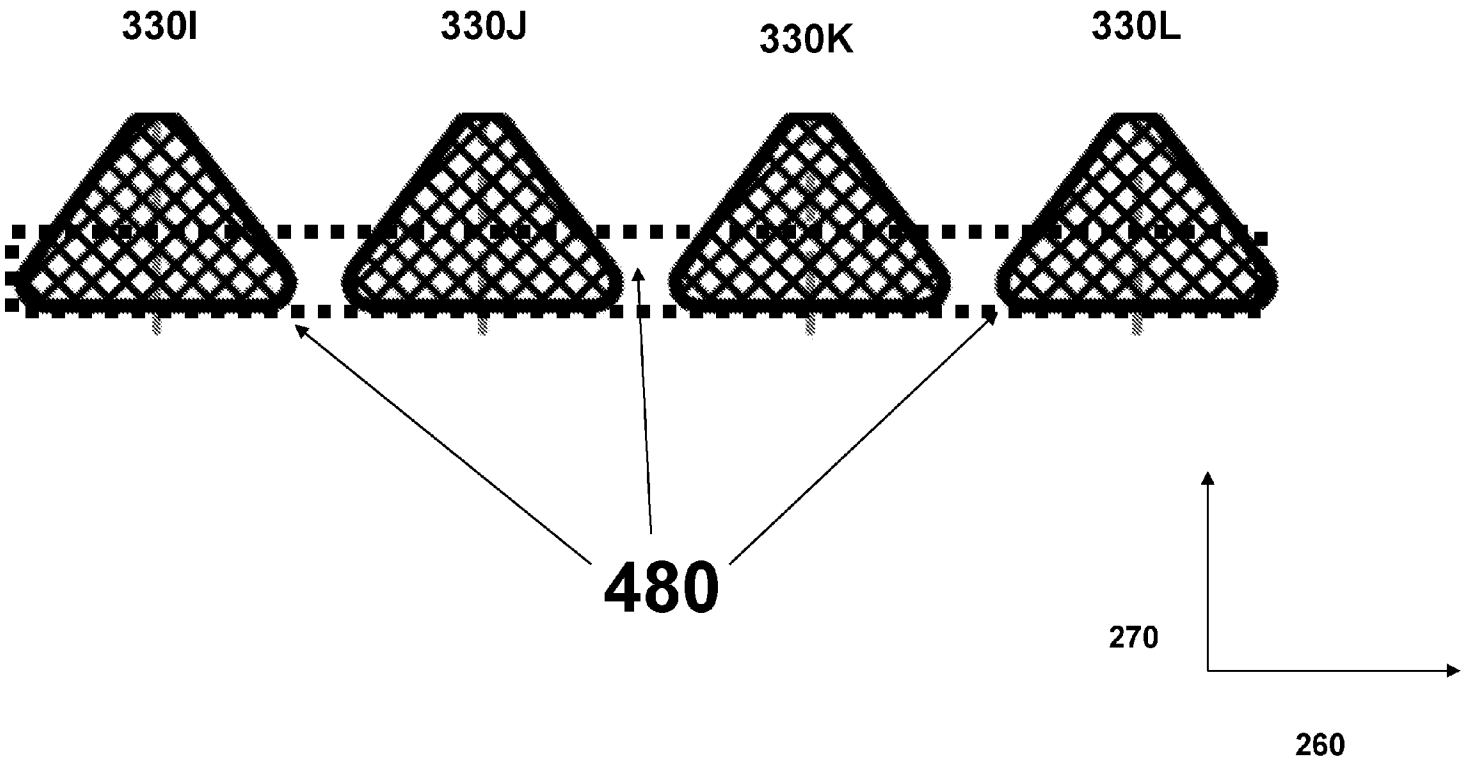
Figure 22B:
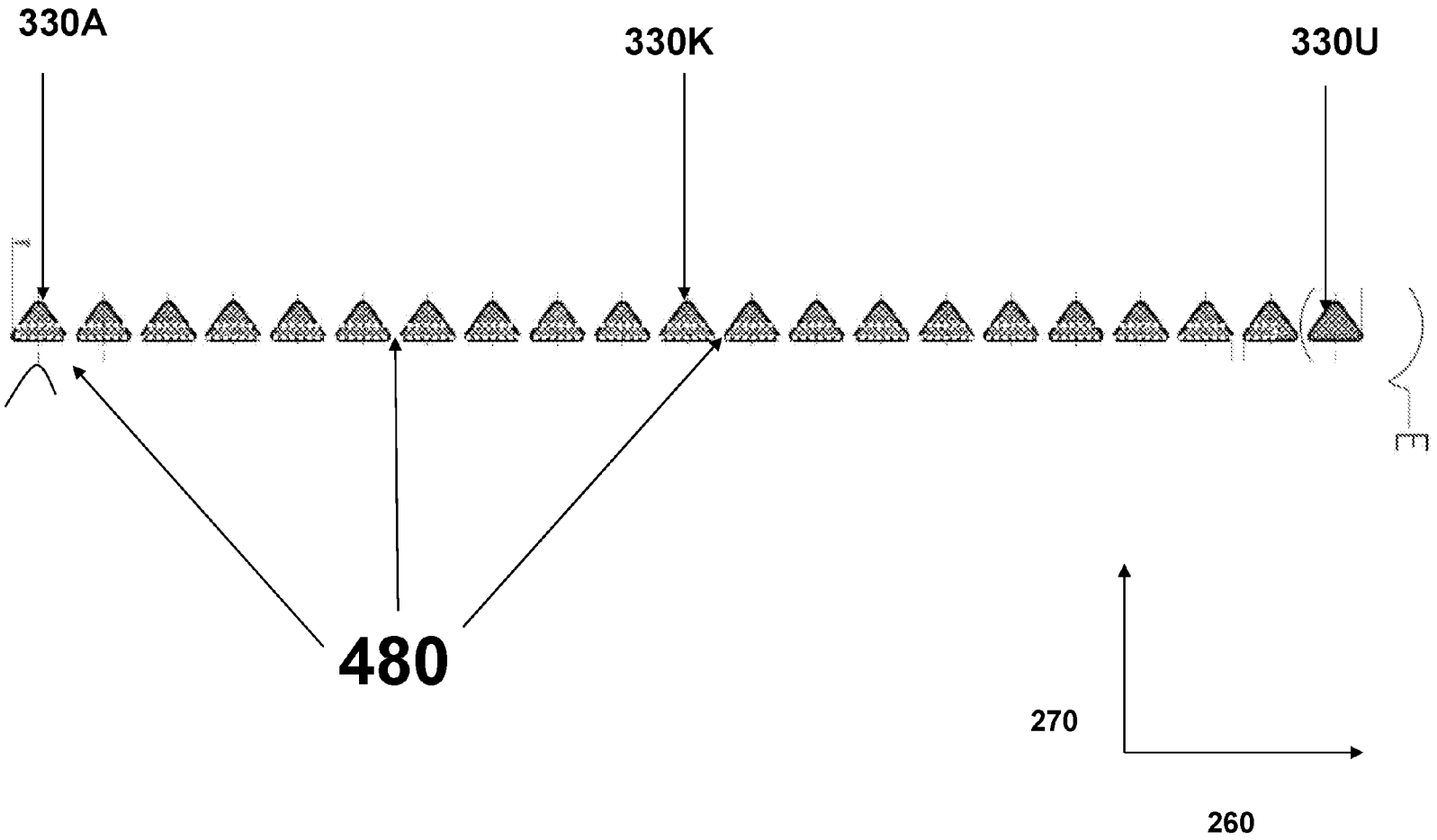

One example of a 'control' volume is illustrated in FIGS. 22A-22B (labeled as 810). The 'measurement' or 'length' of the control volume in the longitudinal dimension 250 may be at least 1 cm or at least 2 cm or at least 3 cm. The 'measurement' of 'length' of the control volume in the 'transverse direction' 260 may be at least 0.5 cm or at least 1 cm or at least 1.5 cm or at least 2 cm. In some embodiments, the 'fill factor' may be at least 60% or at least 70% or at least 75% or at least 80% or at least 85% or at least 90% or at least 95%.

The control area or the control volume may by substantially flat—e.g. in the lateral direction, following the contour of a mid-line or mid-curve of the shield (i.e. connecting 'midpoints' of adjacent teeth where the midpoint is defined by the 'average location' of the top 246 and bottom 248 of the tooth) following the contour of the bottom/lower surface 290.

In some embodiments, in the direction along the 'lateral direction' along the lateral direction, the control area or the control volume includes a plurality of elongated slots (i.e. these slots are 'voids' and may correspond with the 'minimum gap 370' or a location slightly above or below), each slot being at least 0.5 cm or 1 cm or 1.5 cm or 2 cm in length, where either (i) the average 'lateral distance between laterally-adjacent slots' is at most 4 mm or at most 3 mm or at most 2.5 mm or at most 2 mm; and/or (ii) a majority of slots (or a significant majority of slots—e.g. at least 70% or 80% of the slots) have a longitudinal-average width that is least 0.2 mm or at least 0.3 mm and at most 1.2 mm or at most 1 mm or at most 0.8 mm or at most 0.7 mm or at most 0.6 mm; (iii) a ratio between an average slot-slot lateral distance. and an average slot width is at most 4 or at most 3 (if this ratio is 'too high' and/or the slots are laterally spaced 'far from each other' this may 'reduce the opportunities for hair strands to upwardly traverse shield 220.

FIG. 23 relates to a use case where the cross section of not all teeth is the same. In FIG. 23A, the top of the tooth is 246, the bottom is 248, and the 'midpoint' or line is 249. This line may delineate two regions—a 'higher region' above 249 nearer to the top 246 of the tooth (this region will on average be narrower), and a 'lower region' below 249 nearer to the bottom 246 of the tooth (this region will on average be narrower).

In some embodiments, a ratio between (i) an average tooth cross width in this 'lower region' below 249 and (ii) an average tooth cross width in this 'higher region' above 249 may be at least 1.1 or at least 1.2 or at least 1.3 or at least 1.4 or at least 1.5 or at least 1.6 or at least 1.7 or at least 1.8 or at least 1.9 or at least 2 or at least 2.5

The 'average tooth cross section' width may be averaged according to any technique disclosed herein—for example, longitudinally over the tooth axis in a certain region of the entirety of the tooth and/or between any set of teeth (or sub-set) of the tooth array.

Figure 24A:
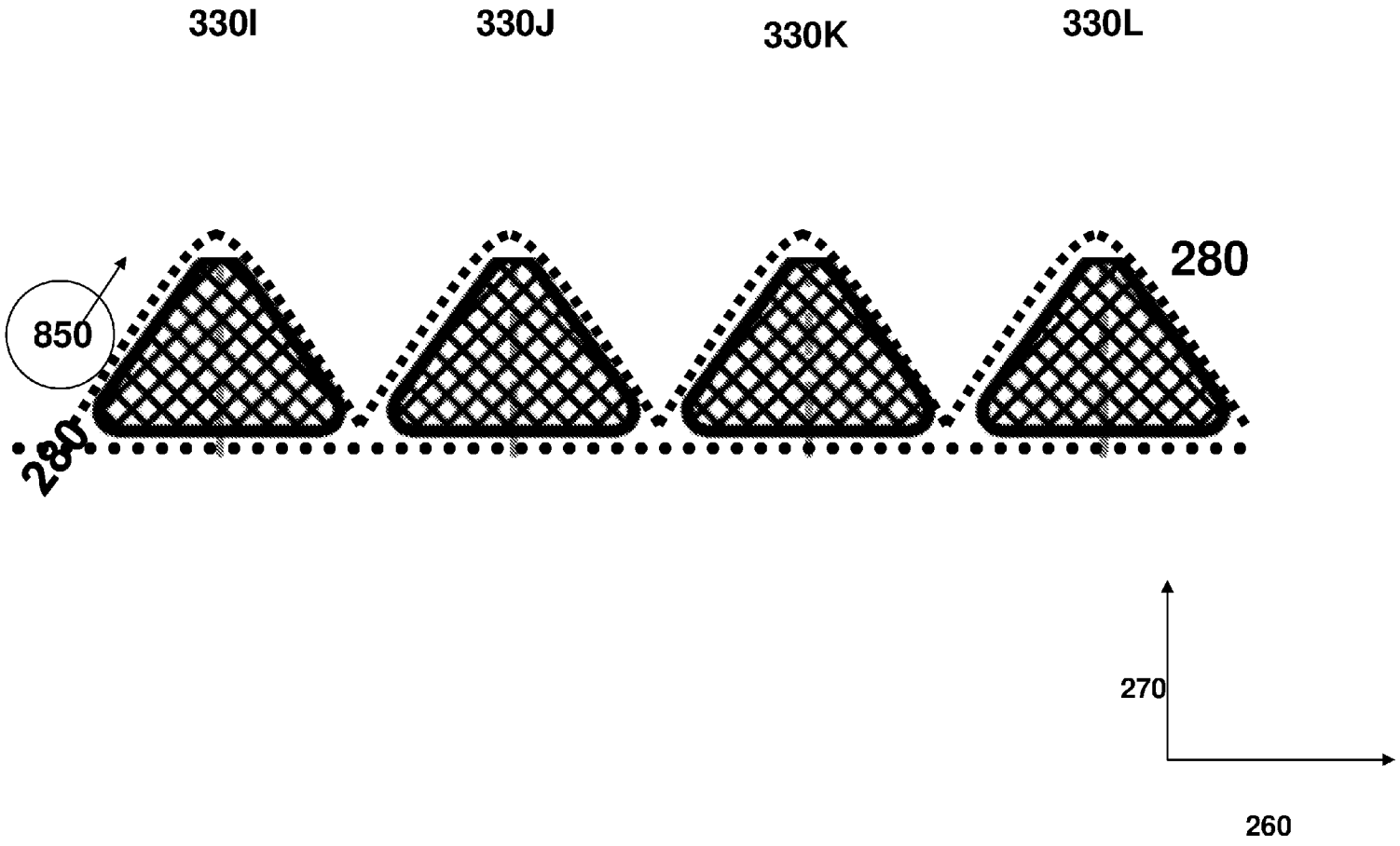
Figure 24B:
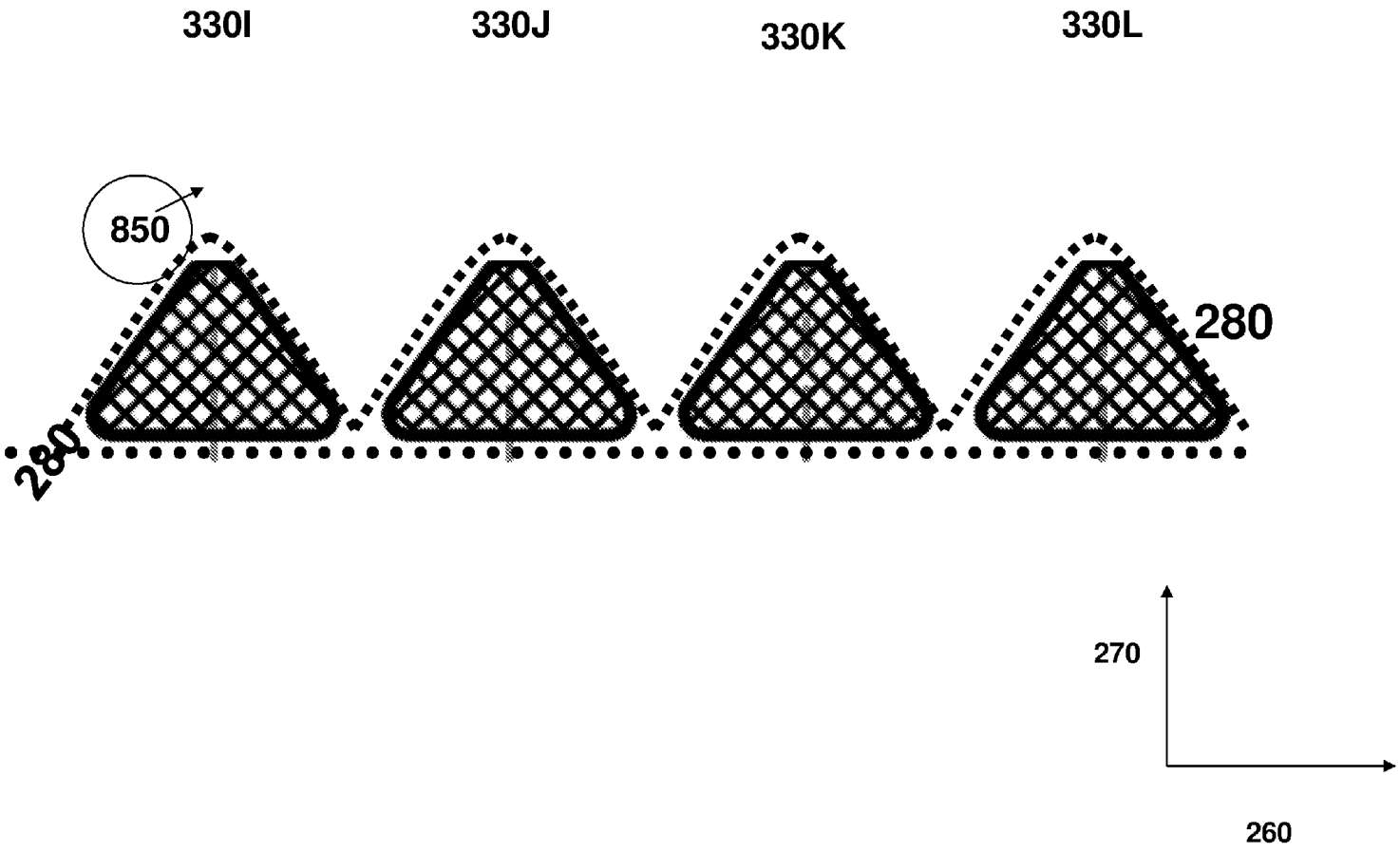
Figure 24C:
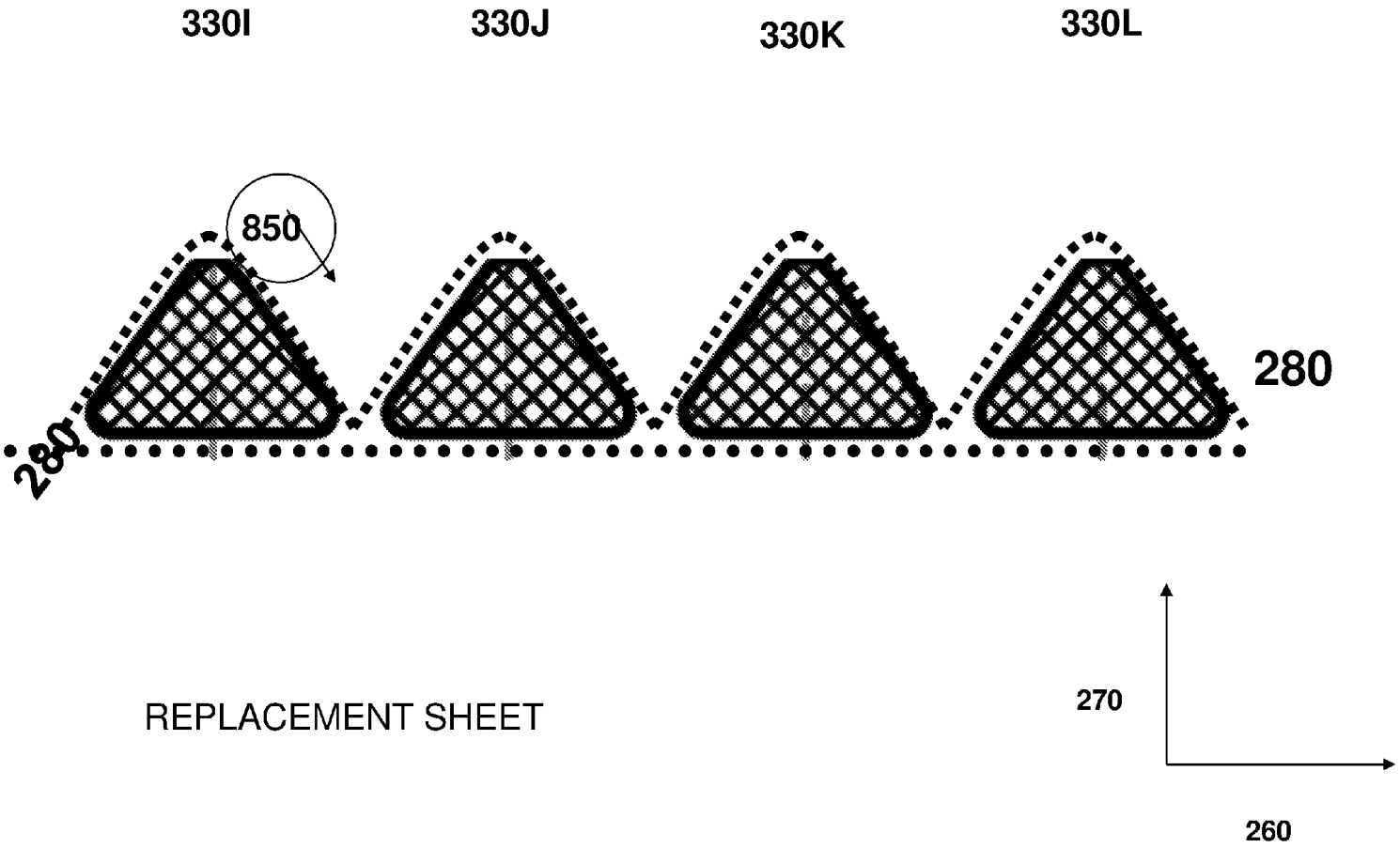
Figure 24D:
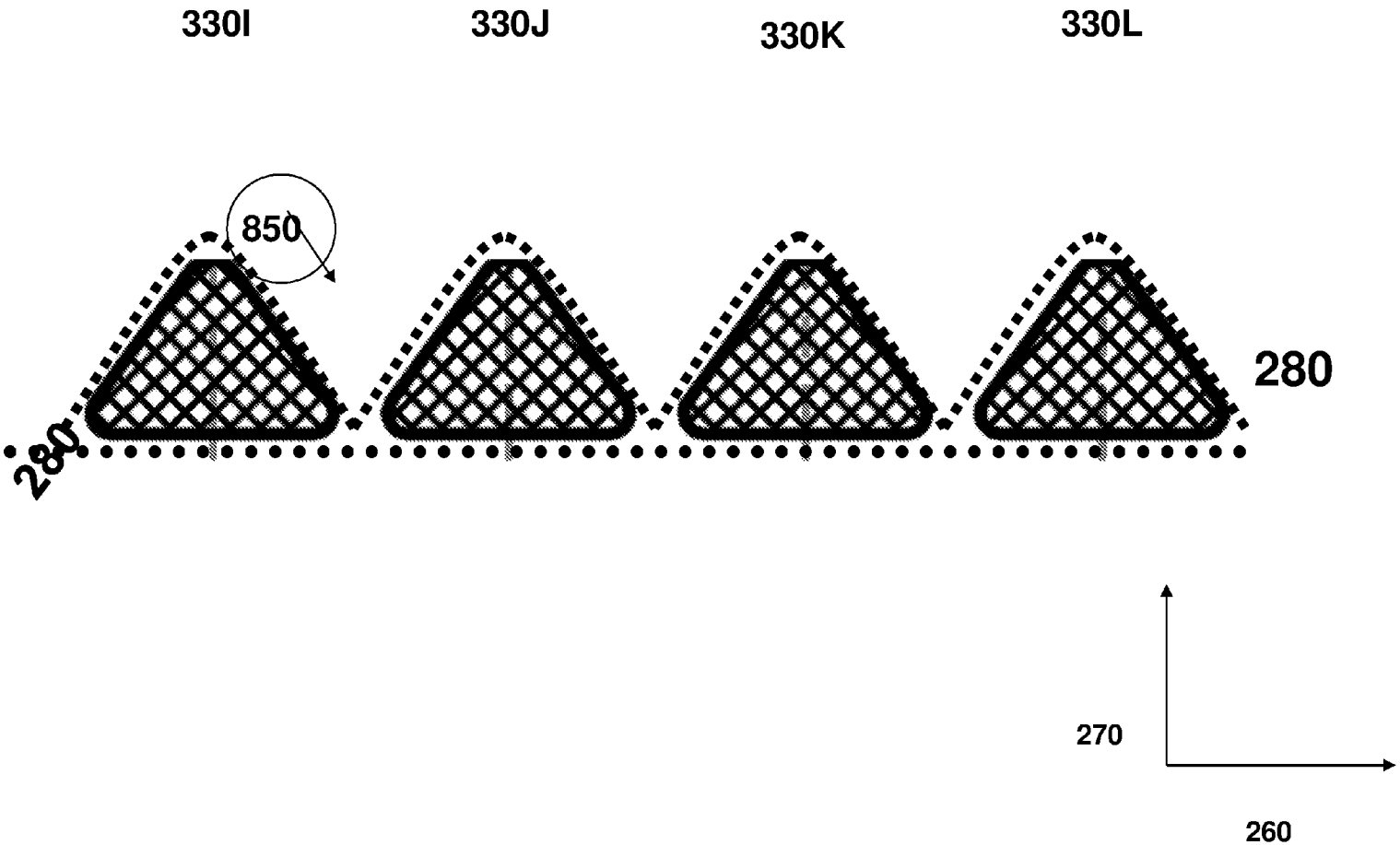
Figure 24E:
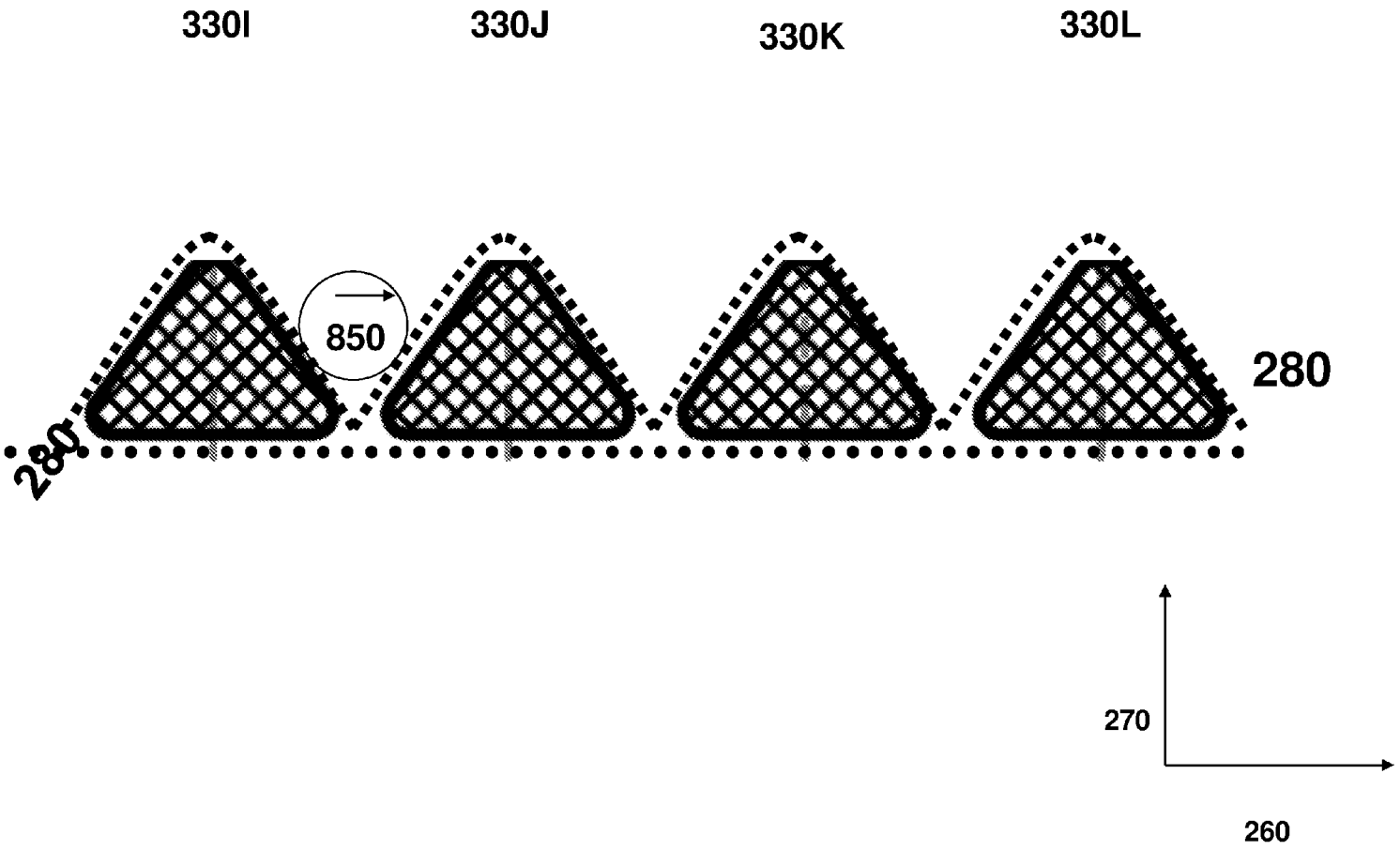
Figure 24F:
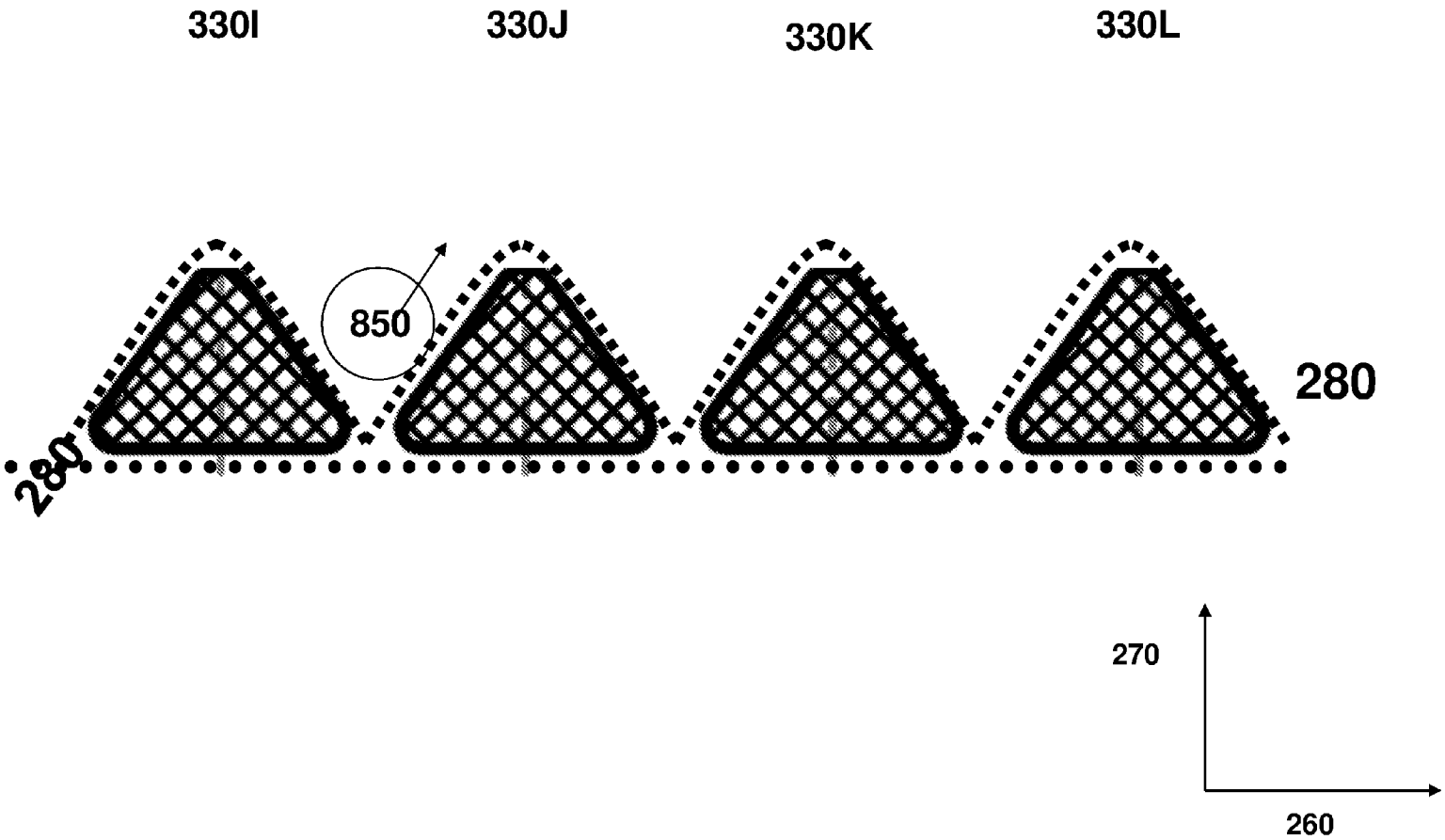

In FIG. 24B, the 'upper region' is defined as above point 911 (¾ of the way to the top) while the 'lower region' is defined as below point 909 (¾ of the way to the bottom).

In some embodiments, a ratio between (i) an average tooth cross width in this 'lower region' below 909 and (ii) an average tooth cross width in this 'higher region' above 911 may be at least 1.3 or at least 1.5 or at least 1.7 or at least 2 or at least 2.5 or at least 3 or at least 4 or at least 5 or at least 7 or at least 10. The 'average tooth cross section' width may be averaged according to any technique disclosed herein—for example, longitudinally over the tooth axis in a certain region of the entirety of the tooth and/or between any set of teeth (or sub-set) of the tooth array.

Figure 23A:
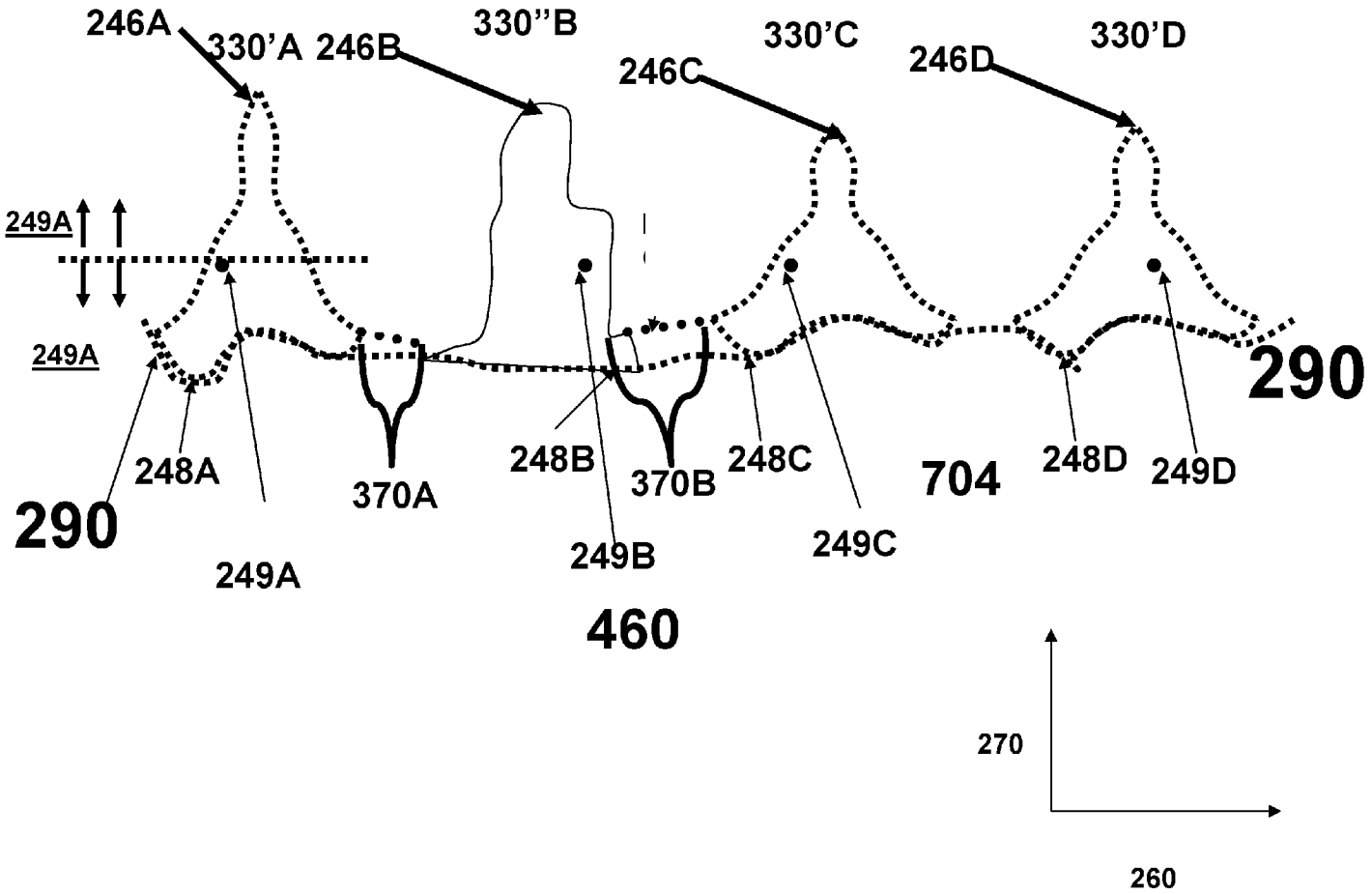
Figure 23B:
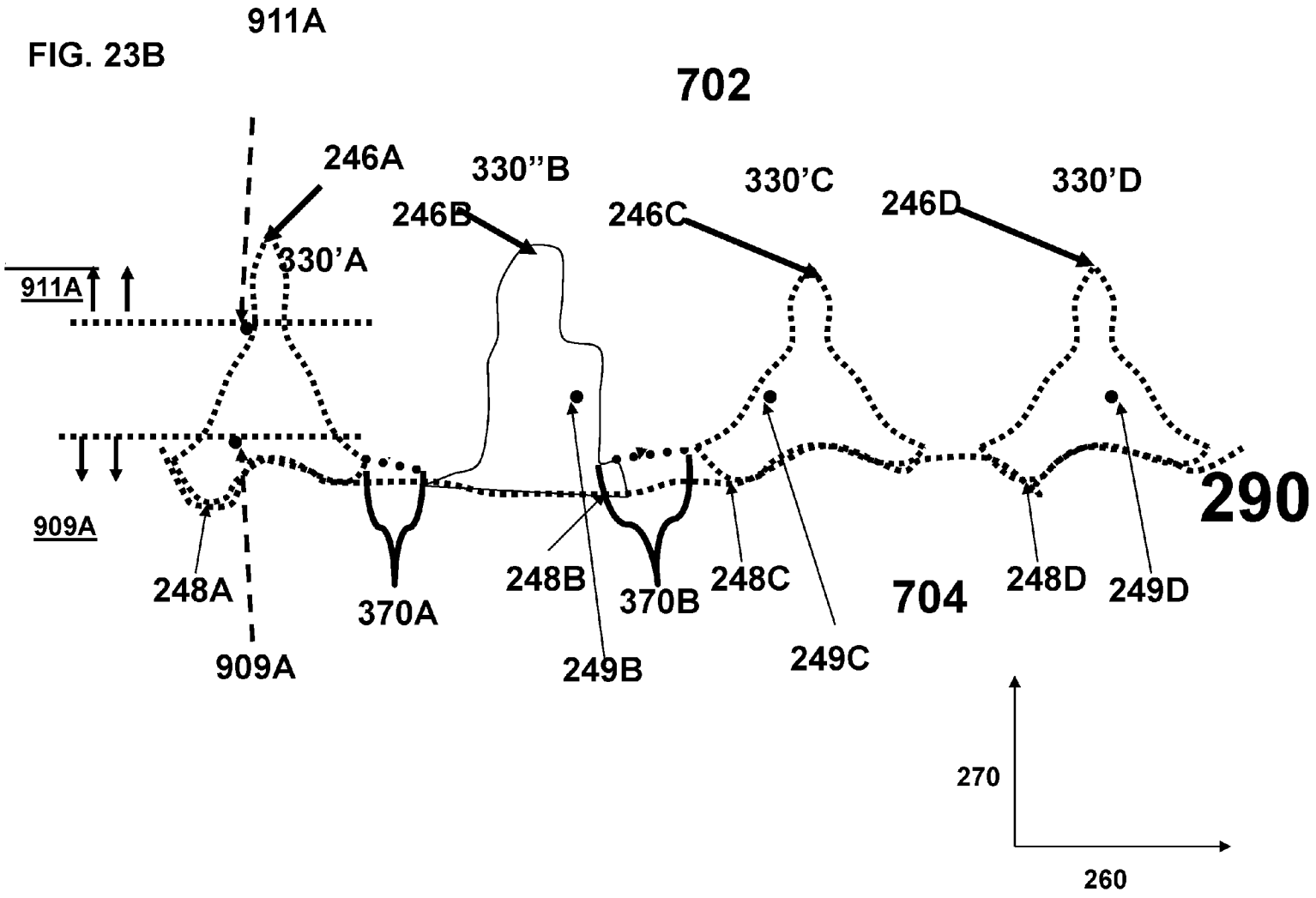
Figure 23C:
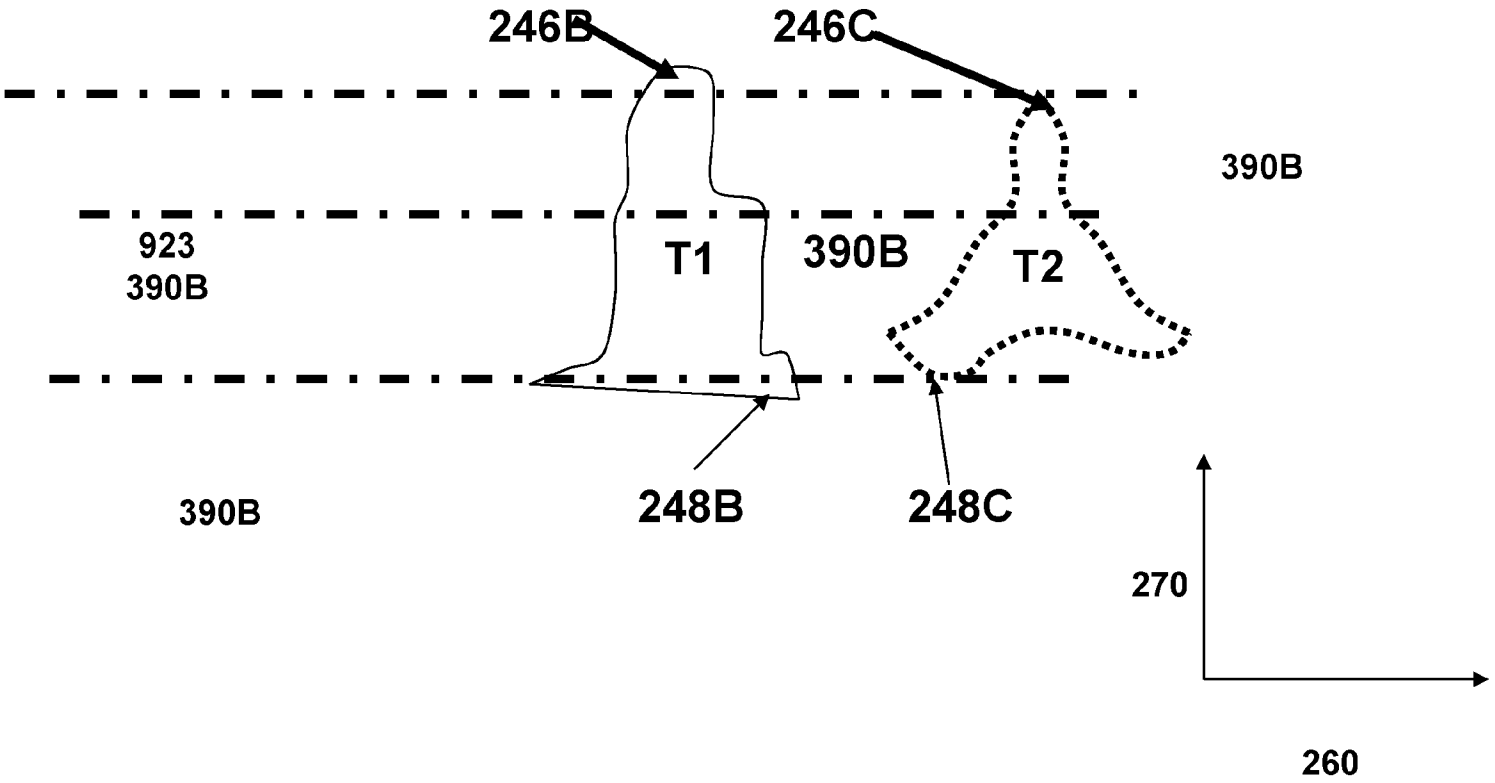
Figure 23D:
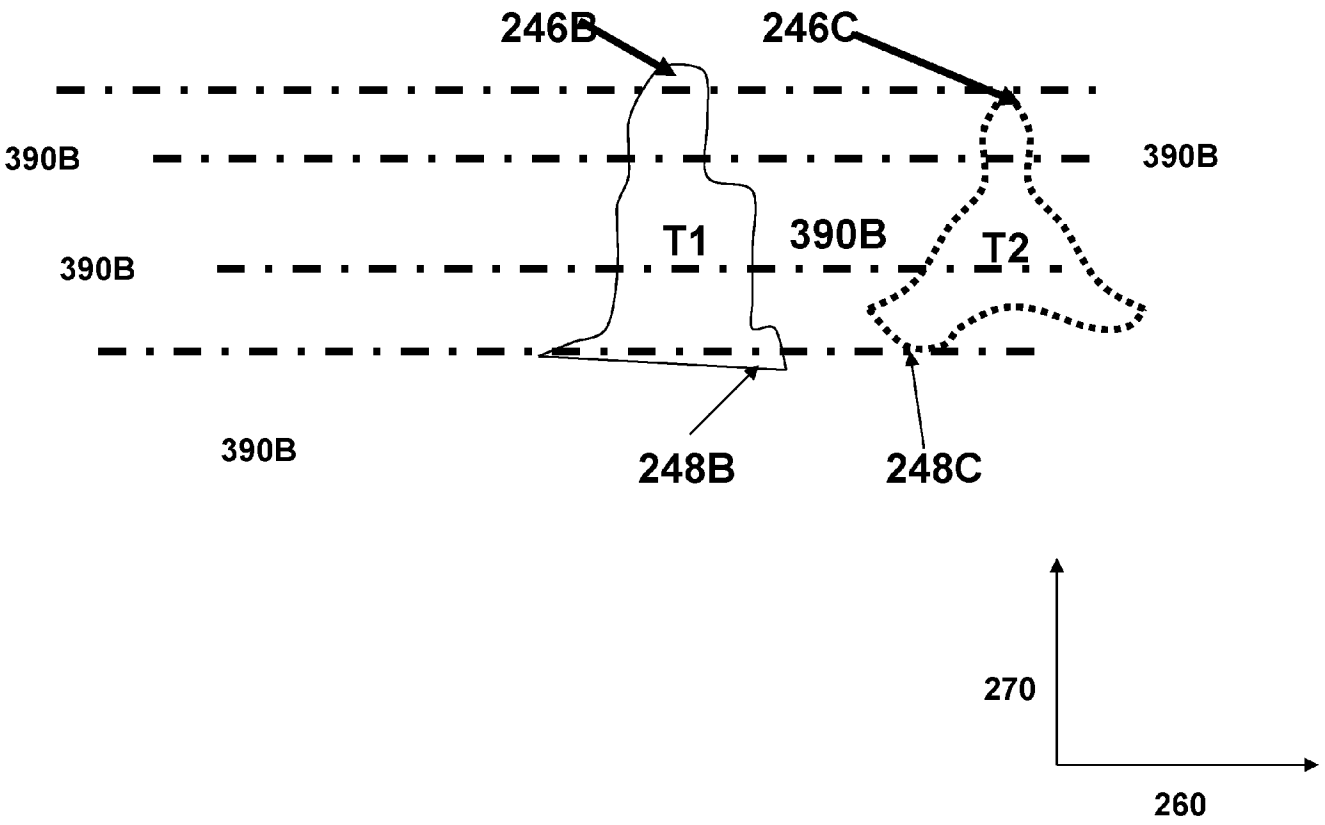

In FIG. 23C-23D, it is shown that the void or slot 390 may, in contrast to the teeth, be 'wider near at the top' ('near the top' is defined as above mid-height level 923 in FIG. 23C and above three-quarters height level 925 in FIG. 23D) and 'narrower near the bottom' ('near the top' is defined as below mid-height level 923 in FIG. 23C and below the one-quarter height level 927 in FIG. 23D)

The height ratio (i.e. average height in the wider region divided by average height in the narrower region) for the void (i.e. the 'wider region is the top' and the 'narrower region' is the bottom but the principle, for at least the example of FIG. 23, may be similar. Thus height ratio for the void may be for FIG. 23C (i.e any case of the 'mid-height level) at least 1.1 or at least 1.2 or at least 1.3 or at least 1.4 or at least 1.5 or at least 1.6 or at least 1.7 or at least 1.8 or at least 1.9 or at least 2 or at least 2.5 and for FIG. 23D (any case of the quarter or three quarter level) at least 1.3 or at least 1.5 or at least 1.7 or at least 2 or at least 2.5 or at least 3 or at least 4 or at least 5 or at least 7 or at least 10.

As noted above, in some embodiments, the tooth may have an asymmetric width profile where the region closer to the bottom 248 of the tooth 330 tends to have a wider/large width, while the region closer to the top 248 of the tooth 330 tends to have a narrower/smaller width. As noted above, this may lead to a situation where the top/upper surface 280 of shield 220 has a relatively rough topography (for example, undulating) while the bottom/lower surface 290 of shield 220 has a relatively 'smooth' topography.

In some embodiments, if one were to move a small cylinder 850 (e.g. having a length of 1 mm or 2 mm or 3 mm or 5 mm or 1 cm or 1.5 cm or 2 cm or 2.5 cm) in a lateral direction over upper surface 280 (e.g. for each tooth pair lower-bounded by the location of the minimum gap 370), because the upper surface of topographically rough, this cylinder would move up and down as the small cylinder is moved over upper surface 280—this is shown in the frames of FIG. 24A-24F.

Various numbers describing possible cylinder sizes may refer either to cylinder radius or cylinder diameter. In one example, the cylinder 850 has a radius or diameter of 0.6 mm. In another example, the cylinder 850 has a radius or diameter of 0.8 mm. In one example, the cylinder 850 has a radius or diameter of 0.6 mm. In another example, the cylinder 850 has a radius or diameter of 1 mm. In one example, the cylinder has a radius o or diameter f 0.6 mm. In another example, the cylinder 850 has a radius or diameter of 1.3 mm.

Possible minimum cylinder radii (or minimum diameters) are: 0.4 mm, 0.5 mm, 0.6 mm, 0.8 mm, 1 mm, 1.2 mm, 1.4 mm, 1.6 mm, 1.8 mm and 2 mm. Possible maximum cylinder radii (or maximum diameters) are: 2.5 mm, 2 mm, 1.8 mm, 1.6 mm, 1.4 mm, 1.2 mm, 1 mm, 0.8 mm and 0.4 mm—ranges may be formed by any mixing of any minimum and any maximum (for this feature or any feature herein).

Figure 25A:
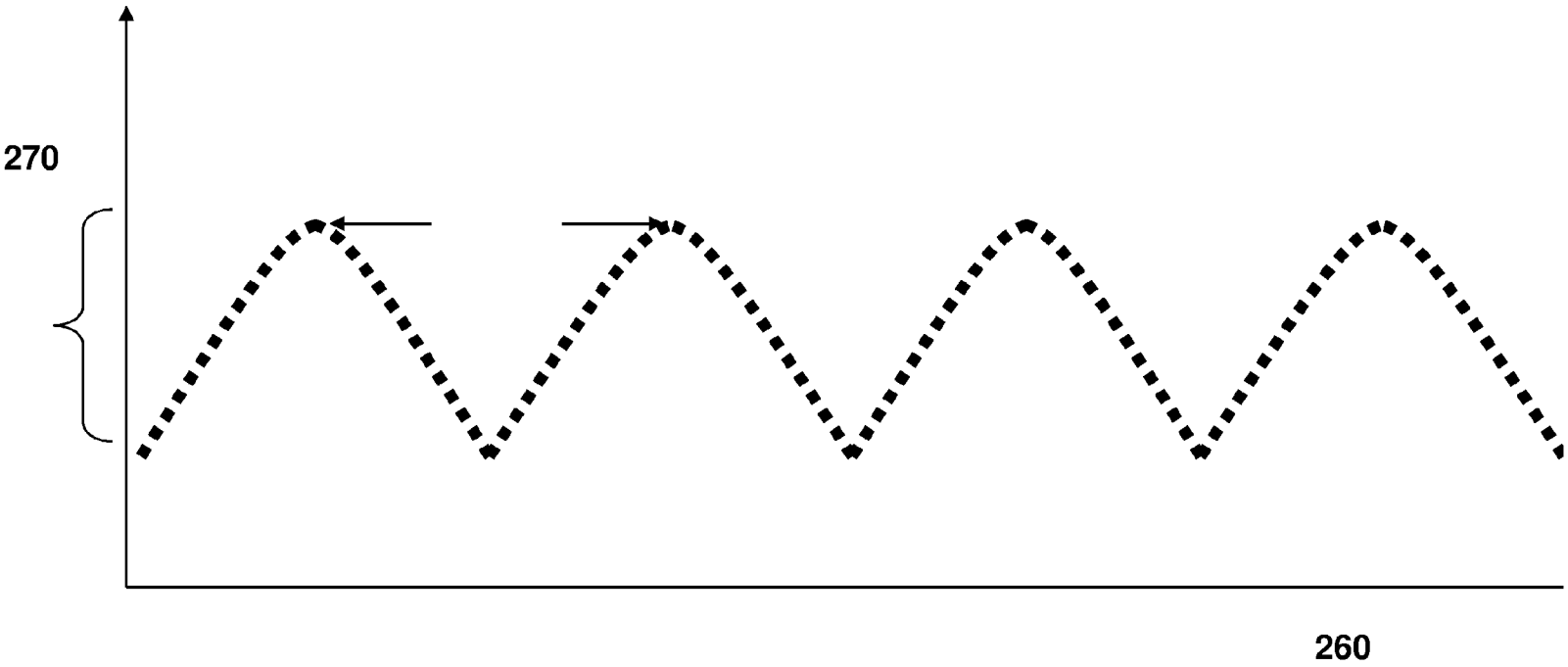
FIG. 25 relates to a trajectory of a movement of a hypothetical cylinder.
Figure 25B:
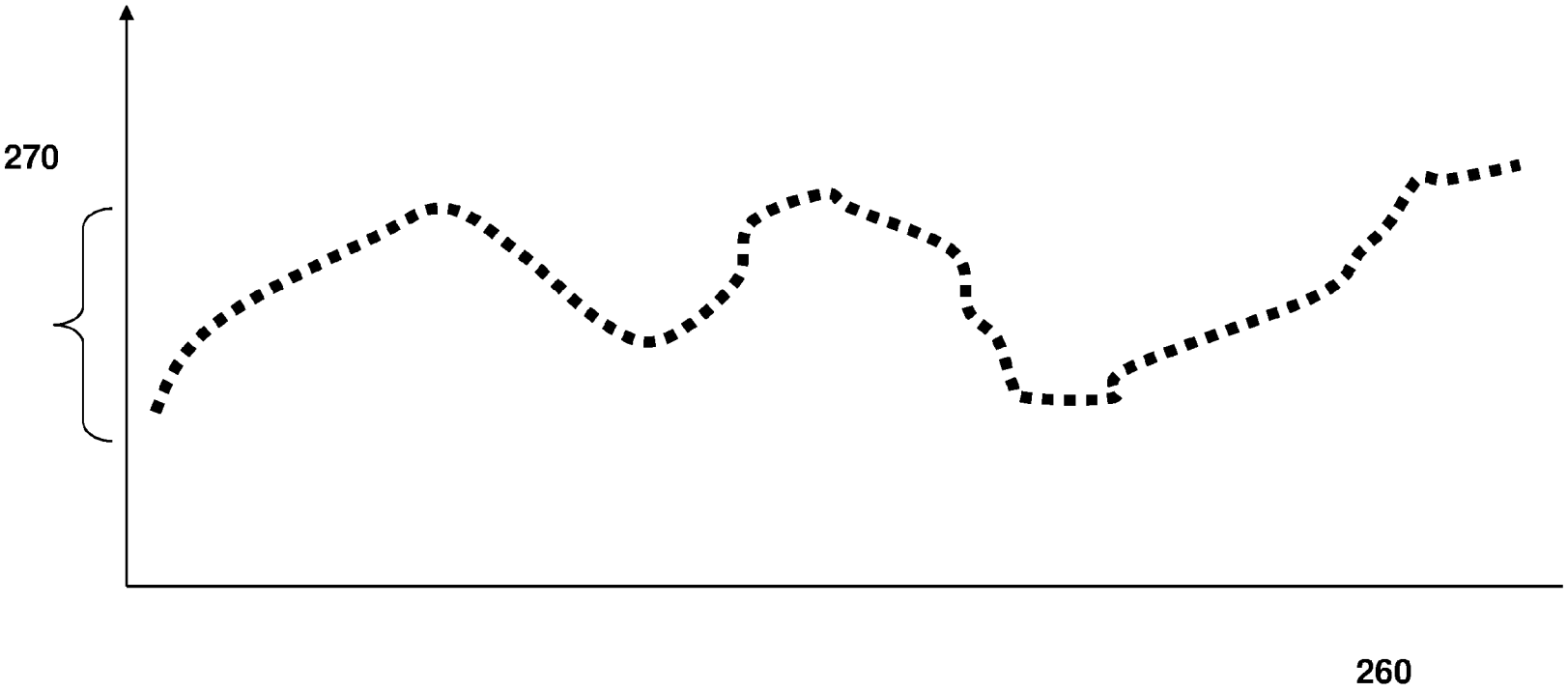

In FIGS. 25A-25B, the trajectory of the cylinder from the 'experiment' of FIG. 24 is illustrated—the magnitude/size (i.e. in the 'height direction) of the undulations and/or oscillations is given by OSC1 and may be at least 0.4 mm or at least 0.6 mm or at least 0.8 mm or at least 1 mm or at least 1.2 mm or at least 1.4 mm or at or at least 1.6 mm or at least 1.8 mm or at least 2 mm. This 'oscillation' or 'undulation' magnitude (which ultimately describes surface 280) may be achieved on 'distinct' occasions (i.e. separated in the 'lateral direction' by at least 1 mm or by at least 1.5 or by at least 1.8 mm or by at least 2 mm or by at least 2.5 mm) along the lateral directions—for example, at least 3 times or at least 5 times or least 7 times or at least 10 times or at least 13 times. In the non-limiting example of FIG. 24A, the lateral separation distance between these 'distinct occasions' corresponds to the substantially periodic form (i.e. in the lateral 260 direction) of surface 280. However, it is noted that the surface 280 is not required to be periodic.

Figure 26A:
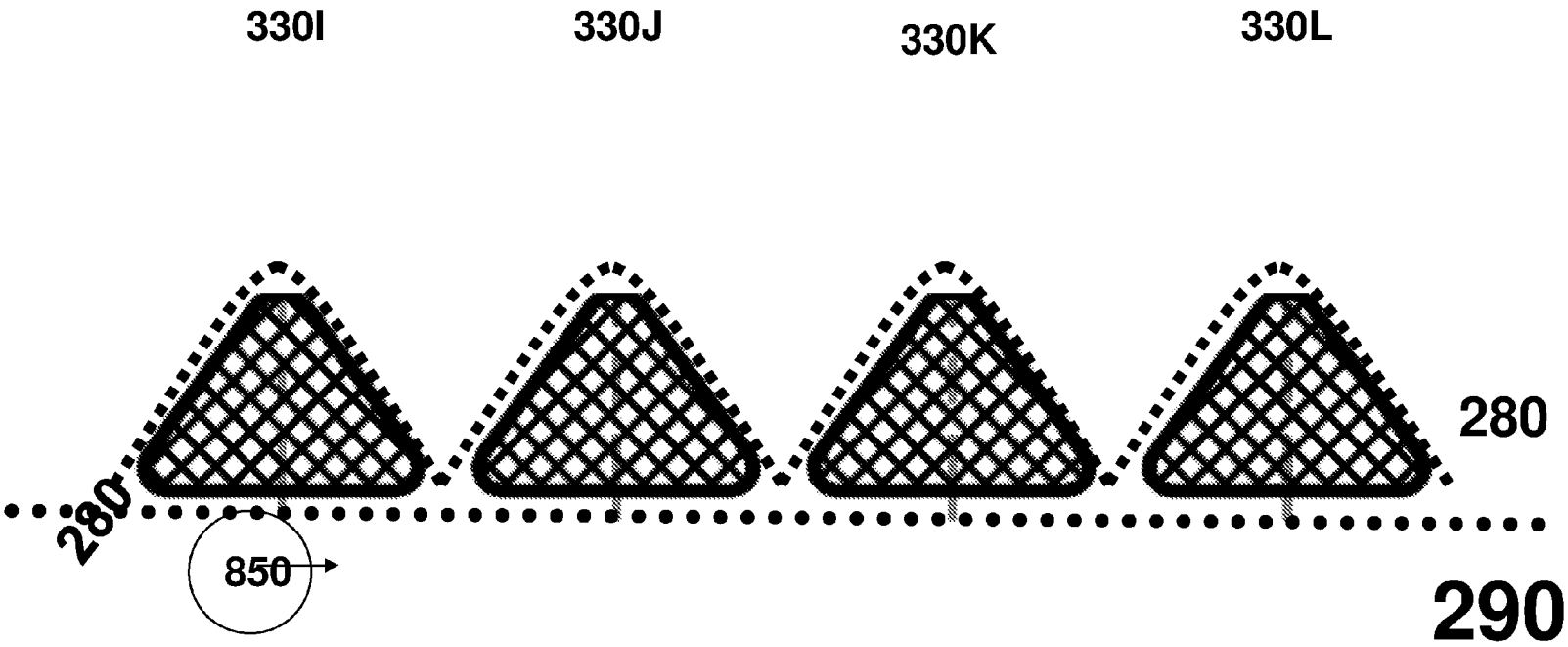
Figure 26B:
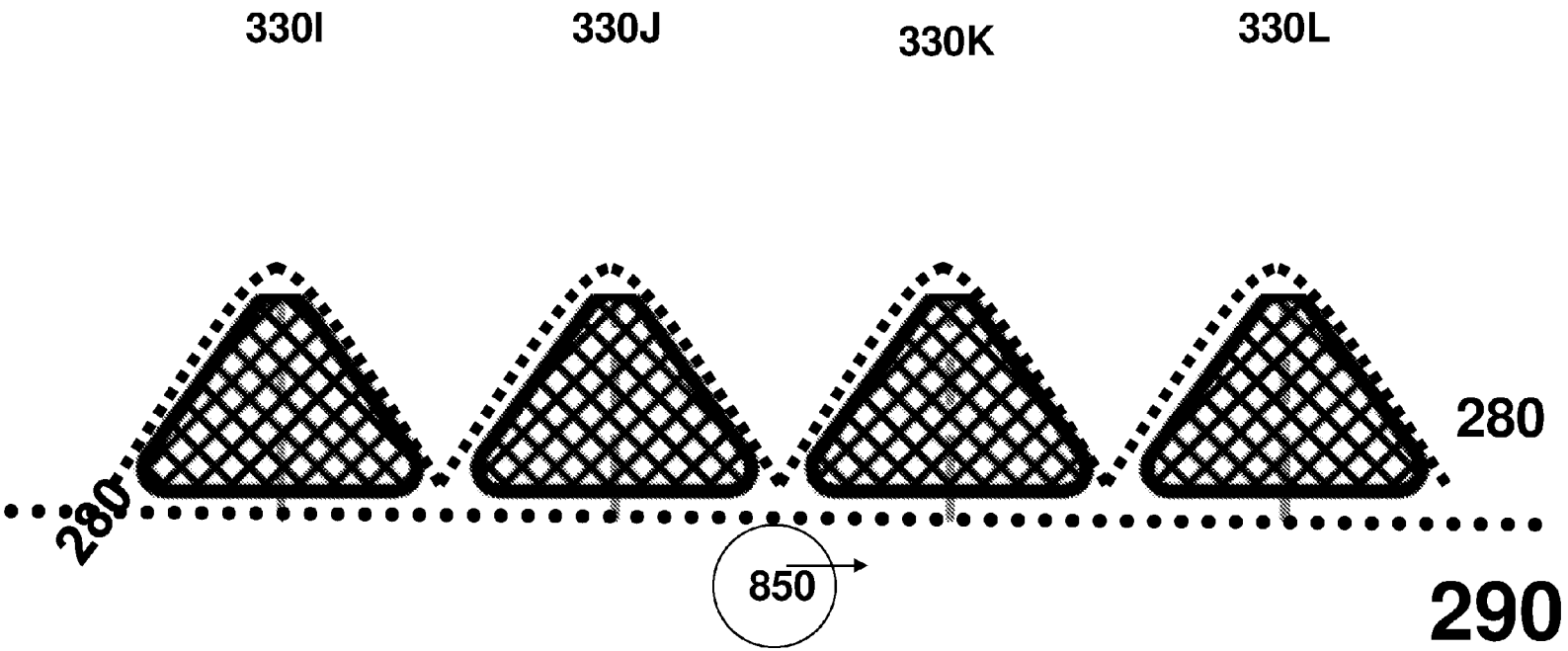
Figure 26C:
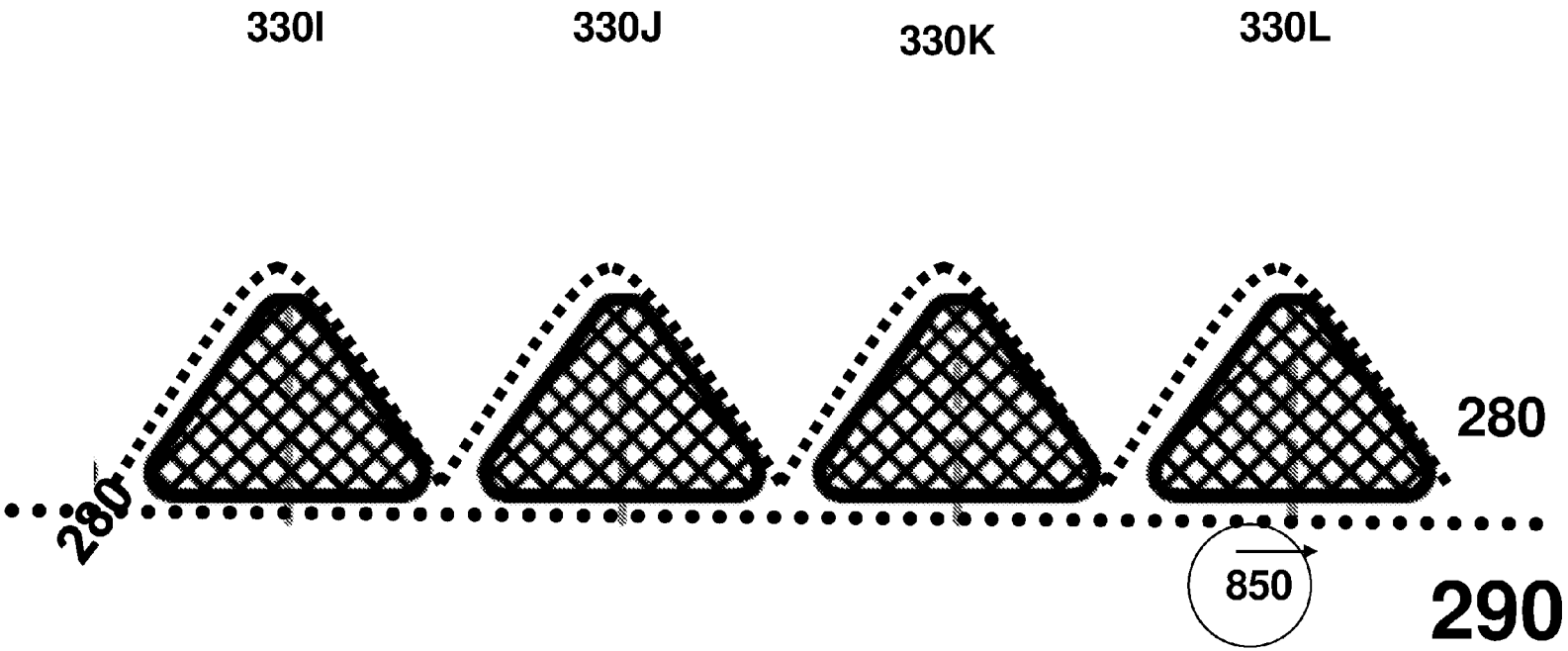
Figure 27:
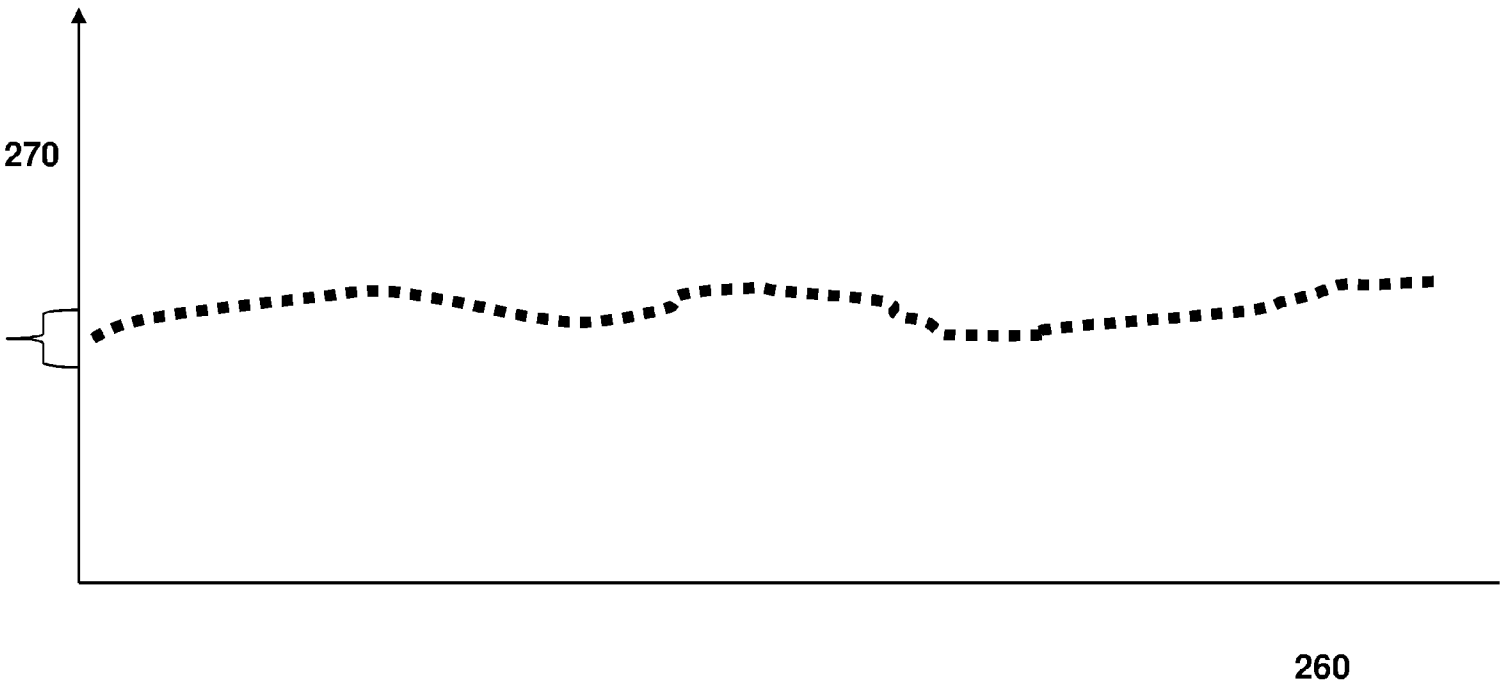
FIG. 27 illustrates a trajectory.

In FIG. 26, the experiment of FIG. 24 is repeated, with the same cylinder, for the 'lower/bottom surface 290.' In FIG. 27, the trajectory is illustrated. the magnitude/size (i.e. in the 'height direction) of the undulations and/or oscillations is given by OSC2 and may be at most 1 mm or at most 0.5 mm or at most 0.3 mm or at most 0.3 mm or at most 0.1 mm. In some embodiments, in order for OSC2 to 'count,' it needs to occur only once. In some embodiments, it needs to occur at least 2 or 3 or 4 or 5 or 7 times at 'distinct lateral locations' separated by at least 1 mm or 1.5 mm or 2 mm.

In some embodiments, OSC1 is larger than OSC2 so that the ratio between OSC 1 and OSC2 is at least 2 or at least 3 or at least 5 or at least 7 or at least 10. It is understood that for the rounded triangles OSC1/OSC2 may be quite large—however, for other shapes that are also substantially triangular (for example, if there is some sort of structure 'below' the base, then OSC1/OSC2 may not be as large.

Various embodiments of the present invention may relate to: methods for coloring hair (for example, with an aerosol hair-coloring agent); devices for coloring hair (for example, including shield 220 and aerosol assembly 400) kits for coloring hair (for example, including a shield 220 and aerosol assembly 400 or a portion of an aerosol assembly) and shields 220 configured to be useful for hair coloring. Thus, in some embodiments, shield 220 and aerosol assembly 400 may be sold separately or as a kit (for example, attachable to each other either permanently attachable or detachably attachable.

Thus, any 'system or device including a shield and an aerosol assembly' may also be provided as a 'kit including the shield and the aerosol assembly where the shield and the aerosol assembly may be coupled to each other (for example, assembly by fastening at least a portion of each to each other).

In one non-limiting example, a single kit includes an aerosol assembly and shields 220 of multiple lengths—for example, a 'short shield' of a longitudinal length (e.g. from the tip to the base of the tooth) of less than 4 cm or less than 4.5 cm, and a 'long shield' of a longitudinal length (e.g. from the tip to the base of the tooth) of more than 5 cm or more than 5.5 cm or more than 6 cm or more than 6.5 cm (i.e. any combination).

Figure 28:
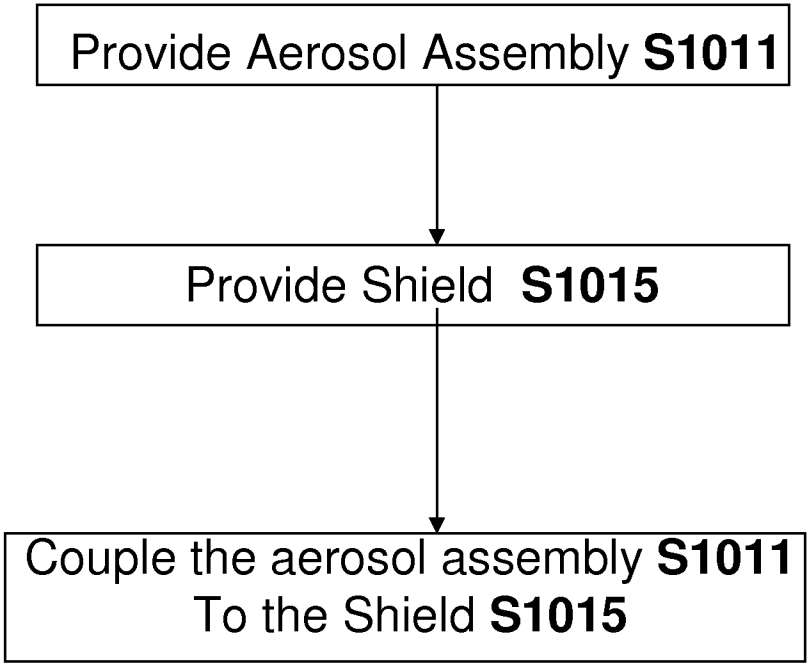
FIGS. 28-29 relate to methods for coloring hair in accordance with some embodiments.

FIG. 28 describes a routine for assembling such a kit into any presently-disclosed system.

Figure 29:
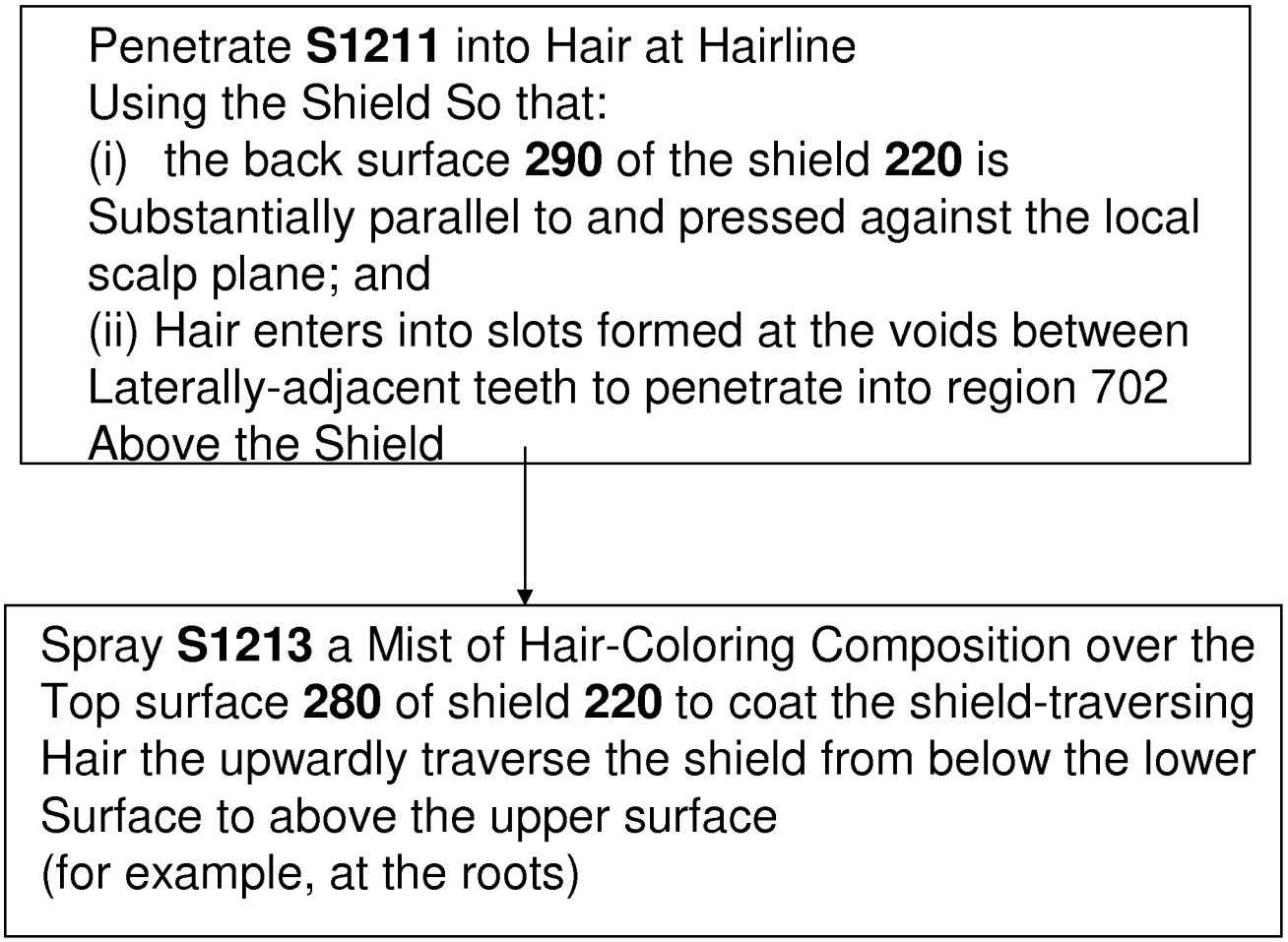

FIG. 29 is a flow chart of using a hair coloring device (see FIGS. 11-12 also).

Figure 30A:
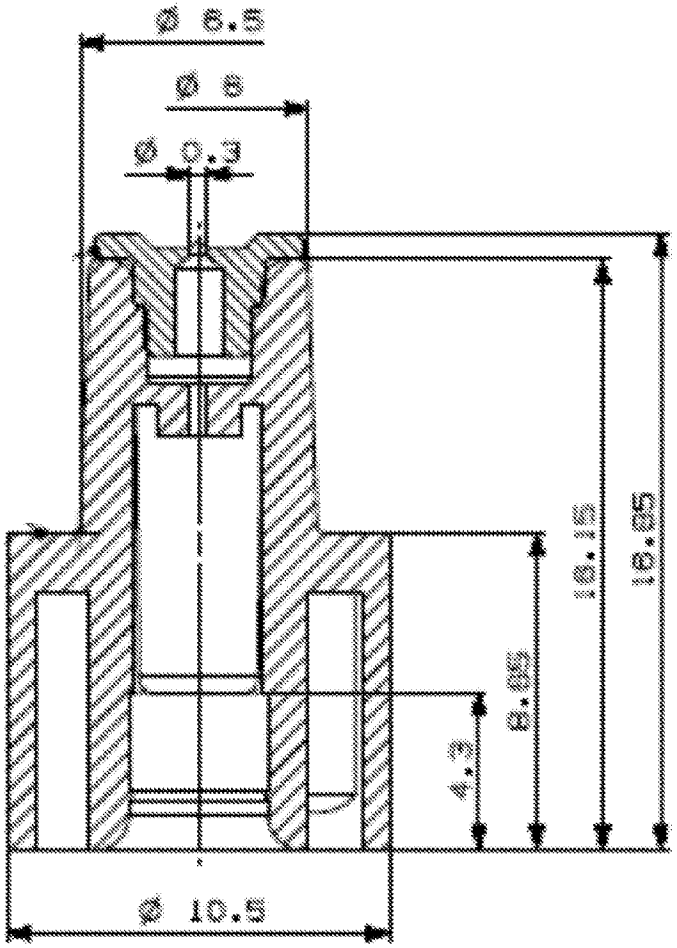
FIGS. 30A-30B relate to spray apparatus in accordance with some embodiments.

FIG. 30 describers an aerosol assembly—for example, the orifice has a width of 0.3 mm in FIG. 30A, the form relatively small droplets (e.g. less than 100 microns by average, or less than 80 microns or less than 60 microns or less than 50 microns)—thus, the width of the orifice may be less than 0.6 mm or less than 0.5 mm.

Figure 30B:
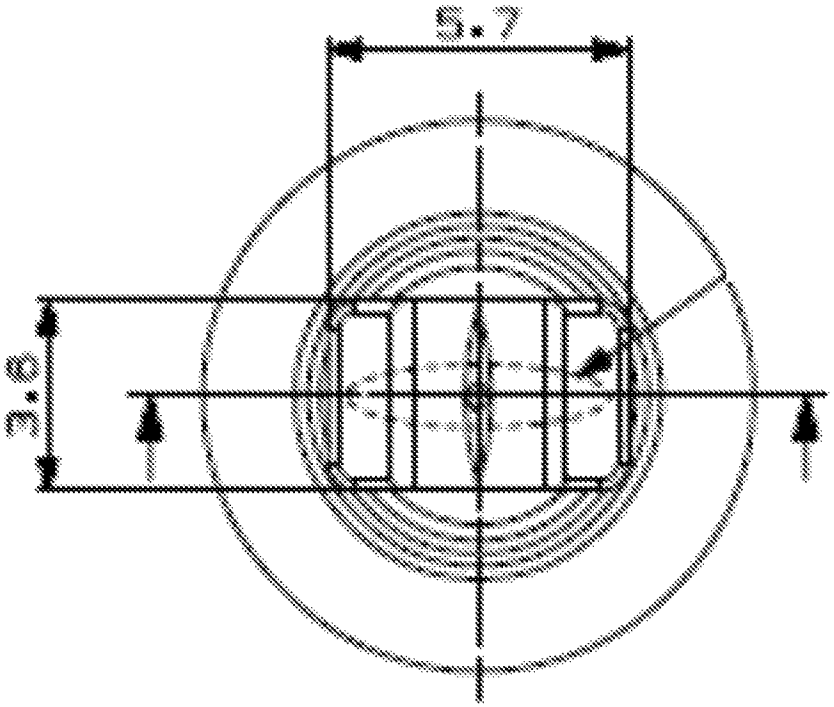

One salient feature of FIG. 30B, is a 'rectangular-shaped spray insert' (e.g. a ratio between a length and a width is at least 1.2 or at least 1.4 so that the produced spray (see the dotted line which shows a primarily horizontal spray form) is a fan spray, for example, having a substantially rectangular cross section.

General Discussion of Features

As noted earlier, some embodiments of the present invention relate to a slot array of elongated slots or a tooth array of elongated teeth. It is appreciated that various tooth or slot properties (for example, relating to a width profile, an aspect ratio, a cross-section shape, a gap distance near teeth) may not be required to prevail for a majority of teeth and/or for a majority of locations along elongated tooth or slot axis (i.e. within the entirety of the tooth or the slot or within a given elongated 'section').

For any feature or combination of features disclosed herein for a 'majority of teeth' (i.e. of a plurality of teeth) or a majority of voids or slots (i.e. for a plurality of voids or slots) this feature may also apply (i.e. any feature or combination of features), in alternative embodiments, to a 'significant minority' (i.e. at least 30%) or to a 'significant majority' (i.e. at least 70%) or a 'very significant majority' (i.e. at least 90%) of teeth or voids or slots.

Similarly, for any feature or combination of features disclosed herein for "most locations' (i.e. for at least 50% of the locations) within a 'section' of a tooth or slot or void or the shield (i.e. along a longitudinal or central axis) along a longitudinal axis and/or along length of tooth and/or along a length of slots or a length of voids between neighboring teeth, this feature of may also apply to 'significant minority' (i.e. at least 30%) of locations within the section or to a 'significant majority' (i.e. at least 70%) of locations in the section or a 'very significant majority' (i.e. at least 90%) of teeth of locations in the section along a longitudinal axis.

Some features (or combinations of features) are disclosed for 'sections of teeth' or 'section of shield' having a given length. For any feature or combination of features, this length may be at least 2 cm, or at least 2.5 cm or at least 3 cm or at least 3.5 cm or at least 4 cm.

When a feature (or feature combination) is disclosed for a majority or significant minority or significant majority or a very significant majority of a number of slots or voids or teeth, this number of teeth or slots or voids may be at least 8, at least 10, at least 12, at least 14, at least 16, at least 18, or at least 20 for any feature (of combination) disclosed herein.

Any discussion of 'majority' may also apply to 'significant minority' (at least 30%) or 'significant majority' (i.e. at least 70%) or a 'very significant majority' (i.e. at least 90%).

The skilled artisan will know how to choose appropriate materials from which the shield or any other component should be constructed. In one non-limiting example, the shield is constructed from plastic or any other material apparent to the skilled artisan after reading the present disclosure.

In some embodiments, a kit for constructing any presently disclosed system is described. The kit may include: (i) a hair penetrating shield and (ii) a aerosol assembly which when coupled to each other may produce any presently disclosed hair-coloring device (i.e. that include both the shield and the aerosol assembly).

In one example, a single kit may include multiple shields such a longer shield and shorter shield. A length ratio (i.e. where length is along the longitudinal direction) between the lengths of two shields may be at least 1.3 or at least 1.5 or at least 1.7 or at least 2.

In some embodiments, any kit may include instructions for combining and/or mating the aerosol assembly and the hair shield (for example, according to FIG. 28).

In some embodiments, when the 'quick-drying' hair-coloring composition is delivered to hair (for example, for coat the hair), it may dry on the surface of the hair in less than 8 minutes or less than 6 minutes or less than 4 minutes or less than 2 minutes.

Generally speaking, a 'quick-drying' composition or agent dries faster than water. In one example, when a drop (e.g. from an eye-dropper) the 'quick-drying' composition or agent is placed on a porcelain plate in room temperature conditions, it will dry faster than the water (i.e. subjected to a similar porcelain plate experiment). In some embodiments, the drying time of the 'quick-drying' composition or agent may be closer to the drying time of alcohol (i.e. subjected to an identical porcelain plate experiment) than to the drying time of water.

One salient feature of FIG. 11 is that the shield is relatively long and narrow. In some embodiments, the ratio of length to the width of the shield is at least 1.25 or at least 1.5 or at least 1.7 or at least 2. Use of a 'narrow shield' (i.e. whose width is at most 5 cm or at most 4 cm or at most 3 cm or at most 2 cm). may be useful for treating 'delicate areas' though this is not a requirement.

First Additional Discussion

It is now disclosed for the first time a hair-coloring device for coloring hair roots, the device comprising: a) a hair-penetrating shield 220 comprising a tooth array having top 280 and bottom 290 surfaces and having proximal 228 and distal 224 ends, the tooth array including at least eight (or at least 10 or at least 12 or at least 14 or at least 16 or at least 20) closely-spaced teeth such that for a majority (or a 'significant' or 'very significant' majority) of teeth of the tooth array: i) each tooth of the majority includes a main portion 330 and a tapered distal portion 240 for facilitating hair penetration; and ii) for each tooth of the majority, the main portion 330 includes a section having a length of at least 2.5 cm where for most locations along the tooth axis within the section:

A) a cross section of the tooth has an asymmetric width profile along the shield thickness axis 270 such that the tooth cross section, on average, is narrower near the top 248 of the tooth and the tooth cross section, on average, is wider near the bottom 246 of the tooth;

B) the tooth cross-section is less than 5 mm^2 (in some embodiments, less than 3 mm^2 or less than 2.5 mm^2 or less than 2 mm^2—in some embodiments, at least 0.5 mm^2 or at least 0.75 mm^2 or at least 1 mm^2); and C) the tooth is separated from a laterally neighboring tooth to provide a minimum gap distance 370 that is between 0.3 mm and 1 mm, and b) an aerosol assembly 400 coupled to the hair-penetrating shield, the aerosol assembly including an aerosol outlet elevated above the top surface 280 of the shield, the aerosol assembly configured to dispense or 'spray out' a non-viscous hair-coloring agent as a mist in a proximal-distal direction defined by the array of teeth onto the top 280 surface of the shield 220 such that the hair-penetrating shield protects the space beneath the bottom surface from the non-viscous hair-coloring agent.

In some embodiments, each tooth has a top-bottom midpoint 249 that is midway between the tooth's top 352 and bottom 362, and wherein for the majority of teeth of the tooth array, for most locations along the tooth axis within the section, a width ratio between: i) a first average tooth width describing the average tooth width below the top-bottom midpoint; and ii) a second average tooth width describing the average tooth width above the top-bottom midpoint is at least 1.2 (or at least 1.3 or at least 1.7 or at least 2).

In one example, for the majority of teeth, for most locations along the tooth axis, the width ratio is at least 1.6.

In some embodiments, for the majority of teeth, for most locations along the tooth axis, the tooth cross section is less than 5 mm^2 or less than 3 mm^2.

In some embodiments, for the majority of teeth, for most locations along the tooth axis: i) each pair of laterally neighboring teeth T1 and T2 are positioned to form a respective intertooth lateral void 390 that is in between the laterally neighboring teeth within a height range having upper and lower bounds: A) the upper bound being the lower height of the top 246 of tooth T1 and the top 246 of tooth T2, and B) the lower bound being the greater height of the bottom 246 of tooth T1 and the bottom 246 of tooth T2, and ii) a cross section of the respective intertooth void has an asymmetric width profile along the shield thickness axis 270 such that the void cross section, on average, is wider near the top of the intertooth void 390 and the intertooth void 390, on average, is narrower near the bottom of the intertooth void 390.

In some embodiments, i) each void has a top-bottom void mid-height level 923 that is midway between upper and lower bounds of the height range; ii) for the majority of teeth of the tooth array, for most locations along the tooth axis within the section, a width ratio between: i) a first average void width describing the average void width above the top-bottom void mid-height level; ii) a second average void width describing the average void width below the top-bottom void mid-height level, is at least 1.1 or at least 1.2 or at least 1.4 or at least 1.5 or at least 1.6 or at least 1.8 or at least 2.

It is now disclosed for the first time a hair-coloring device for coloring hair roots, the device comprising: a) a hair-penetrating shield 220 having top 280 and bottom 290 surfaces, comprising a slot array having at least eight (or at least 10 or at least 12 or at least 14 or at least 16 or at least 20) elongated shield-thickness-spanning narrow slots 480 that are substantially aligned a proximal-distal direction, the hair-penetrating shield 220 including a longitudinal section of at least 2.5 cm where: i) for a majority of slots of the array, each slot provide a shield-thickness-spanning property throughout a majority of the longitudinal section (reminder—as for any 'majority' feature this may be a significant or very significant majority); ii) an array-wide average cross-section-minimum-slot width is between 0.3 mm and 1 mm and/or for the majority of slots of the array each provide, throughout a majority of the longitudinal-subsection cross-section-minimum-slot width that is between 0.3 mm and 1 mm (or at most 0.8 mm); iii) for the majority of slots of the slot array, a slot aspect ratio within the longitudinal section is at least 30 (or at least 40 or at least 50 or at least 60 or at least 70 or at least 80 or at least 90 or at least 100) the slot aspect ratio being defined by a ratio between the slot length within the section and an individual-slot longitudinal-averaged cross-section-minimum-slot width averaged over the longitudinal section; iv) an array-wide average slot-slot lateral distance within the longitudinal section is at most 3 mm and/or at most a value equal to 3 times the array-wide average cross-section-minimum-slot width within the longitudinal section the hair-penetrating shield including a plurality of elongated, tapered penetrating elements (for example, having a minimum length of 2 mm or 3 mm or 4 mm and a ratio between length and average width of at least 1.5 or at least 2) located at the distal end of the shield 220; and b) an aerosol assembly 400 coupled to the hair-penetrating shield, the aerosol assembly including an aerosol outlet elevated above the top surface 280 of the shield, the aerosol assembly configured to dispense a non-viscous hair-coloring agent as a mist in a proximal-distal direction defined by the array of teeth onto the top 280 surface of the shield 220 such that the hair-penetrating shield protects the space beneath the bottom surface from the non-viscous hair-coloring agent.

In some embodiments, the laterally-spaced distal penetrating elements may be spaced in integral multiples of the slot-slot widths and/or configured to correspond to the slots.

In some embodiments, for each slot of the majority of slots, for most longitudinal locations within the longitudinal section, the slot exhibits an asymmetric width profile along the shield thickness axis 270 such that the slot thickness is narrower near the bottom surface 290 of the shield than it is near the top surface 280 of the shield.

In some embodiments, for a majority of a region that is laterally bound by the first and last slot of the slot array and within the longitudinal section, the top surface 280 is rough relative to the bottom surface 290 for a topographic length scale of 1 mm.

It is now disclosed hair-coloring device for coloring hair roots, the device comprising: a) a hair-penetrating shield 220 comprising a tooth array having top 280 and bottom 290 surfaces and having proximal 228 and distal 224 ends, the tooth array including at least eight (or at least 10 or at least 12 or at least 14 or at least 16 or at least 20) closely-spaced teeth such that for a majority of teeth of the tooth array (or a significant or very significant majority—like for any feature) i) each tooth of the majority includes a main portion 330 and a tapered distal portion 240 for facilitating hair penetration; ii) each tooth of the majority includes a longitudinal section having a length of at least 2.5 cm where: A) the aspect ratio of the tooth within the section is at least 20, the tooth aspect ratio between defined by a ratio between the tooth length within the section and a square root of the longitudinally-averaged tooth cross section within the section; B) for most locations within the tooth longitudinal section, the tooth cross-section is less than 5 mm^2 (or less than 3 mm^2); iii) for most locations within the longitudinal section, the tooth is separated from a laterally neighboring tooth to provide a minimum gap distance 370 that is between 0.3 mm and 1 mm, b) an aerosol assembly 400 coupled to the hair-penetrating shield, the aerosol assembly including an aerosol outlet elevated above the top surface of the shield, the aerosol assembly configured to dispense a non-viscous hair-coloring agent as a mist in a proximal-distal direction defined by the array of teeth onto the top 280 surface of the shield 220 such that the hair-penetrating shield protects the space beneath the bottom surface from the non-viscous hair-coloring agent.

It is now disclosed a hair-coloring device for coloring hair roots, the device comprising: a) a hair-penetrating shield 220 comprising a tooth array having top 280 and bottom 290 surfaces and having proximal 228 and distal 224 ends, the tooth array including at least eight (or at least 10 or at least 12 or at least 14 or at least 16 or at least 20) closely-spaced teeth such that for a majority of teeth of the tooth array: i) each tooth of the majority includes a main portion 330 and a tapered distal portion 240 for facilitating hair penetration; ii) each tooth of the majority includes a longitudinal section having a length of at least 2.5 cm where: i) for most locations within the tooth longitudinal section, the tooth cross-section is less than 5 mm^2 (or less than 3 mm^2 or less than 2.5 mm^2 or less than 2 mm^2); ii) the tooth is separated from a laterally neighboring tooth to provide a minimum gap distance 370, a ratio between a length of the longitudinal section of the tooth and the longitudinally-averaged minimum gap distance with the laterally neighboring tooth being at least 30 (or at least 40 or at least 50 or at least 60), the minimum gap distance 370 being, for most locations within the longitudinal section, that is between 0.3 mm and 1 mm; and b) an aerosol assembly 400 coupled to the hair-penetrating shield, the aerosol assembly including an aerosol outlet elevated above the top surface of the shield, the aerosol assembly configured to dispense a non-viscous hair-coloring agent as a mist in a proximal-distal direction defined by the array of teeth onto the top 280 surface of the shield 220 such that the hair-penetrating shield protects the space beneath the bottom surface from the non-viscous hair-coloring agent.

It is now disclosed a hair-coloring device for coloring hair roots, the device comprising: a) a hair-penetrating shield 220 comprising a tooth array having top 280 and bottom 290 surfaces and having proximal 228 and distal 224 ends, the tooth array including at least eight (or at least 10 or at least 12 or at least 14 or at least 16 or at least 20) closely-spaced teeth such that for a majority of teeth of the tooth array (or a significant or very significant majority) i) each tooth of the majority includes a main portion 330 and a tapered distal portion 240 for facilitating hair penetration; and ii) for each tooth of the majority, the main portion 330 includes a section having a length of at least 2.5 cm where for most locations along the tooth axis within the section: A) a cross section of the tooth has an substantial triangular shape, the substantial triangle pointing upwards along the shield thickness axis 270; and B) the tooth cross-section is less than 5 mm^2; and b) an aerosol assembly 400 coupled to the hair-penetrating shield, the aerosol assembly including an aerosol outlet elevated above the top surface 280 of the shield, the aerosol assembly configured to dispense or spray out a non-viscous hair-coloring agent as a mist in a proximal-distal direction defined by the array of teeth onto the top 280 surface of the shield 220 such that the hair-penetrating shield protects the space beneath the bottom surface from the non-viscous hair-coloring agent.

A Second Additional Discussion

Referring now to the drawings, FIGS. 1-5 illustrate a hair coloring applicator constructed in accordance with the present embodiments and particularly useful for touching-up hair along a hair line in a quick and convenient manner.

As shown particularly in the exploded view of FIG. 5, the hair coloring applicator comprises four main components: a container, generally designated 10, for containing a quantity of a hair coloring composition; an attachment 20 attachable to one end of container 10; a shield 30 carried by the attachment; and an outer housing 40 enclosing container 10 and serving as a handle for grasping and manipulating the applicator.

As clearly seen in FIG. 5, container 10 is an aerosol container of cylindrical configuration and may be of any known construction. It includes a quantity of the hair coloring composition to be dispensed, which may be in powder or liquid form; preferably, it also includes a propellant gas for dispensing the hair coloring composition in the form of a spray. One end of aerosol container 10 includes an outlet 12 in the form of a nozzle through which the composition is dispensed, and a valve indicated at 14, which is normally closed, but which is opened upon tilting or depressing nozzle 12, to dispense the composition in the form of a spray via the nozzle.

Attachment 20 is removably attachable to the end of aerosol container 10 including the nozzle 12. Attachment 20 includes a shield 30, which, as will be more particularly described below, exposes the root regions of the hairs to be touched-up, to the hair coloring composition spray dispensed via nozzle 12 when valve 14 is opened, while at the same time effectively blocking the individual's scalp from exposure to the hair coloring composition spray. Shield 30 is fixedly attached to attachment 20, but may also be removably attachable thereto for replacement or cleaning purposes. The shield and/or attachment may be constructed for one-time use, or for repeated use.

The lower end 21 of attachment 20 is of a cylindrical configuration and has an inner diameter substantially equal to the outer diameter of the aerosol container 10. One side of attachment 20 is formed with a slanted top wall 22 terminating in a top rim 23 formed with a projection 24 for receiving the shield 30 with a friction or snap fit. When attachment 20 is applied over the upper end of aerosol container 10, an opening 25 in slanted wall 22 is aligned with nozzle 12 of the aerosol container, whereas a push button 25 is aligned with valve 14 of the aerosol container. The construction is such that upon depression of the push button, nozzle 12 of the container is tilted or depressed to open valve 14, thereby to produce a spray of the hair coloring composition over the outer surface of shield 30 via opening 25 in the attachment.

As seen particularly in FIG. 5, opening 25 of attachment 20 is located between push button 26 and the shield 30 attached to peripheral wall 23 of the attachment. Nozzle 12, and opening 25 in the attachment are oriented to produce a fan-shaped spray directed towards the proximal (inner) end of the shield.

Shield 30 includes a plurality of spaced teeth 31 extending substantially parallel to the longitudinal axis LA of aerosol container 10 and integrally formed with a spline 32 extending substantially perpendicularly to the longitudinal axis LA. As shown particularly in FIG. 3, the teeth 31 of shield 30 are arrayed in a substantially linear array, which array is offset from the longitudinal axis LA of the aerosol container. Teeth 31 are of small width and thickness and are closely spaced. Preferably, they are less than 2 mm in width, thickness and spacing, and are tapered to points at their outer tips.

As will be described more particularly below, when the applicator is used for touching-up hair along a hair line, the applicator is manipulated such that surface 30*a* of shield 30 serves an inner surface pressed against the individual's scalp, whereas surface 30*b* serves as an outer surface which is exposed to the hair coloring composition spray dispensed from nozzle 12 of the aerosol container 10 via opening 22 of the attachment 20.

As shown in FIG. 5, the outer housing 40 of the applicator is also of cylindrical configuration corresponding to the cylindrical configuration of the aerosol container 10. The inner diameter of housing 40 is substantially equal to the outer diameter of aerosol container 10 so as to snugly receive the aerosol container, and thereby to act as a handle for gripping and manipulating the applicator. Preferably the upper surface 41 of outer housing 40, and the inner rim 27 of the attachment 20, are of complementary curved configurations so as to present a pleasing appearance to the applicator when all the parts are assembled as shown in FIGS. 1 and 3, for example.

Figure 2:
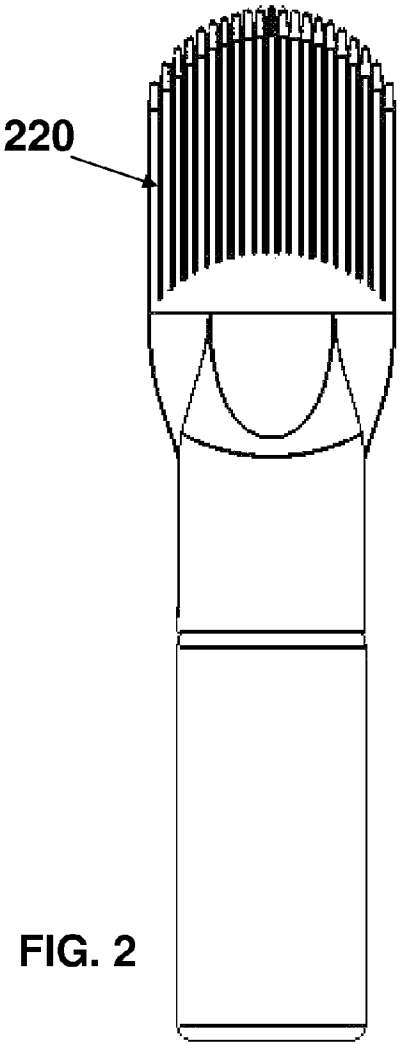
Figure 3:
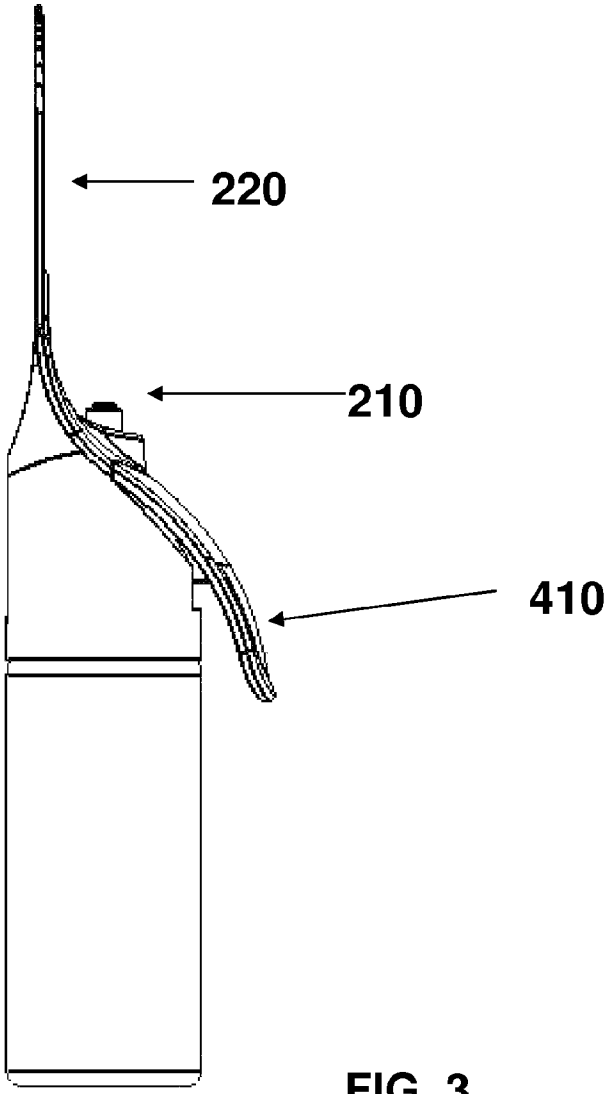
Figure 4:
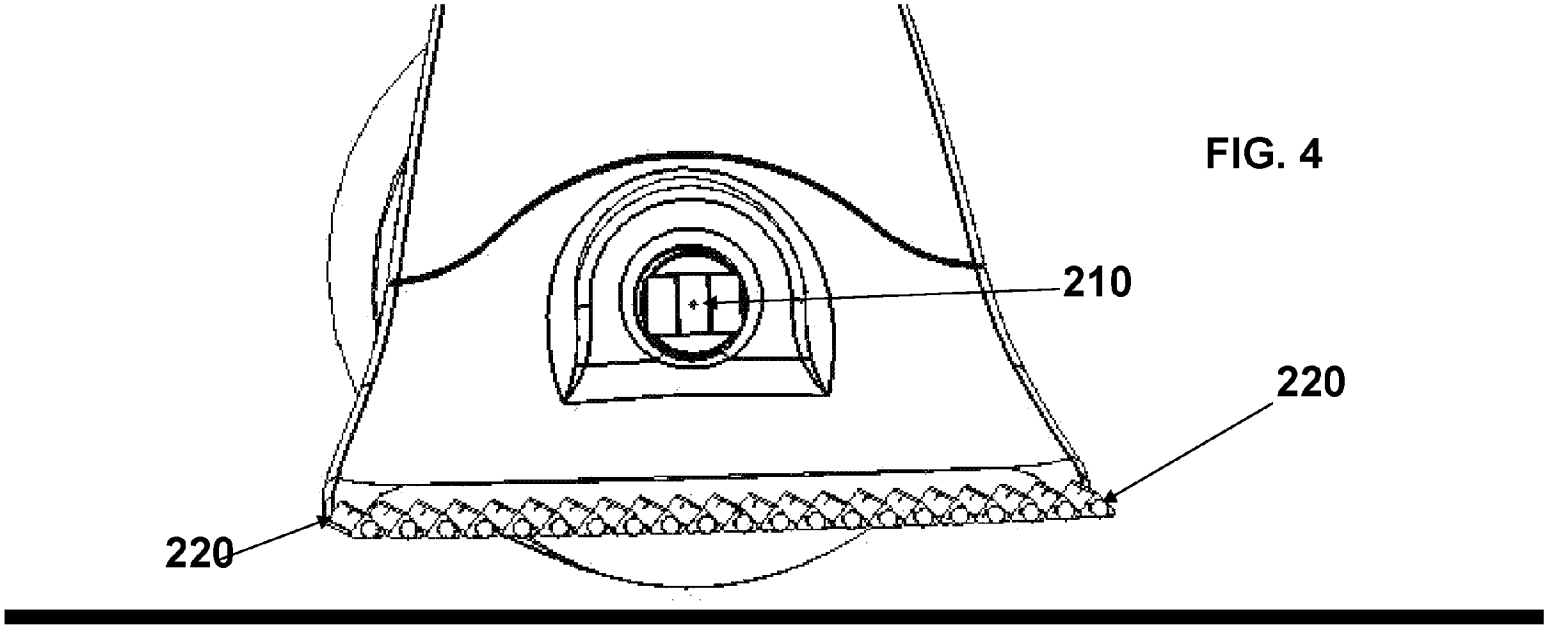

The manner of using the applicator of FIGS. 1-5 will be apparent from the above description. Thus, after all its parts have been assembled, as shown in FIGS. 1-3, the user grasps the outer housing 40, orients the shield 30 such that surface 30*a* faces and presses against the individual's scalp, and manipulates the applicator such that the root regions of the hairs along the hairline to be touched-up are received in the spaces between teeth 31. The user then depresses push button 26, to produce a spray via nozzle 12 over the outer side 30*b* of the shield 30, while the shield is moved along the hair line to be touched-up. The so-produced spray of hair coloring composition coats the root regions of the hairs exposed by teeth 31 at the proximal end of shield 30, whereas the remainder of the shield effectively blocks the passage of the hair coloring composition spray to the individual's scalp.

After the hair coloring composition has been depleted from aerosol container 10, the holder 40, attachment 20 and shield 30 may be disassembled and applied to a fresh aerosol container 10.

The hair coloring applicator illustrated in FIGS. 6-10 is also constructed of basically the same parts as the applicator of FIGS. 1-5, namely including an aerosol container 110 (FIG. 10), an attachment 120 applied to one end of the aerosol container, a shield 130 carried by the attachment, and an outer housing 140 enclosing aerosol container 110 and serving as a handle for gripping and manipulating the applicator.

The main difference in the applicator illustrated in FIGS. 6-10 over that illustrated in FIGS. 1-5 is that the outer housing 140, and the attachment 120, are not of a cylindrical configuration, but rather of a substantially square configuration with rounded corners, so as to present a more comfortable gripping of the applicator when manipulating it, as well as a more pleasing outer appearance to the applicator.

In all other respects, the applicator illustrated in FIGS. 6-10 is constructed and used in substantially the same manner as described above with respect to FIGS. 1-5.

While the applicator has been described with respect to two preferred embodiments, it will be appreciated that these are set forth merely for purposes of example, and that many other variations and applications of the invention may be made. For example, instead of using an aerosol container for dispensing the hair-dye in the form of a spray, a pump-type container may be used wherein the push button 26 is effective to pump out a spray of the hair-dye, rather than to open a valve permitting the propellant fluid within the container to produce the hair-dye spray. Also, the push button may be on a side wall of the container rather than on the attachment. Further, the teeth of the shield may be non-parallel to the longitudinal axis of the container, e.g., 90° or less.

The applicators described herein may contain any hair coloring composition suitable for coloring hair, preferably suitable for "touching-up" local areas of an individual's hair, and more preferably suitable for touching-up hair along a hairline of a subject.

The hair coloring composition can include any hair coloring agent(s) (pigments), formulated with a suitable carrier (e.g., designed for forming a hair coloring composition in the form of a spray). Preferably, the hair coloring composition is for temporarily coloring hair. While the applicators described herein may contain any suitable hair coloring composition, the present inventors have developed hair-coloring agents, formulations and compositions that are particularly useful when used in the context of these and other embodiments of the present invention.

A Third Additional Discussion

According to one aspect of the embodiments of the present invention, there is provided a hair-coloring applicator comprising a container for containing a quantity of hair-coloring composition including an outlet at one end of the container through which the hair-coloring composition may be dispensed, and a shield projecting outwardly from one end of the container. The shield includes a plurality of closely spaced teeth having inner surfaces to be pressed against the subject's scalp with the root regions of the hairs passing through the spaces between the teeth, and outer surfaces to be exposed to the hair-coloring spray composition dispensed from the container such that the hair-coloring composition coats the root regions of the hairs passing through the spaces between the teeth, while the teeth substantially block the hair-coloring composition from reaching the subject's scalp. The abovementioned applicator is particularly useful for touching-up hair along a hairline of an individual.

As used herein, the phrase "touching-up" describes the coloring of hair in a quick and simple manner. This phrase further describes the coloring of local areas of hair, particularly local areas of gray or white hair such as the root region or parts thereof. The phrase "root region" describes the part of a hair closest to the scalp.

According to an embodiment of the present invention, the shield is carried by an attachment to the end of the container, and the container is an aerosol container for dispensing the hair-coloring composition in the form of a spray through a nozzle.

As used herein, the phrase "aerosol container" describes any container suitable for releasing a composition contained therein in the form of a spray. For example, the container should be capable of withstanding the internal pressure of a pressurized composition, and the nozzle should be configured so as to allow escaping pressurized composition to escape in the form of an aerosol.

In some embodiments, the abovementioned attachment includes an opening aligned with the nozzle.

According to an embodiment of the present invention, the abovementioned attachment further includes a push button controlling the dispensing of hair-coloring composition via the nozzle. In some embodiments, the abovementioned opening in the attachment that is aligned with the nozzle is located between the shield and the push button, such that the push button can be reached through the opening.

According to an embodiment of the present invention, the push button and the opening are located on an outer surface of the attachment, wherein the attachment slants towards the shield.

According to an embodiment of the present invention, the spaced teeth of the shield are parallel to the longitudinal axis of the container. Preferably, the teeth are arrayed in a generally linear array that is laterally spaced from the longitudinal axis of the container.

According an embodiment of the present invention, the teeth are less than 2 mm in width, thickness, and spacing.

According to an embodiment of the present invention, the teeth are tapered to a point at their outer tips.

According to an embodiment of the present invention, the applicator further comprises an outer housing enclosing the abovementioned container, the outer housing serving as a handle for gripping and manipulating the applicator. The outer housing may have any shape that is suitable for being held by hand.

According to an embodiment of the present invention, the outer housing and the container are both cylindrical.

According to another embodiment of the present invention, the container is cylindrical, and the outer housing is non-cylindrical.

According to an embodiment of the present invention, there is provided a hair coloring applicator comprising a container containing a quantity of hair coloring composition and including an outlet at one end of the container through which the hair coloring composition is dispensed and an attachment attached to the end of the container carrying the outlet, the attachment including a shield. The shield has a plurality of spaced teeth which pass between the subject's hairs to expose the root regions of the hairs passing through the teeth, while the teeth substantially block the hair coloring composition from passing through to the subject's scalp. Such an applicator is particularly useful for touching-up hair along a hairline of a subject.

According to some embodiments of the present invention, each of the hair coloring compositions described herein is identified for use in temporary hair coloring and/or in coloring white or gray hair.

According to some embodiments of the present invention, each of the hair coloring compositions described herein is identified for use in touching-up hair along a hairline of an individual.

In one embodiment of the present invention, any of the hair coloring compositions described herein is packaged in an applicator adapted for dispensing the composition onto hair, and identified for use in hair coloring, as described hereinabove.

Any applicator suitable for applying a composition onto hair may be used. Exemplary applicators include, but are not limited to, a wick-type applicator, a squeeze bottle, an aerosol container, a comb-type applicator, a drop dispenser and a pump-type applicator.

As used herein, the phrase "wick-type applicator" encompasses any applicator comprising a wick which absorbs a quantity of a liquid composition, wherein the composition may be applied to a surface by contacting the wick with the absorbed composition to the surface. The quantity of the composition absorbed in the wick may be replenished, for example, by dipping the wick into a quantity of the composition stored in a container, or by part of the wick being in continuous contact with the composition in a container, the composition being drawn into the wick via absorption by the wick. The container containing the composition may serve as a component of the applicator along with the wick.

As used herein, the term "wick" describes an article-of-manufacturing capable of absorbing a liquid and of allowing the liquid to escape from the surface of the article-of-manufacturing.

As used herein, the phrase "squeeze bottle" encompasses any applicator comprising a container for storing a composition, the container having at least one flexible wall, wherein the composition may be forced out of the container by applying force (e.g. squeezing) to the flexible wall(s) of the container. Typically, the container includes a valve that allows a composition to exit the container under a certain pressure (such as the pressure generated by applying force to the flexible wall of the container), but which prevents composition from leaving the container in the absence of such pressure.

As used herein, the phrase "comb-type applicator" encompasses any applicator comprising a comb or a brush, the comb or brush having a quantity of composition adhered thereto, wherein the composition may be applied to a surface by contacting the comb or brush to the surface. The quantity of composition which is adhered to the comb or brush may be replenished by contacting the comb or brush with a composition stored in a container. The container may serve as a component of the applicator.

As used herein, the phrase "drop dispenser" encompasses any applicator comprising a container containing therein a liquid composition, the container having a small opening which allows the passage of a small quantity of the composition from the inside of the container through the opening to the outer surface of the container, thereby resulting in a small quantity of composition (i.e. a drop) on the outer surface of the container. The drop of composition may be applied to a surface by contacting the drop with the surface. The liquid composition in the container may be replenished from a larger quantity of composition stored in a larger container, which may serve as a component of the applicator.

As defined herein, the phrase "pump-type applicator" encompasses any applicator comprising a container for storing a composition with a pump attached thereto, wherein the composition may be forced out of the container by a pressure applied by the pump. The container may include a valve that allows a composition to exit the container under a pressure applied by the pump, but which prevents composition from leaving the container in the absence of such pressure. The pressure applied by the pump may be generated by any means, including, but not limited to, by hand (e.g. a syringe), by a spring, by an electronic motor, or by a pressurized fluid.

As used herein, the phrase "aerosol container", when used to describe an applicator, encompasses any applicator comprising an aerosol container, as this phrase has been defined hereinabove. An applicator described as an aerosol container may include additional components besides the aerosol container.

When the hair coloring composition is a composition useful for coloring white and/or gray hair, the composition is preferably identified as such.

When the hair coloring composition is a composition useful for temporary hair coloring, the composition is preferably identified as such.

When the hair coloring composition is a composition useful for touching-up hair along a hairline of an individual, the composition is preferably identified as such.

The applicators, hair coloring agents and hair coloring compositions described hereinabove are particularly advantageous when used in combination.

Hence, according to another aspect of the present invention, there is provided an applicator as described hereinabove, wherein a hair coloring composition to be contained therein comprises a suitable carrier and at least one hair coloring agent selected from the group consisting of a first hair coloring agent which comprises a purified polymer of tannic acid having iron ions bound thereto, being substantially devoid of unbound iron ions, and a second hair coloring agent which comprises a condensation polymer of a reducing carbohydrate and an amino acid, as these hair coloring agents are described herein.

The features of the composition are as described hereinabove. Preferably, in embodiments comprising an applicator which releases a composition in the form of a spray, the composition to be contained therein is in the form of a spray, as described hereinabove.

In another aspect of the present invention, there is provided an applicator, as described hereinabove, wherein the hair coloring composition to be contained therein comprises at least one hair coloring agent and a carrier which comprises a hydrophobic volatile solvent, water, a glycol and a surface active agent, as described hereinabove.

The features of the composition are as described hereinabove. Preferably, in embodiments comprising an applicator which releases a composition in the form of a spray, the composition to be contained therein is in the form of a spray, as described hereinabove.

In another aspect of the present invention, there is provided a hair coloring composition comprising both a carrier described hereinabove and at least one hair coloring agent described hereinabove.

The optional and preferable features of the composition are as described hereinabove.

In a preferred embodiment of the present invention, an applicator described hereinabove is combined with a hair coloring composition comprising both a carrier described hereinabove and at least one hair coloring agent described hereinabove.

Additional objects, advantages, and novel features of the present invention will become apparent to one ordinarily skilled in the art upon examination of the following examples, which are not intended to be limiting. Additionally, each of the various embodiments and aspects of the present invention as delineated hereinabove and as claimed in the claims section below finds experimental support in the following examples.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A hair-coloring device for coloring hair roots, the device comprising:

a) a hair-penetrating shield comprising a tooth array having a top surface and a smooth bottom surfaces and having proximal and distal ends, the tooth array including at least eight closely-spaced teeth such that for a majority of teeth of the tooth array:

i) each tooth of the majority includes a main portion and a tapered distal portion for facilitating hair penetration; and ii) for each tooth of the majority, the main portion includes a section having a length of at least 2.5 cm where for most locations along a tooth axis within the section:

A) a cross section of the tooth has an asymmetric width profile along a shield thickness axis such that the tooth cross section, on average, is narrower near the top of the tooth and the tooth cross section, on average, is wider near the bottom of the tooth;

B) the tooth cross-section is less than 5 mm^2; and

C) the tooth is separated from a laterally neighboring tooth to provide a minimum gap distance that is between 0.3 mm and 1 mm, and b) an aerosol assembly coupled to the hair-penetrating shield, the aerosol assembly including an aerosol outlet elevated above the top surface of the shield, the aerosol assembly configured to dispense a non-viscous hair-coloring agent as a mist in a proximal-distal direction defined by the array of teeth onto the top surface of the shield such that the hair-penetrating shield protects space beneath the bottom surface from the non-viscous hair-coloring agent.

2. The hair-coloring device of claim 1 wherein each tooth has a top-bottom midpoint that is midway between the tooth's top and bottom , and wherein for the majority of teeth of the tooth array, for most locations along the tooth axis within the section, a width ratio between:

i) a first average tooth width describing the average tooth width below the top-bottom midpoint;

ii) a second average tooth width describing the average tooth width above the top-bottom midpoint is at least 1.2.

3. The hair coloring device of claim 2 wherein for the majority of teeth, for most locations along the tooth axis, the width ratio is at least 1.6.

4. The hair coloring device of claim 1 wherein, for the majority of teeth, for most locations along the tooth axis, the tooth cross section is less than 3 mm^2.

5. The hair coloring device of claim 1 wherein, for the majority of teeth, for most locations along the tooth axis wherein:

i) each pair of laterally neighboring teeth T1 and T2 are positioned to form a respective intertooth lateral void that is in between the laterally neighboring teeth within a height range having upper and lower bounds,:

A) the upper bound being the lower height of the top of tooth T1 and the top of tooth T2, and B) the lower bound being the greater height of the bottom of tooth T1 and the bottom of tooth T2, and ii) a cross section of the respective intertooth void has an asymmetric width profile along the shield thickness axis such that the void cross section, on average, is wider near the top of the intertooth void and the intertooh void , on average, is narrower near the bottom of the intertooth void.

6. The hair coloring device of claim 1 wherein:

i) each void has a top-bottom void mid-height level that is midway between upper and lower bounds of the height range;

ii) for the majority of teeth of the tooth array, for most locations along the tooth axis within the section, a width ratio between:

A) a first average void width describing the average void width above the top-bottom void mid-height level;

B) a second average void width describing the average void width below the top-bottom void mid-height level, is at least 1.2.

7. The hair coloring device of claim 1 wherein the tooth array includes at least 14 closely-spaced teeth.

8. The hair-coloring device of claim 1 wherein the top surface is undulating in a lateral direction and/or a direction perpendicular to the tooth axis.

9. A hair-coloring device for coloring hair roots, the device comprising:

a) a hair-penetrating shield comprising a tooth array having a top surface and a smooth bottom surface and having proximal and distal ends, the tooth array including at least eight closely-spaced teeth such that for a majority of teeth of the tooth array:

i) each tooth of the majority includes a main portion and a tapered distal portion for facilitating hair penetration;

ii) each tooth of the majority includes a longitudinal section having a length of at least 2.5 cm where:

A) the aspect ratio of the tooth within the section is at least 20, the tooth aspect ratio between defined by a ratio between the tooth length within the section and a square root of the longitudinally-averaged tooth cross section within the section;

B) for most locations within the tooth longitudinal section, the tooth cross-section is less than 5 mm^2; and C) for most locations within the longitudinal section, the tooth is separated from a laterally neighboring tooth to provide a minimum gap distance that is between 0.3 mm and 1 mm, b) an aerosol assembly coupled to the hair-penetrating shield, the aerosol assembly including an aerosol outlet elevated above the top surface of the shield, the aerosol assembly configured to dispense a non-viscous hair-coloring agent as a mist in a proximal-distal direction defined by the array of teeth onto the top surface of the shield such that the hair-penetrating shield protects the space beneath the bottom surface from the non-viscous hair-coloring agent.

10. The hair coloring device claim 9 wherein the tooth array includes at least 14 closely-spaced teeth.

11. The hair-coloring device of claim 9 wherein the top surface is undulating in a lateral direction and/or a direction perpendicular to the tooth axis.

12. A hair-coloring device for coloring hair roots, the device comprising:

a) a hair-penetrating shield comprising a tooth array having a top surface and a smooth bottom surface and having proximal and distal ends, the tooth array including at least eight closely-spaced teeth such that for a majority of teeth of the tooth array:

i) each tooth of the majority includes a main portion and a tapered distal portion for facilitating hair penetration;

ii) each tooth of the majority includes a longitudinal section having a length of at least 2.5 cm where:

A) for most locations within the tooth longitudinal section, the tooth cross-section is less than 5 mm^2; and B) the tooth is separated from a laterally neighboring tooth to provide a minimum gap distance , a ratio between a length of the longitudinal section of the tooth and the longitudinally-averaged minimum gap distance with the laterally neighboring tooth being at least 30, the minimum gap distance being, for most locations within the longitudinal section, that is between 0.3 mm and 1 mm; and b) an aerosol assembly coupled to the hair-penetrating shield, the aerosol assembly including an aerosol outlet elevated above the top surface of the shield, the aerosol assembly configured to dispense a non-viscous hair-coloring agent as a mist in a proximal-distal direction defined by the array of teeth onto the top surface of the shield such that the hair-penetrating shield protects the space beneath the bottom surface from the non-viscous hair-coloring agent.

13. The hair coloring device of claim 12 wherein the tooth array includes at least 14 closely-spaced teeth.

14. The hair-coloring device of claim 12 wherein the top surface is undulating in a lateral direction and/or a direction perpendicular to the tooth axis.

15. A hair-coloring device for coloring hair roots, the device comprising:

a) a hair-penetrating shield comprising a tooth array having a top surface and a smooth bottom surface and having proximal and distal ends, the tooth array including at least eight closely-spaced teeth such that for a majority of teeth of the tooth array:

i) each tooth of the majority includes a main portion and a tapered distal portion for facilitating hair penetration; and ii) for each tooth of the majority , the main portion includes a section having a length of at least 2.5 cm where for most locations along a tooth axis within the section:

A) a cross section of the tooth has an substantial triangular shape, the substantial triangle pointing upwards along a shield thickness axis ; and B) the tooth cross-section is less than 5 mm^2; and b) an aerosol assembly coupled to the hair-penetrating shield, the aerosol assembly including an aerosol outlet elevated above the top surface of the shield, the aerosol assembly configured to dispense a non-viscous hair-coloring agent as a mist in a proximal-distal direction defined by the array of teeth onto the top surface of the shield such that the hair-penetrating shield protects space beneath the bottom surface from the non-viscous hair-coloring agent.

16. The hair-coloring device of claim 15 wherein the top surface is undulating in a lateral direction and/or a direction perpendicular to the tooth axis.

* * * * *